US010933276B2

(12) United States Patent
Matsubara

(10) Patent No.: US 10,933,276 B2
(45) Date of Patent: Mar. 2, 2021

(54) TRAINING GUIDANCE INSTRUMENT AND TRAINING GUIDANCE METHOD USING THE SAME

(71) Applicant: Hironobu Matsubara, Yao (JP)

(72) Inventor: Hironobu Matsubara, Yao (JP)

( * ) Notice: Subject to any disclaimer, the term of this patent is extended or adjusted under 35 U.S.C. 154(b) by 11 days.

(21) Appl. No.: 16/309,528

(22) PCT Filed: Jul. 3, 2017

(86) PCT No.: PCT/JP2017/024328
§ 371 (c)(1),
(2) Date: Dec. 13, 2018

(87) PCT Pub. No.: WO2018/008591
PCT Pub. Date: Jan. 11, 2018

(65) Prior Publication Data

US 2019/0308060 A1 Oct. 10, 2019

(30) Foreign Application Priority Data

Jul. 8, 2016 (JP) ..... JP2016-135515
Aug. 5, 2016 (JP) ..... JP2016-154268

(51) Int. Cl.
*A63B 21/00* (2006.01)
*A63B 21/008* (2006.01)
*A63B 23/10* (2006.01)

(52) U.S. Cl.
CPC .... *A63B 21/4034* (2015.10); *A63B 21/00069* (2013.01); *A63B 21/0087* (2013.01);
(Continued)

(58) Field of Classification Search
CPC ..... A63B 21/4034; A63B 21/00069; A63B 21/0087; A63B 21/159; A63B 23/10; A63B 2208/0204
See application file for complete search history.

(56) References Cited

U.S. PATENT DOCUMENTS 3,814,420 A * 6/1974 Encke ..... A63B 21/04 482/130
4,934,688 A * 6/1990 Lo ..... A63B 22/0056 482/111

(Continued)

FOREIGN PATENT DOCUMENTS

JP 61-16170 U 1/1986
JP 2-39765 U 3/1990

(Continued)

OTHER PUBLICATIONS

Official Communication issued in International Patent Application No. PCT/JP2017/024328, dated Sep. 12, 2017.

(Continued)

*Primary Examiner* — Garrett K Atkinson
(74) *Attorney, Agent, or Firm* — Keating and Bennett, LLP

(57) ABSTRACT

A training guidance instrument 200 includes a pressor part 2091, a heel placing part 2092A, and a control unit including rotary members 210 and 214, support members 211 and 215, rotary parts 202A and 202B, support members 212 and 216, and telescopic members 219 and 220. The control unit is configured to move the heel placing part 2092A toward the ground in response to application of a force Pw2 toward the ground which is stronger than upward force applied on the heel placing part 2092A when the heel placing part 2092A is positioned above and away from the ground and move the heel placing part 2092A upward in response to application of weaker force toward the ground than the force Pw2 on the heel placing part 2092A, while the second joint and third joints of the toes of the trainee are pressed by the pressor part 2091 and the heel is placed on the heel placing part 2092A.

1 Claim, 29 Drawing Sheets

(52) U.S. Cl.
CPC ..... *A63B 21/159* (2013.01); *A63B 23/10* (2013.01); *A63B 2208/0204* (2013.01)

(56) References Cited

U.S. PATENT DOCUMENTS 5,035,421 A * 7/1991 Scheller ..... A63B 21/023 482/130
5,267,923 A * 12/1993 Piaget ..... A63B 21/0085 482/52
5,336,143 A * 8/1994 Wu ..... A63B 21/157 482/52
5,354,251 A * 10/1994 Sleamaker ..... A63B 21/156 482/96
5,611,770 A * 3/1997 Tesch ..... A61H 1/0266 482/131
5,676,623 A * 10/1997 Yu ..... A63B 21/154 482/53
5,928,115 A * 7/1999 Arroyo, Jr. ..... A63B 22/0002 482/51
6,244,992 B1 * 6/2001 James ..... A61H 1/0237 482/19
6,589,141 B1 * 7/2003 Flaggs ..... A63B 23/04 482/79
6,705,975 B2 * 3/2004 Kuo ..... A63B 22/0056 482/51
6,709,368 B1 * 3/2004 Chue ..... A63B 21/015 482/52
6,899,658 B1 * 5/2005 Chuang ..... A63B 22/001 482/53
6,913,561 B2 * 7/2005 Wu ..... A61H 1/0214 482/52
6,916,279 B2 * 7/2005 Endelman ..... A63B 21/04 482/123
7,041,037 B2 * 5/2006 Huang ..... A63B 22/0064 482/53
7,364,534 B2 * 4/2008 Zoller ..... A63B 23/08 482/79
7,614,978 B2 * 11/2009 Piaget ..... A63B 21/0085 482/112
7,635,321 B2 * 12/2009 Hill ..... A63B 21/00047 482/79
7,648,444 B2 * 1/2010 Johnson ..... A63B 22/16 482/52
7,794,378 B2 * 9/2010 Splane, Jr. ..... A63B 21/02 482/142
7,985,168 B2 * 7/2011 Reyes ..... A63B 21/00072 482/130
7,988,602 B1 * 8/2011 Janzen ..... A61H 1/0266 482/148
8,360,940 B2 * 1/2013 Kole ..... A63B 21/028 482/121
8,430,796 B1 * 4/2013 Tarkington ..... A63B 23/03541 482/51
8,784,286 B2 * 7/2014 Reyes ..... A63B 21/00072 482/130
D727,441 S * 4/2015 Chuang ..... D21/687
9,132,308 B2 * 9/2015 Kole ..... A63B 21/028
9,415,260 B2 * 8/2016 Islas ..... A63B 23/10
9,533,190 B2 * 1/2017 Walkama ..... A63B 26/00
9,757,615 B2 * 9/2017 Walkama ..... A63B 26/00
9,914,009 B2 * 3/2018 Tarkington ..... A63B 23/03541
9,919,178 B2 * 3/2018 Morton ..... A63B 21/0552
10,046,196 B2 * 8/2018 Ercanbrack ..... A63B 23/03516
10,174,506 B2 * 1/2019 Kim ..... E04F 11/17
10,434,357 B2 * 10/2019 McCarthy ..... A63B 21/4047
2002/0165069 A1 * 11/2002 Ravikumar ..... A63B 23/10 482/80
2005/0049116 A1 * 3/2005 Huang ..... A63B 22/0064 482/51
2005/0079959 A1 * 4/2005 Wu ..... A61H 1/0214 482/53
2005/0164844 A1 * 7/2005 Johnson ..... A63B 22/16 482/79
2008/0096745 A1 * 4/2008 Perry ..... A63B 22/00 482/148
2010/0248916 A1 * 9/2010 Reyes ..... A63B 21/00072 482/130
2011/0092339 A1 * 4/2011 Stewart ..... A43B 13/18 482/52
2011/0287911 A1 * 11/2011 Reyes ..... A63B 21/00072 482/130
2013/0045841 A1 * 2/2013 Chen ..... A63B 69/18 482/71
2015/0165255 A1 * 6/2015 Chen ..... A63B 21/00189 482/130
2015/0165260 A1 * 6/2015 Tarkington ..... A63B 23/03541 482/80
2015/0245938 A1 * 9/2015 Honda ..... A61F 5/019 602/30
2016/0199690 A1 * 7/2016 Islas ..... A63B 23/10 482/79
2017/0056717 A1 * 3/2017 Ercanbrack ..... A63B 22/0664
2017/0087405 A1 * 3/2017 Walkama ..... A63B 26/00
2017/0165517 A1 * 6/2017 Morton ..... A63B 21/0552
2018/0339192 A1 * 11/2018 Bujold ..... A63B 23/04
2019/0160322 A1 * 5/2019 McCarthy ..... A63B 21/00069
2019/0308057 A1 * 10/2019 Chen ..... A63B 21/4034

FOREIGN PATENT DOCUMENTS

JP 10-94403 A 4/1998
JP 2003-293206 A 10/2003
JP 2007-82997 A 4/2007
JP 2007-83023 A 4/2007
JP 2007-185453 A 7/2007
JP 2013-31642 A 2/2013
JP 2015-178041 A 10/2015
WO 2006/118377 A1 11/2006

OTHER PUBLICATIONS

Matsubara, "Training Guidance Instrument and Training Guidance Method Using the Same", U.S. Appl. No. 16/953,412, filed Nov. 20, 2020.

* cited by examiner

FIG. 3

| POSITION OF GATE VALVE 2195 | PRESSURE $P_A$ | POSITION OF GATE VALVE2196 | PRESSURE $P_B$ |
|---|---|---|---|
| UPPER LIMIT POSITION $Z_{A_1}=Z_{A_U}$ | $P_{0A_1}(=P_{AMIN})$ ↓ $P_{A-1}(>P_{AMIN})$ | INITIAL POSITION ↓ POSITION ABOVE INITIAL POSITION | $P_{0B}(<P_{0A_1})$ ↓ $P_{B_1}(<P_{A_1}, P_{0B})$ |
| POSITION $Z_{A_2}(<Z_{A_1})$ | $P_{0A_2}(>P_{0A_1})$ ↓ $P_{A-2}(>P_{0A_2})$ | INITIAL POSITION ↓ POSITION ABOVE INITIAL POSITION | $P_{0B}$ ↓ $P_{B_2}(<P_{A_2}, P_{0B})$ |
| POSITION $Z_{A_3}(<Z_{A_2})$ | $P_{0A_3}(>P_{0A_2})$ ↓ $P_{A-3}(>P_{0A_3})$ | INITIAL POSITION ↓ POSITION ABOVE INITIAL POSITION | $P_{0B}$ ↓ $P_{B_3}(<P_{A_3}, P_{0B})$ |
| ⋮ | ⋮ | ⋮ | ⋮ |
| POSITION $Z_{A_n-1}(<Z_{A_n-2})$ | $P_{0A_n-1}(>P_{0A_n-2})$ ↓ $P_{A-n-1}(>P_{0A_n-1})$ | INITIAL POSITION ↓ POSITION ABOVE INITIAL POSITION | $P_{0B}$ ↓ $P_{B_n-1}(<P_{A_n-1}, P_{0B})$ |
| LOWER LIMIT POSITION $Z_{A_n}=Z_{A_L}$ | $P_{0A_n}(=P_{AMAX})$ $(>P_{0A_n-1})$ ↓ $P_{A-n}(>P_{0A_n}=P_{AMAX})$ | INITIAL POSITION ↓ POSITION ABOVE INITIAL POSITION | $P_{0B}$ ↓ $P_{B_n}(<P_{A_n}, P_{0B})$ |

FIG. 7
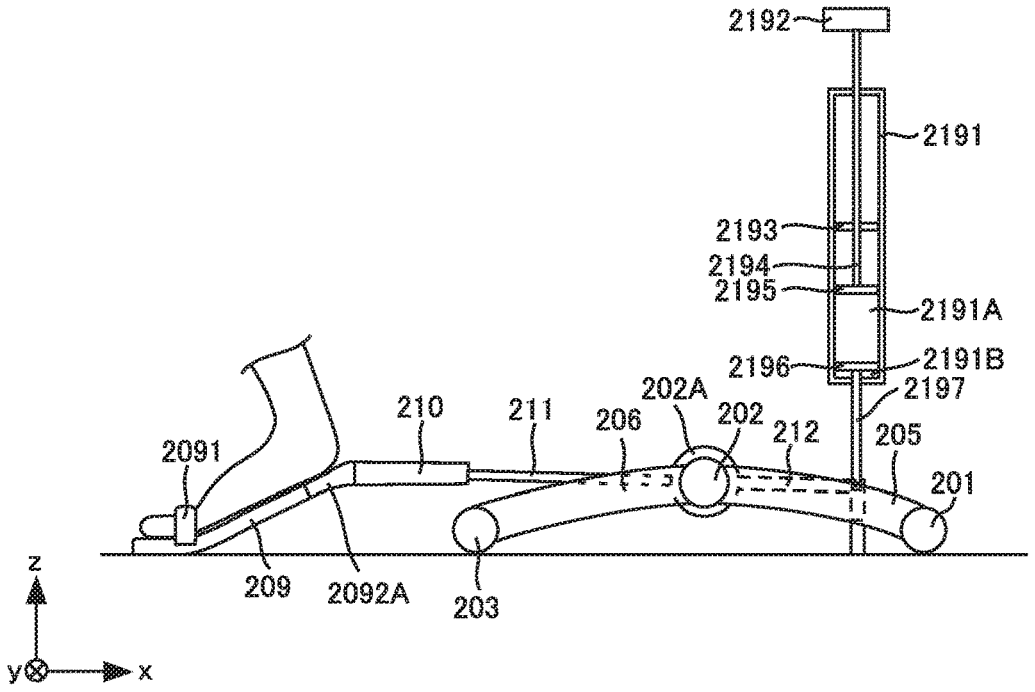
(a)
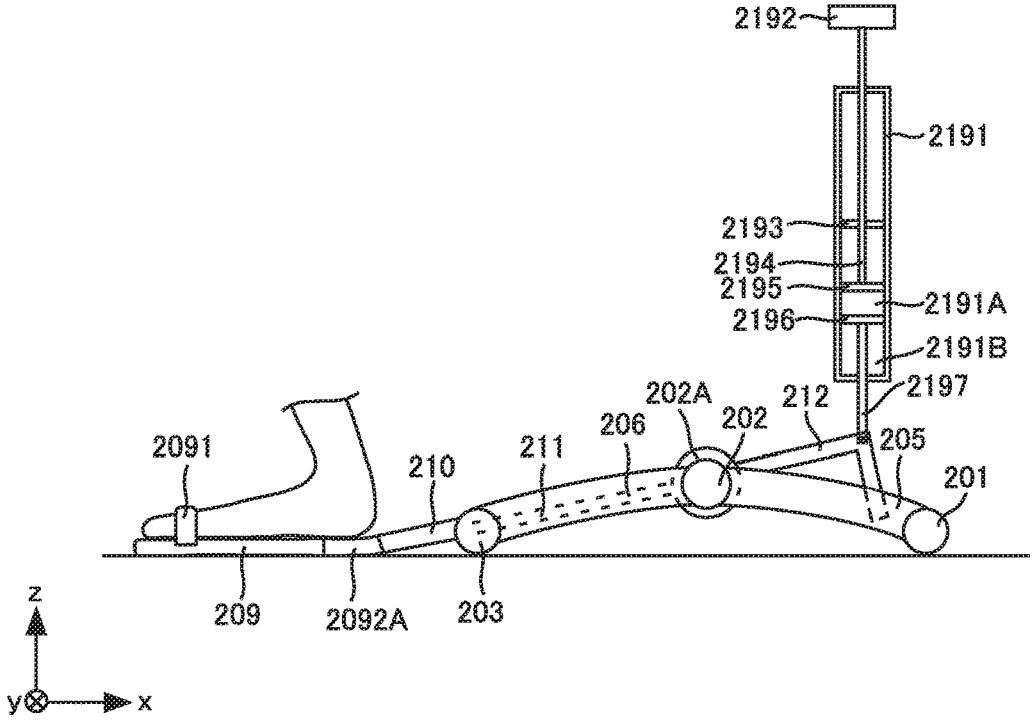
(b)

FIG. 15
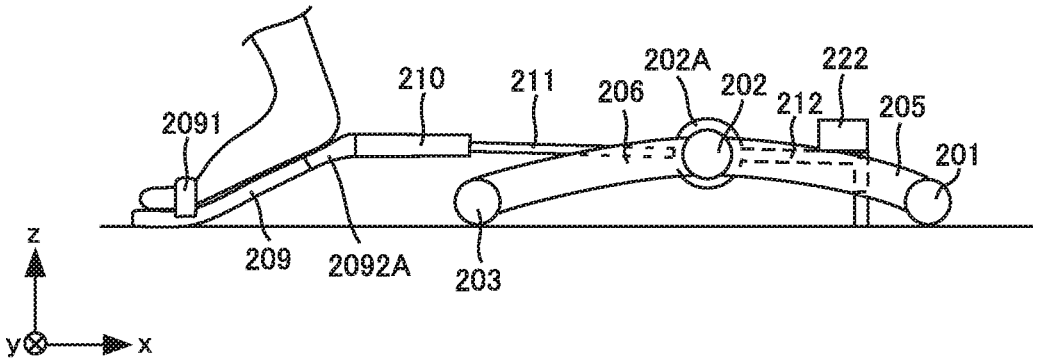
(a)
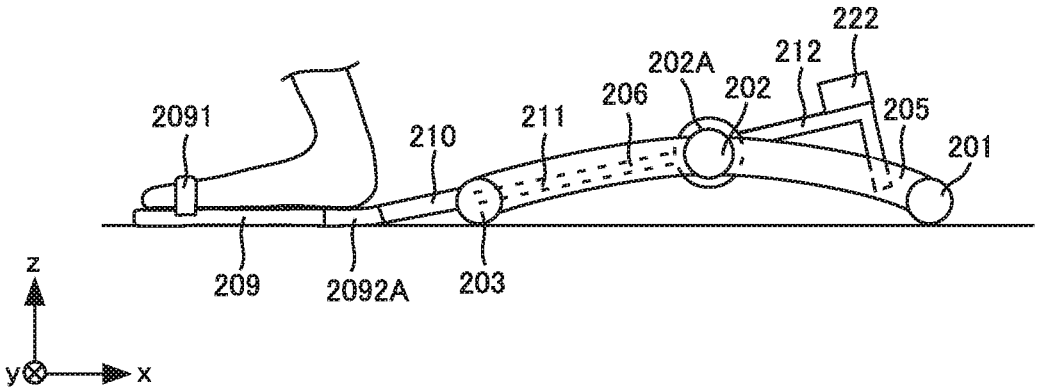
(b)

FIG. 16
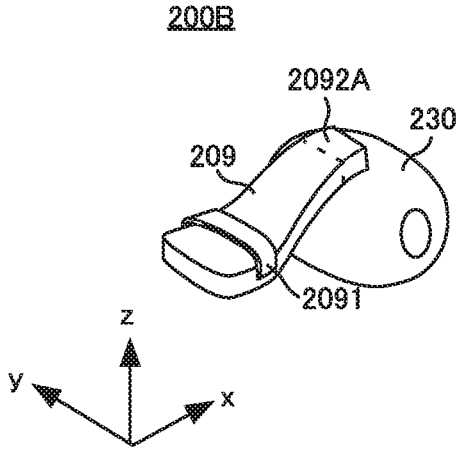
FIG. 17
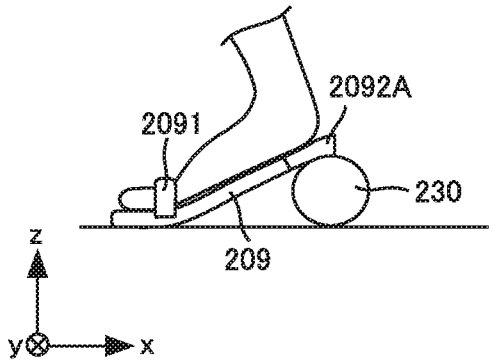
(a)
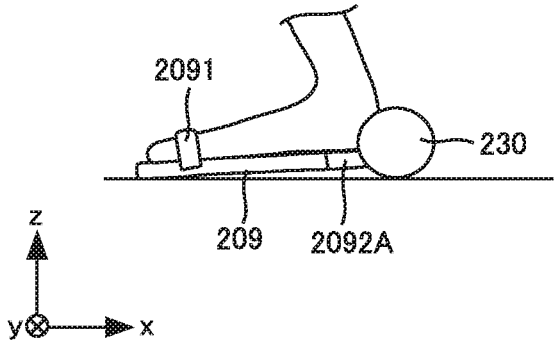
(b)

FIG. 21
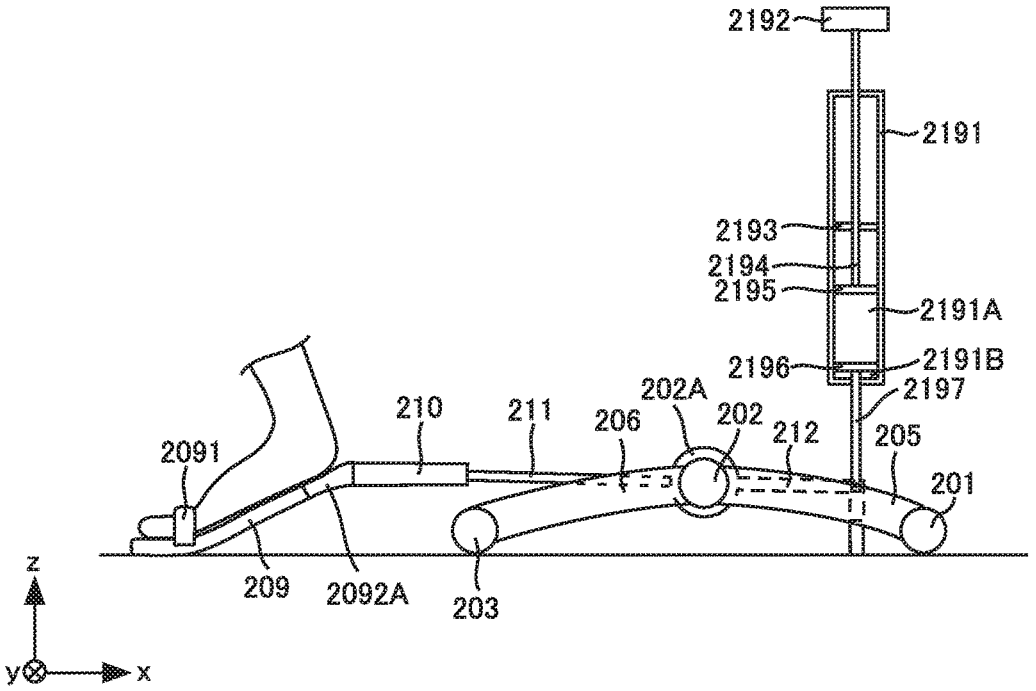
(a)
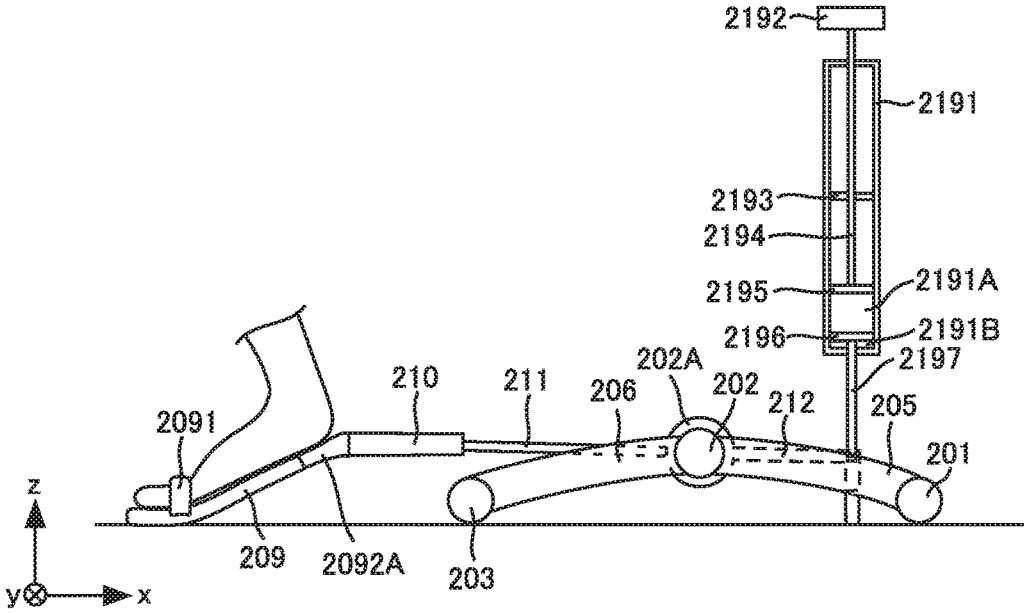
(b)

FIG. 27

CHR1

PLEASE TAKE A SITTING POSTURE ON THE SEAT WITH BOTH FEET IN CONTACT WITH THE FLOOR SURFACE

CHR2

PLEASE TAKE A STANDING POSTURE WITH YOUR FEET SET APART AT A DISTANCE SUBSTANTIALLY EQUAL TO YOUR SHOULDER WIDTH

CHR3

PLEASE TAKE A SITTING POSTURE ON THE SEAT AND CROSS THE ARMS IN FRONT OF THE CHEST

CHR4

PLEASE TAKE A STANDING POSTURE AND USE THE SUPPORT MEMBER TO SUPPORT THE BODY IN A FORWARD TILTED POSTURE WITH THE UPPER LIMBS

CHR5

PLEASE PUT ONE FOOT OF THE RIGHT FOOT AND THE LEFT FOOT FORWARD, MAKE THE LESSOR TOES AND THE HEEL OF ONE FOOT CONTACT THE FLOOR SURFACE, PUT THE OTHER FOOT BEHIND, HAVE THE INTERPHALANGEAL JOINT OF THE BIG TOE AND THE METATARSOPHALANGEAL JOINTS OF THE SECOND TOE, THE THIRD TOE, THE FOURTH TOE, AND THE FIFTH TOE OF THE OTHER FOOT PRESSED BY THE PRESSER PART OF THE TRAINING GUIDANCE INSTRUMENT, AND PLACE THE HEEL OF THE OTHER FOOT ON THE HEEL PLACING PART

CHR6

PLEASE APPLY FORCE ON THE HEEL PLACING PART BY THE HEEL OF THE FOOT PUT BEHIND UNTIL THE HEEL PLACING PART REACHES THE FLOOR SURFACE WHILE ALL THE TOES OF THE FOOT PUT BEHIND ARE IN CONTACT WITH THE BASE PART OF THE FOOTREST MEMBER

CHR7

PLEASE STOP APPLYING FORCE ON THE HEEL PLACING PART WHEN THE HEEL PLACING PART REACHES THE FLOOR SURFACE

CHR8

PLEASE PUT THE OTHER FOOT FORWARD, MAKE THE LESSOR TOES AND THE HEEL OF THE OTHER FOOT CONTACT THE FLOOR SURFACE, PUT ONE FOOT BEHIND, HAVE THE INTERPHALANGEAL JOINT OF THE BIG TOE AND THE METATARSOPHALANGEAL JOINTS OF THE SECOND TOE, THE THIRD TOE, THE FOURTH TOE, AND THE FIFTH TOE OF THE ONE FOOT PRESSED BY THE PRESSER PART OF THE TRAINING GUIDING INSTRUMENT, AND PLACE THE HEEL OF ONE FOOT ON THE HEEL PLACING PART

CHR9

PLEASE APPLY FORCE ON THE HEEL PLACING PART BY THE HEEL OF THE FOOT PUT BEHIND UNTIL THE HEEL PLACING PART REACHES THE FLOOR SURFACE WHILE ALL THE TOES OF THE FOOT PUT BEHIND ARE IN CONTACT WITH THE BASE PART OF THE FOOTREST MEMBER

CHR10

PLEASE STOP APPLYING FORCE ON THE HEEL PLACING PART WHEN THE HEEL PLACING PART REACHES THE FLOOR SURFACE

FIG. 31

CHR1

PLEASE TAKE A SITTING POSTURE ON THE SEAT WITH BOTH FEET IN CONTACT WITH THE FLOOR SURFACE

CHR2

PLEASE TAKE A STANDING POSTURE WITH YOUR FEET SET APART AT A DISTANCE SUBSTANTIALLY EQUAL TO YOUR SHOULDER WIDTH

CHR3

PLEASE TAKE A SITTING POSTURE ON THE SEAT AND CROSS THE ARMS IN FRONT OF THE CHEST

CHR11

PLEASE BEND THE KNEES TO TAKE A SITTING POSTURE, HAVE THE INTERPHALANGEAL JOINT OF THE BIG TOE AND THE METATARSOPHALANGEAL JOINTS OF THE SECOND TOE, THE THIRD TOE, THE FOURTH TOE, AND THE FIFTH TOE OF THE LEFT FOOT PRESSED BY THE PRESSER PART 2091 OF THE FOOTREST MEMBER 209, PLACE THE HEEL OF THE LEFT FOOT ON THE HEEL PLACING PART 2092A OF THE FOOTREST MEMBER 209, HAVE THE INTERPHALANGEAL JOINT OF THE BIG TOE AND THE METATARSOPHALANGEAL JOINTS OF THE SECOND TOE, THE THIRD TOE, THE FOURTH TOE, AND THE FIFTH TOE OF THE RIGHT FOOT PRESSED BY THE PRESSER PART 2091 OF THE FOOTREST MEMBER 213, AND PLACE THE HEEL OF THE RIGHT FOOT ON THE HEEL PLACING PART 2092A OF THE FOOTREST MEMBER 213

CHR12

PLEASE APPLY FORCE ON THE HEEL PLACING PART BY THE HEEL OF ONE FOOT OF THE RIGHT FOOT AND THE LEFT FOOT UNTIL THE HEEL PLACING PART REACHES THE FLOOR SURFACE WHILE ALL THE TOES OF THE ONE FOOT ARE IN CONTACT WITH THE BASE PART OF THE FOOTREST MEMBER

CHR13

PLEASE STOP APPLYING THE FORCE ON THE HEEL PLACING PART WHEN THE HEEL PLACING PART REACHES THE FLOOR SURFACE

CHR14

PLEASE APPLY THE FORCE ON THE HEEL PLACING PART BY THE HEEL OF THE OTHER FOOT UNTIL THE HEEL PLACING PART REACHES THE FLOOR SURFACE WHILE ALL THE TOES OF THE OTHER FOOT ARE IN CONTACT WITH THE BASE PART OF THE FOOTREST MEMBER

CHR15

PLEASE STOP APPLYING FORCE ON THE HEEL PLACING PART WHEN THE HEEL PLACING PART REACHES THE FLOOR SURFACE

FIG. 33
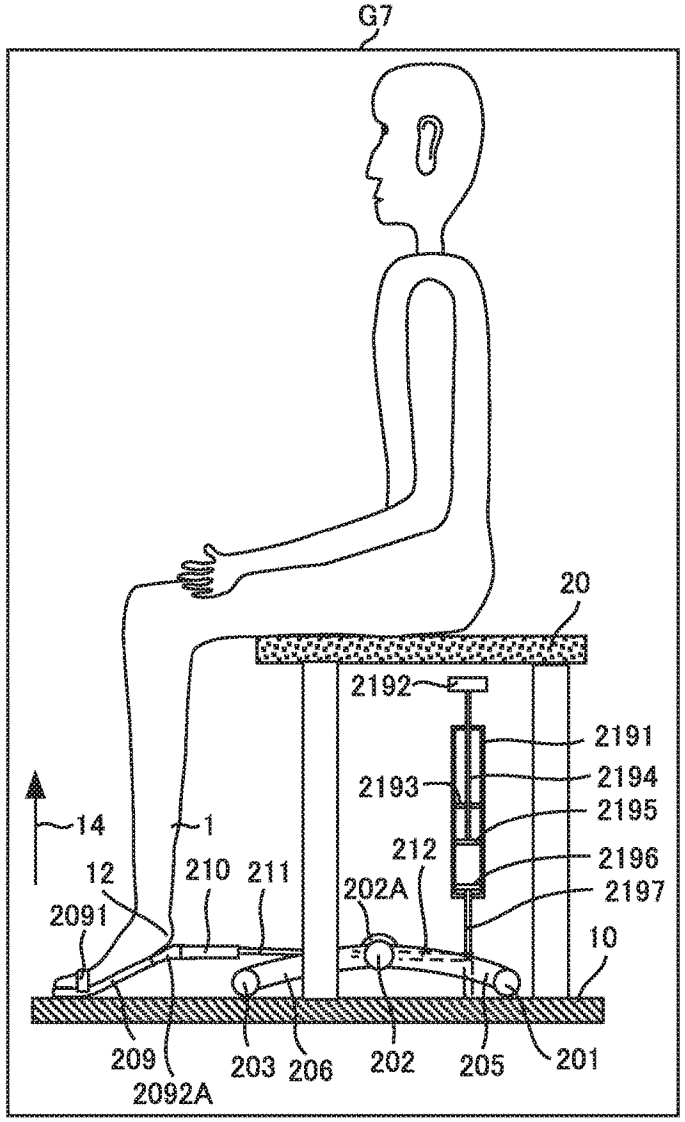
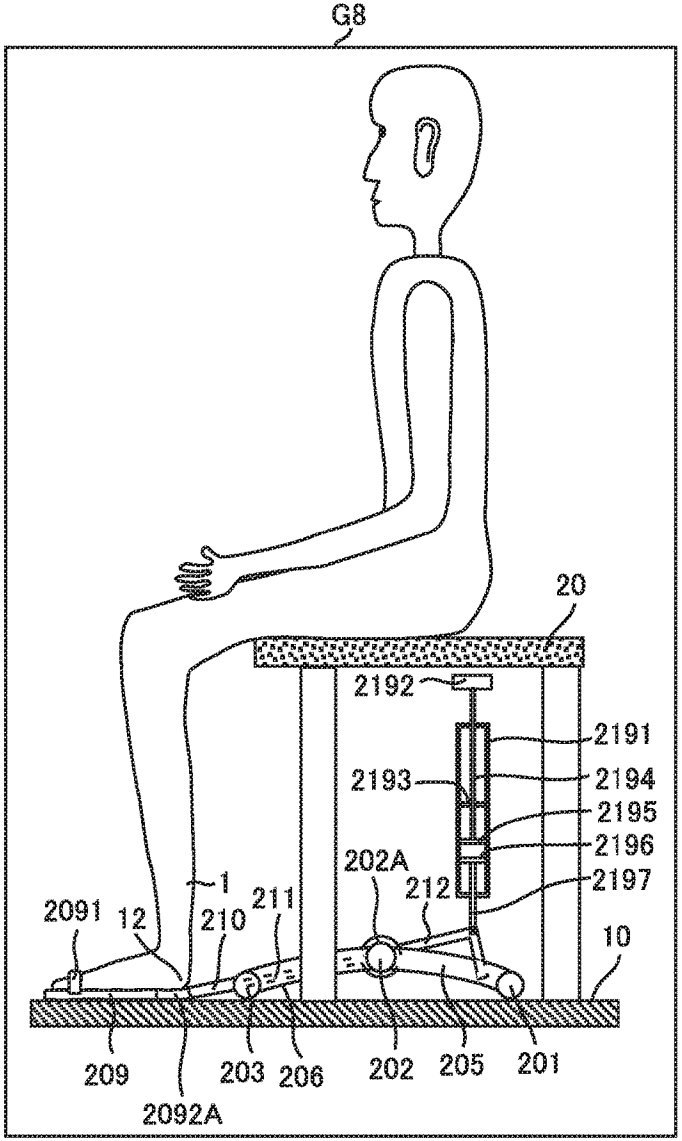

TRAINING GUIDANCE INSTRUMENT AND TRAINING GUIDANCE METHOD USING THE SAME

TECHNICAL FIELD

The present invention relates to a training guidance instrument and a training guidance method using the same.

BACKGROUND ART

Body trunk training equipment disclosed in PTL 1 has been known. The body trunk training equipment includes an equipment base part, a support column, a circle frame, a support member, and a sliding part.

The support column is provided upright on the equipment base part. The circle frame in a substantially semicircular arc shape is attached to the support column by the support member. The circle frame can be raised/lowered in the vertical direction along the support column.

The sliding part is attached to the circle frame in a slidable manner in the circumferential direction of the circle frame. The sliding part is provided with a grip part which extends in the inward direction of the circle frame. The sliding part is provided with a weight plate through a pivot part. The weight plate is rotatable around the pivot part.

The user of the body trunk training equipment stands on the equipment base part on the inner side of the circle frame and has the sliding part slide in the circumferential direction of the circular frame while gripping the grip part. Then, the momentum along the circle frame caused by the sliding operation of the sliding part is transmitted as rotation force to the pivot part, so that inertial force is generated at the weight plate which is supported by the pivot part. In this way, the inertial force allows the user to get motion for obtaining a load unpredictable for the user, so that various kinds of muscle training are enabled by the load applied on the user, and the user can efficiently train muscles such as around the body trunk in a desired state.

According to the disclosure of PTL 1, using the body trunk training equipment, training associated with batting, tennis racket swinging, and golf swinging can be carried out.

A training guidance method disclosed in PTL 2 has been known. According to the training guidance method, the user is guided to exercise while a plane-stimulating member is provided in a position corresponding to a functional skin area of at least one muscle selected from a group of muscles divided by the level of muscle tone in relation to exercise with an antigravity effect, so that the muscle tone of the muscle provided with the plane stimulating member is relaxed, and the muscle consciousness of a desired muscle is lowered.

A foot health orthosis disclosed in PTL 3 has been known. The foot health orthosis includes an elastic ring-shaped holder which can be mounted on each toe from the outside and a cushion part which is disposed in a part of the holder, is held on the back surface side of the toe in an externally mounted state and has a greater thickness than the holder. According to the disclosure of PTL 3, when the foot health orthosis is put on to a big toe or each of other toes so that the cushion part is in contact with the back surface of the toe, the toe is pushed up from the side of the ground through the cushion part during walking, then flexing force in a substantially obliquely upward acts upon the feet, which amplifies the kicking force by the toe tip, the toe muscles, the foot muscle group, and the leg muscle strength are trained effortlessly or stimulated, and the foot arch formation is accelerated or the arch formation can be prevented from being deteriorated, which may lead to improvement to splayfoot or a spread foot.

CITATION LIST

Patent Literature

[PTL 1] JP 2013-031642 A
[PTL 2] JP 2003-293206 A
[PTL 3] JP 2015-178041 A

SUMMARY OF INVENTION

Technical Problem

However, the muscles which can be trained by the body trunk training equipment disclosed in PTL 1 are only particular muscles of a human body used for example for batting, tennis racket swinging, and golf swinging. The muscles which can be trained by the training guidance method disclosed in PTL 2 are also only specific muscles of the muscles of a human body. Using the fool health orthosis disclosed in PTL 3, improvements are only limited to splayfoot or a spread foot. Therefore, according to these conventional methods, physical abilities inherent in a human body cannot be improved.

Solution to Problem

Therefore, according to an embodiment of the present invention, a training guidance instrument capable of improving the physical ability of a person is provided.

According to the embodiment of the present invention, a training guidance method using the training guidance instrument capable of improving the physical ability of a person is provided.

A training guidance instrument according to the embodiment of the present invention includes a presser part, a heel placing part, and a control unit. The presser part presses the second joint of a big toe and the third joints of a second toe, a third toe, a fourth toe, and a fifth toe of a trainee. The heel placing part is for placing a heel of the trainee thereon. The control unit is configured to move the heel placing part toward the ground in response to application of second force toward the ground by the trainee on the heel placing part which is stronger than first force applied upward from the ground on the heel placing part when the heel placing part is positioned above and away from the ground, and the control unit is configured to move the heel placing part upward from the ground in response to application of weaker force toward the ground than the second force by the trainee on the heel placing part when the heel placing part is positioned below its upward highest position from the ground, while the second joint and the third joints of the trainee are pressed by the presser part.

In the training guidance instrument, the control unit is configured to move the heel placing part toward the ground in response to application of the second force on the heel placing part when the heel placing part is positioned above and away from the ground, and the control unit is configured to move the heel placing part upward from the ground in response to application of weaker force toward the ground than the second force on the heel placing part, while the second joint and the third joints of the trainee are pressed by the presser part. As a result, the trainee moves up and down the heel of the trainee in the vertical direction in response to the movement of the heel placing part, while the second joint and the third joints of the trainee are pressed by the presser part.

The trainee carries out the exercise, so that a balance between the left and right sides and a balance between the front and back sides of the trainee improve, and force exerted by the trainee to press the heel placing part by the heel increases.

Therefore, the physical ability of the trainee can be improved.

The training guidance instrument preferably includes a rotary member. The rotary member is provided rotatably around an axis of a support member provided on the ground and having one end attached to the support member and the other end connected to the heel placing part. The control unit is configured to rotate the rotary member around the axis of the support member so that the other end of the rotary member moves toward the ground in response to application of the second force by the trainee on the heel placing part when the heel placing part is positioned above and away from the ground, and the control unit is configured to rotate the rotary member around the axis of the support member so that the other end of the rotary member moves upward in response to the weaker force toward the ground than the second force applied by the trainee on the heel placing part when the heel placing part is positioned below the highest position.

The heel placing part moves in the vertical direction as the rotary member rotate. As a result, the trainee can easily move up and down the heel while placing the heel on the heel placing part by applying the second force on the heel placing part or weakening the force applied to the heel placing part to be less than the second force.

Therefore, the physical ability of the trainee can be improved by the simple exercise.

The training guidance instrument preferably includes a toe inserting part. The toe inserting part is for separately inserting therein the big toe, the second toe, the third toe, the fourth toe, and the fifth toe of the trainee.

The heel of the trainee is moved up and down in the vertical direction while the second joint and the third joints of the toes of the trainee are pressed by the presser part and all the toes are inserted in the toe inserting part.

Therefore, the physical ability of the trainee can further be improved.

The control unit preferably has a force adjusting unit. The force adjusting unit is configured to adjust force to be applied on the heel placing part by the trainee in order to move the heel placing part toward the ground between first strength and second strength greater than the first strength.

Since the strength of force to be applied by the trainee on the heel placing part in order to move the heel placing part toward the ground can be adjusted by the force adjusting unit, the strength of force applied on the heel placing part by the heel of the trainee in order to have the heel placing part reach the ground can be measured. After and before the exercise of moving up and down the heel of the trainee, the strength of force is measured, so that it can easily be determined whether the physical ability of the trainee has improved.

According to the embodiment of the present invention, a training guidance method for instructing a trainee uses the training guidance instrument of any one of claims 1 to 4 and includes instructing a trainee to carry out, at least once for both feet, the operation of applying the second force on the heel placing part so that the heel placing part in a position above and away from the ground approaches the ground and the operation of weakening the force toward the ground applied on the heel placing part to be less than the second force as the heel placing part approaches the ground, while the second joint and the third joints of the toes of the trainee are pressed by the presser part and the heel of the trainee is in contact with the heel placing part.

In the training guidance method according to the embodiment of the present invention, using the training guidance instrument, the trainee is instructed to carry out, for both feet, the operation of moving the heel up and down in the vertical direction while the second joint and the third joints of the toes of the trainee are pressed by the presser part.

In this way, the trainee can learn to walk with all toes of both feet in contact with the ground, and for example a balance between the left and right sides and a balance between the front and back sides improve, the ability of the fingers improve, or the force exerted to press the heel placing part toward the ground becomes stronger.

Therefore, the physical ability of the trainee can be improved. The physical ability can be improved.

BRIEF DESCRIPTION OF DRAWINGS

FIG. 3 shows relation among the position of a gate valve 2195, pressure $P_A$ in a space 2191A, the position of a gate valve 2196, and pressure $P_B$ in a space 2191B shown in FIG. 2.

FIG. 7 is a view for illustrating the operation of the training guidance instrument shown in FIG. 1.

FIG. 15 is a view for illustrating the operation of the training guidance instrument shown in FIG. 13.

FIG. 16 is a schematic view of yet another training guidance instrument according to the embodiment of the present invention.

FIG. 17 is a view for illustrating the operation of the training guidance instrument shown in FIG. 16.

FIG. 21 is a view for illustrating a method for measuring force exerted by a trainee to have the heel placing part reach a floor surface.

FIG. 27 is a view showing the concept of character information.

FIG. 31 is a view showing the concept of another kind of character information.

FIG. 33 is a view showing the concept of another kind of image information.

DESCRIPTION OF EMBODIMENTS

Figure 1:
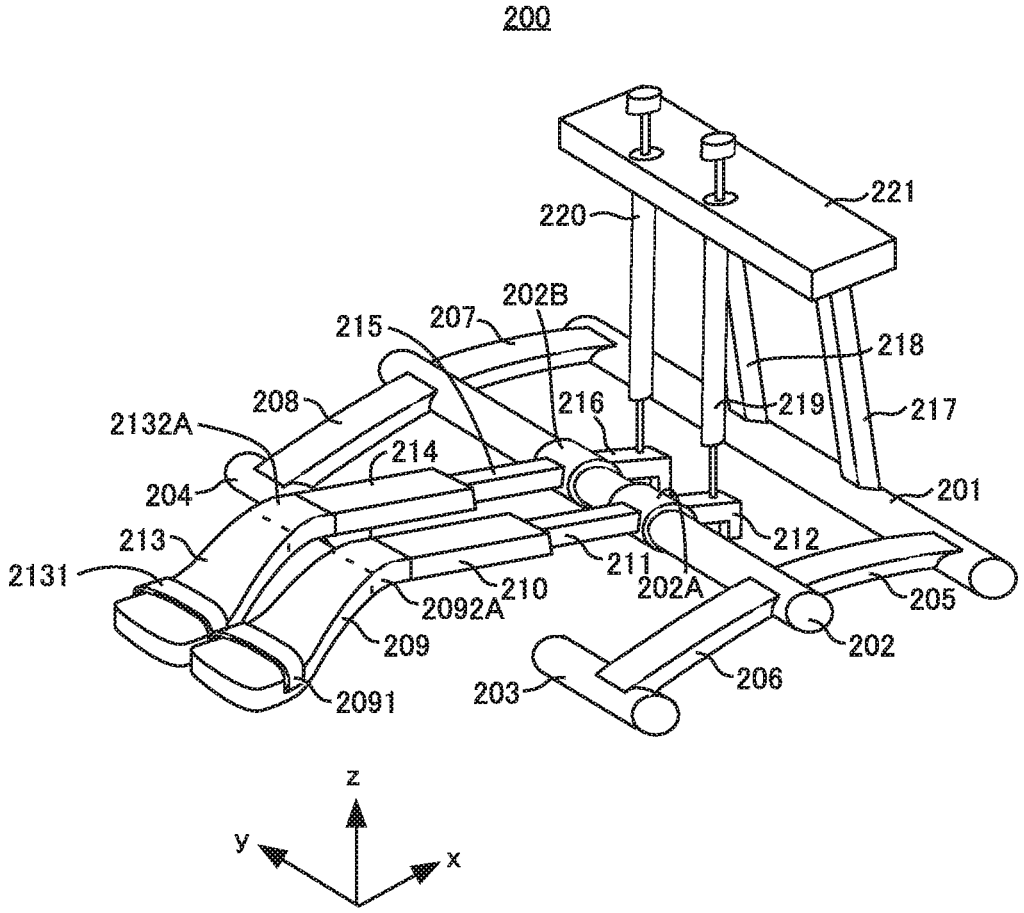
FIG. 1 is a schematic view of a training guidance instrument according to an embodiment of the present invention.

An embodiment of the present invention will be described in detail with reference to the drawings. Note that the same or corresponding portions in the drawings are designated by the same reference characters and their description will not be repeated.

FIG. 1 is a schematic view of a training guidance instrument according to an embodiment of the present invention. Referring to FIG. 1, the training guidance instrument 200 according to the embodiment of the present invention includes base members 201, 203, and 204, support members 202, 205, 206, 207, 208, 211, 212, 215, and 216, footrest members 209 and 213, rotary members 210 and 214, leg parts 217 and 218, telescopic members 219 and 220, and a plate member 221. The support member 202 has rotary parts 202A and 202B which rotate in the circumferential direction around the axis of the support member 202.

Coordinates x, y, and z are defined in FIG. 1. The base member 201 is provided on the ground (or the floor, hereinafter as the ground) in the y-axis direction. The base member 203 is provided on the ground along the y-axis direction at a prescribed distance from the base member 201 in the x-axis direction. The base member 204 is provided on the ground along the y-axis direction at a prescribed distance from the base member 203 along a line extended from the base member 203.

The support member 202 is provided at a prescribed height from the ground between the base member 201 and the base members 203 and 204 in the x-axis direction.

The support member 205 is in a substantially arc-shape in an x-z plane and has one end connected to one end side of the support member 201 and the other end connected to one end side of the support member 202. The support member 206 is in a substantially arc shape in an x-z plane and has one end connected to one end side of the support member 202 and the other end connected to the base member 203. As a result, when connected, the support members 205 and 206 have a substantially arc shape as a whole through the support member 202 in an x-z plane.

The support member 207 is in a substantially arc shape in an x-z plane and has one end connected to the other end side of the support member 201 and the other end connected to the other end side of the support member 202. The support member 208 is in a substantially arc shape in an x-z plane and has one end connected to the other end side of the support member 202 and the other end connected to the base member 204. As a result, when connected, the support members 207 and 208 have a substantially arc shape as a whole through the support member 202 in an x-z plane.

The footrest member 209 has a presser part 2091 on one end side and a heel placing part 2092A on the other end. The heel placing part 2092A of the footrest member 209 is connected to one end of the rotary member 210.

The rotary member 210 has one end connected to the heel placing part 2092A of the footrest member 209 and the other end connected to one end of the support member 211.

The support member 211 has one end connected to the other end of the rotary member 210 and the other end connected to the rotary part 202A of the support member 202.

The support member 212 has a substantially L shape in an x-z plane. The support member 212 has one end connected to the rotary part 202A of the support member 202 and an end of the straight line part in the x-axis direction connected to one end of the telescopic member 219. In the case, the straight line parts of the support members 211 and 212 are connected to the rotary part 202A of the support member 202 so as to form a substantially straight line in an x-z plane.

The footrest member 213 has a presser part 2131 on one end side and a heel placing part 2132A on the other end. The heel placing part 2132A of the footrest member 213 is connected to one end of the rotary member 214.

The rotary member 214 has one end connected to the heel placing part 2132A of the footrest member 213 and the other end connected to one end of the support member 215.

The support member 215 has one end connected to the other end of the rotary member 214 and the other end connected to the rotary part 202B of the support member 202.

The support member 216 has a substantially L shape in an x-z plane. The support member 216 has one end connected to the rotary part 202B of the support member 202 and an end of the straight line part in the x-axis direction connected to one end of the telescopic member 220. In this case, the straight line parts of the support members 215 and 216 are connected to the rotary part 202B of the support member 202 so as to form a substantially straight line in an x-z plane.

The leg part 217 has one end connected to the base member 201 and the other end connected to the plate member 221.

The leg part 218 is provided at a prescribed distance from the leg part 217 in the y-axis direction and has one end connected to the base member 201 and the other end connected to the plate member 221.

The telescopic member 219 has one end connected to an end of the straight line part of the support member 212 and the other end side provided through the plate member 221 and connected to the plate member 221.

The telescopic member 220 has one end connected to an end of the straight line part of the support member 216 and the other end side provided through the plate member 221 and connected to the plate member 221.

The plate member 221 is connected to the other ends of the leg parts 217 and 218 and the other end side of the telescopic members 219 and 220.

Figure 2:
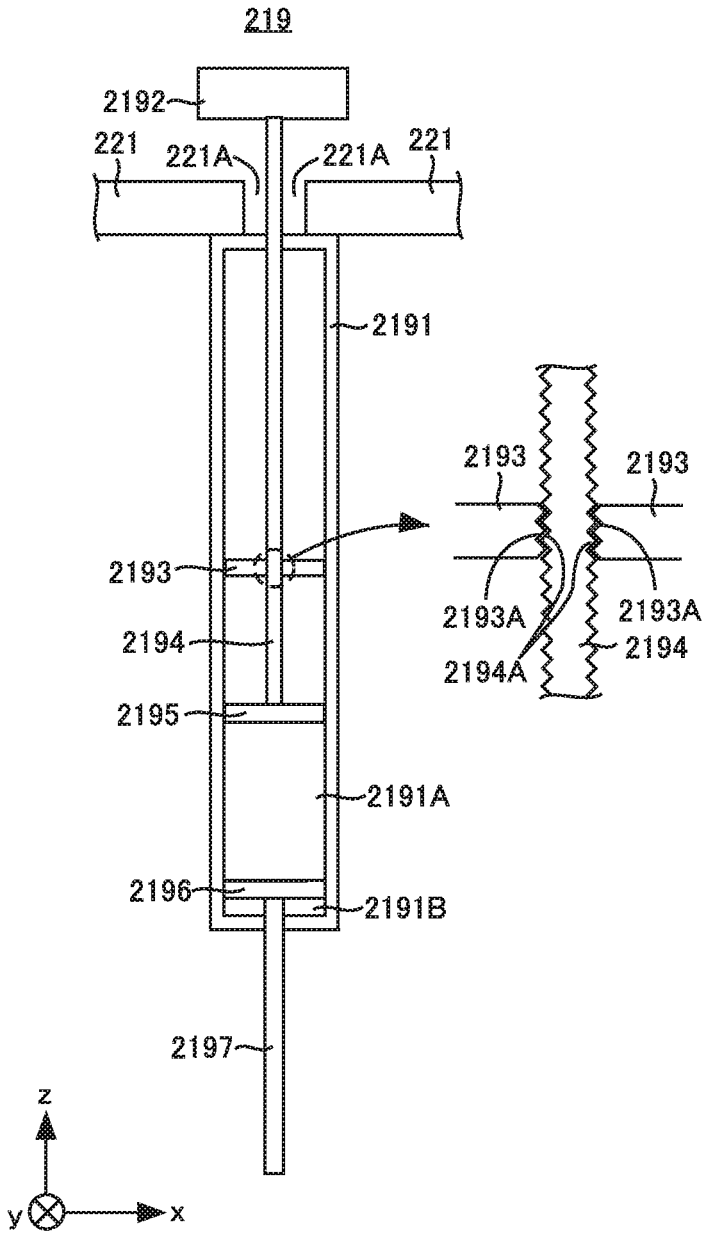
FIG. 2 is a sectional view of a telescopic member shown in FIG. 1 in an x-z plane.

FIG. 2 is a sectional view of the telescopic member 219 shown in FIG. 1 taken along an x-z plane. Referring to FIG. 2, the telescopic member 219 includes a main body 2191, a pressure adjusting unit 2192, a support member 2193, a shaft member 2194, gate valves 2195 and 2196, and a support member 2197.

The main body 2191 has a tubular shape which is hollow inside. The main body 2191 has one end fixed to the plate member 221. The pressure adjusting unit 2192 is connected to one end of the shaft member 2194 in a rotatable manner around the axis of the main body 2191.

The support member 2193 is substantially disk shaped and fixed to the inner wall of the main body 2191.

The shaft member 2194 in a rod shape is fitted to the support member 2193 to penetrate through the support member 2193 and penetrate the main body 2191 to be arranged through the through hole 221A of the plate member 221. The shaft member 2194 has one end connected to the pressure adjusting unit 2192 and the other end connected to the gate valve 2195. The axis of the shaft member 2194 coincides with the axis of the main body 2191.

The gate valve 2195 is provided in close contact with the inner wall of the main body 2191 and inside the main body 2191. The area between the gate valve 2195 and the inner wall of the main body 2191 is sealed so that air is not let in/out from the space 2191A. The gate valve 2195 moves in the z-axis direction as the shaft member 2194 rotates in the clockwise or anti-clockwise direction in an x-y plane.

The gate valve 2196 is provided in close contact with the inner wall of the main body 2191 and inside the main body 2191. The area between the gate valve 2196 and the inner wall of the main body 2191 is also sealed so that air is not let in/out from the space 2191A. The gate valve 2196 moves up and down in the z-axis direction as the support member 2197 moves up and down in the z-axis direction on the sheet surface of FIG. 2.

The support member 2197 has one end connected to the gate valve 2196 and the other end connected an end of the straight line part of the support member 212.

The support member 2193 has a threaded part 2193A at the inner circumferential part thereof, and the shaft member 2194 has a threaded part 2194A at the outer circumferential surface thereof. The threaded part 2193A of the support member 2193 engages with the threaded part 2194A of the shaft member 2194.

As the pressure adjusting unit 2192 turns anti-clockwise in an x-y plane, the shaft member 2194 also turns anti-clockwise in an x-y plane. Then, the gate valve 2195 moves upwardly in the z-axis direction on the sheet surface of FIG. 2.

As the pressure adjusting unit 2192 turns clockwise in an x-y plane, the shaft member 2194 also turns clockwise in an x-y plane. Then, the gate valve 2195 moves for example downward in the z-axis direction on the sheet surface of FIG. 2.

When the gate valve 2195 moves upward, the volume in the space 2191A increases, and the pressure $P_A$ in the space 2191A is lowered at a constant temperature. When the gate valve 2195 moves downward, the volume in the space 2191A decreases, and the pressure $P_A$ in the space 2191A increases at a constant temperature.

When the gate valve 2196 moves upward, the volume in the space 2191A decreases, and the pressure $P_A$ in the space 2191A increases at a constant temperature. When the gate valve 2196 moves downward, the volume in the space 2191A increases, and the pressure $P_A$ in the space 2191A decreases at a constant temperature.

The telescopic member 220 has the same structure as that of the telescopic member 219 shown in FIG. 2.

In an initial state, the other ends of the support members 212 and 216 (the ends opposite to the ends connected to the rotary parts 202A and 202B) are in contact with the ground. Therefore, in the initial state, the gate valve 2196 and the main body 2191 define a space 2191B therebetween.

In the initial state, the pressure $P_A$ in the space 2191A is set to a pressure $P_{0A}$, and the pressure $P_B$ in the space 2191B is set to a pressure $P_{0B}$. The pressures $P_{0A}$ and $P_{0B}$ are, for example, higher than the atmospheric pressure, and pressure $P_{OA}$ is higher than the pressure $P_{0B}$.

When the position of the gate valve 2196 in the z-axis direction is constant and the gate valve 2195 moves upward to the upper limit position, the pressure $P_A$ in the space 2191A attains a minimum value $P_{AMIN}$, while when the gate valve 2195 moves downward to the lower limit position, the pressure $P_A$ in the space 2191A attains a maximum value $P_{AMAX}$. The minimum value $P_{AMIN}$ and the maximum value $P_{AMAX}$ are higher than the atmospheric pressure, and the minimum value $P_{AMIN}$ is higher than the pressure $P_{0B}$ in the space 2191B. Therefore, the pressure $P_A$ in the space 2191A can be set to an arbitrary pressure between the minimum value $P_{AMIN}$ and the maximum value $P_{AMAX}$ by the pressure adjusting unit 2192.

When the other ends of the support members 212 and 216 are in contact with the ground, the position of the gate valve 2196 in the z-axis direction does not change, and the pressure $P_B$ in the space 2191B is kept at a constant value ($P_{0B}$) even if the pressure $P_A$ in the space 2191A changes.

When the position of the gate valve 2195 in the z-axis direction is constant and the support member 2197 moves upward (in the z-axis direction) from the initial position, the pressure $P_A$ in the space 2191A increases as the volume in the space 2191A decreases, and the pressure $P_B$ in the space 2191B is lower than the pressure $P_{0B}$ as the volume in the space 2191B increases.

FIG. 3 shows the relation among the position of the gate valve 2195, the pressure $P_A$ in the space 2191A, the position of the gate valve 2196, and the pressure $P_B$ in the space 2191B shown in FIG. 2.

When the position $Z_A$ of the gate valve 2195 in the z-axis direction is in the position $Z_{A_1}$ (which is the upper limit position $Z_{A_U}$) and the position of the gate valve 2196 in the z-axis direction is the initial position (when the other ends of the support members 212 and 216 are in contact with the ground, which hereinafter applies to below), the pressure $P_A$ in the space 2191A is the pressure $P_{0A\text{-}1}$ (which is the minimum value $P_{AMIN}$), and the pressure $P_B$ in the space 2191B is the pressure $P_{0B}$ which is lower than the pressure $P_{0A_1}$ ($\leq P_{0A\text{-}1}$) (which is the minimum value $P_{AMIN}$).

Then, when the position $Z_A$ in the z-axis direction of the gate valve 2195 is kept in the position $Z_{A_1}$ (which is the upper limit position $Z_{A_U}$) and the position of the gate valve 2196 in the z-axis direction moves upward above the initial position, the pressure $P_A$ in the space 2191A rises from the pressure $P_{0A\text{-}1}$ (=$P_{AMIN}$) to the pressure $P_{A_1}$ (>$P_{AMIN}$) and the pressure $P_B$ in the space 2191B decreases from the pressure $P_{0B}$ to the pressure $P_{B\text{-}1}$ (<$P_{A_1}$, $P_{0B}$).

When the position $Z_A$ of the gate valve 2195 in the z-axis direction is in a position $Z_{A_2}$ lower than the position $Z_{A_1}$ (=$Z_{A_U}$), and the position of the gate valve 2196 in the z-axis direction is in the initial position, the pressure $P_A$ in the space 2191A is a pressure $P_{0A_2}$ higher than the pressure $P_{0A_1}$ (=$P_{AMIN}$), and the pressure $P_B$ in the space 2191B is the pressure $P_{0B}$.

Then, when the position $Z_A$ of the gate valve 2195 in the z-axis direction is kept in the position $Z_{A_2}$ (<position $Z_{A_1}$) and the position of the gate valve 2196 in the z-axis direction moves upward to a position higher than the initial position, the pressure $P_A$ in the space 2191A increases from the pressure $P_{0A_2}$ to the pressure $P_{A_2}$ (>$P_{0A_2}$,) and the pressure $P_B$ in the space 2191B decreases from the pressure $P_{0B}$ to the pressure $P_{B_2}$ (<$P_{A_2}$, $P_{0B}$).

Furthermore, when the position $Z_A$ of the gate valve 2195 in the z-axis direction is in a position $Z_{A_3}$ which is lower than the position $Z_{A_2}$ and the position of the gate valve 2196 in the z-axis direction is the initial position, the pressure $P_A$ in the space 2191A is $PO_{0A_3}$ which is higher than the pressure $P_{0A_2}$, and the pressure $P_B$ in the space 2191B is the pressure $P_{0B}$.

When the position $Z_A$ of the gate valve 2195 in the z-axis direction is kept in the position $Z_{A_3}$ (<position $Z_{A_2}$) and the position of the gate valve 2196 in the z-axis direction moves upward above the initial position, the pressure $P_A$ in the space 2191A increases from the pressure $P_{0A_3}$ to the pressure $P_{A_3}$ (>$P_{0A_3}$) and the pressure $P_B$ in the space 2191B decreases from the pressure $P_{0B}$ to the pressure $P_{B_3}$ (<$P_{A_3}$, $P_{0B}$).

Hereinafter, similarly, the position $Z_A$ of the gate valve 2195 in the z-axis direction is in a position $Z_{A_n-1}$ which is lower than the position $Z_{A_n-2}$ (n is an integer equal to or greater than 3), and the position of the gate valve 2196 in the z-axis direction is the initial position, the pressure $P_A$ in the space 2191A is a pressure $P_{0A_n-1}$ which is higher than a pressure $P_{0A_n-2}$, and the pressure $P_B$ in the space 2191B is the pressure $P_{0B}$.

When the position $Z_A$ of the gate valve 2195 in the z-axis direction is kept in the position $Z_{A_n-1}$ (<position $Z_{A_n-2}$), and the position of the gate valve 2196 in the z-axis direction moves upward above the initial position, the pressure $P_A$ in the space 2191A increases from the pressure $P_{0A_n-1}$ to a pressure $P_{A_n-1}$ (>$P_{0A_n-1}$) and the pressure $P_B$ in the space 2191B decreases from the pressure $P_{0B}$ to a pressure $P_{B_n-1}$ (<$P_{A_n-1}$, $P_{0B}$).

When the position $Z_A$ of the gate valve 2195 in the z-axis direction is in the position $Z_{A_n}$ (=the lower limit position $Z_{A_L}$) and the position of the gate valve 2196 in the z-axis direction is the initial position, the pressure $P_A$ in the space 2191A is a pressure $P_{0A_n}$ (=maximum value $P_{AMAX}$) which is higher than the pressure $P_{0A_n-1}$, and the pressure $P_B$ in the space 2191B is the pressure $P_{0B}$.

When the position $Z_A$ in the z-axis direction of the gate valve 2195 is kept in the position $Z_{A_n}$ (=the lower limit position $Z_{A_L}$), and the position of the gate valve 2196 in the z-axis direction moves upward to a position above the initial position, the pressure $P_A$ in the space 2191A increases from the pressure $P_{0A_n}$ to the pressure $P_{A_n}$ (>$P_{0A_n}$) and the pressure $P_B$ in the space 2191B decreases from the pressure $P_{0B}$ to the pressure $P_{B_n}$ (<$P_{A_n}$, $P_{0B}$).

In this way, when the position of the gate valve 2195 changes from the upper limit position $Z_{A_U}$ to the lower limit position $Z_{A_L}$ while the position of the gate valve 2196 is kept in the initial position, the pressure $P_A$ in the space 2191A rises from the pressure $P_{0A_1}$ (=$P_{AMIN}$) to $P_{0A_n}$ (=$P_{AMAX}$) and the pressure $P_B$ in the space 2191B is kept at the constant pressure $P_{0B}$. In addition, when the position $Z_A$ of the gate valve 2195 is kept in the positions $Z_{A_1}$, $Z_{A_2}$, $Z_{A_3}$, . . . , $Z_{A_n-1}$, and $Z_{A_n}$, and the position of the gate valve 2196 is shifted upward to higher positions from the initial position, the pressure $P_A$ in the space 2191A is increased from the pressures $P_{0A_1}$, $P_{0A_2}$, $P_{0A_3}$, . . . , $P_{0A_n-1}$, and $P_{0A_n}$ to the pressures $P_{A_1}$, $P_{A_2}$, $P_{A_3}$, . . . , $P_{A_n-1}$, and $P_{A_n}$, respectively and the pressure $P_B$ in the space 2191B decreases from the pressure $P_{0B}$ to the pressures $P_{B_1}$, $P_{B_2}$, $P_{B_3}$, . . . , $P_{B_n-1}$, and $P_{B_n}$, respectively.

The pressures $P_{B\text{-}1}$, $P_{B\text{-}2}$, $P_{B\text{-}3}$, . . . , $P_{B\text{-}n-1}$, and $P_{B\text{-}n}$ are lower than the pressures $P_{A_1}$, $P_{A_2}$, $P_{A_3}$, . . . , $P_{A_n-1}$, and $P_{A_n}$, respectively.

Therefore, when the position of the gate valve 2195 is in the positions $Z_{A_1}$, $Z_{A_2}$, $Z_{A_3}$, . . . , $Z_{A_n-1}$, and $Z_{A_n}$, respectively, and the position above the initial position of the gate valve 2191 is the same, the respective pressure differences $P_{A_1}$-$P_{B_1}$, $P_{A_2}$-$P_{B_2}$, $P_{A_3}$-$P_{B_3}$, . . . $P_{A_n-1}$-$P_{B_n-1}$, and $P_{A_n}$-$P_{B_n}$ between the pressures $P_{A_1}$, $P_{A_2}$, $P_{A_3}$, . . . , $P_{A_n-1}$, and $P_{A_n}$, and the pressures $P_{B\text{-}1}$, $P_{B\text{-}2}$, $P_{B\text{-}3}$, . . . , $P_{B\text{-}n-1}$, and $P_{B\text{-}n}$ increase as the position of the gate valve 2195 is approaches the lower limit position from the upper limit position.

Figure 4:
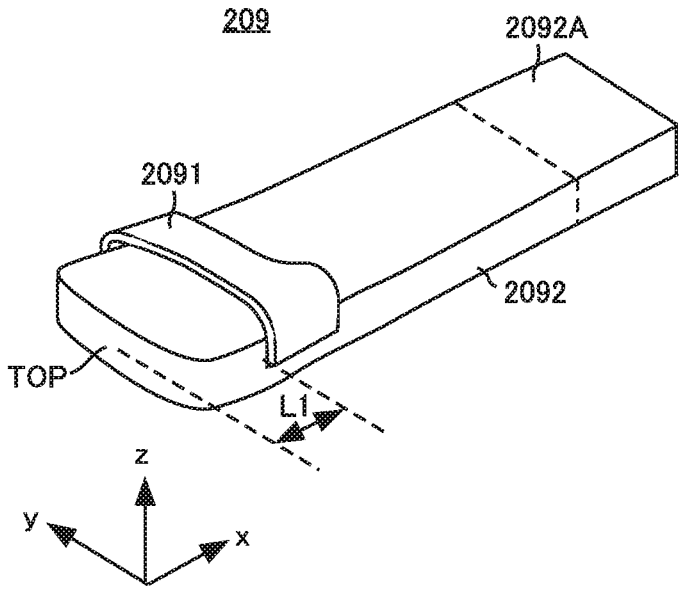
FIG. 4 is a view showing the concept of a footrest member 209 shown in FIG. 1.

FIG. 4 is a diagram showing the concept of the footrest member 209 shown in FIG. 1. Referring to FIG. 4, the footrest member 209 includes the presser part 2091 and a base part 2092.

The presser part 2091 is attached to the base part 2092 at one end side of the base part 2092 in the x-axis direction. More specifically, the presser part 2091 is attached to side surfaces of the base part 2092 in the width-wise direction (the y-axis direction) in a position at a distance L1 from a tip end TOP of the base part 2092 in the x-axis direction. The distance L1 is determined as the distance within which the base between the big toe and the second toe of the trainee and the base between the second toe and the third toe exist when the trainee places the foot on the footrest member 209.

The presser part 2091 is made of an elastic material (such as rubber) and may have a thickness of 2 mm to 3 mm.

The base part 2092 has a flat plate shape. The base part 2092 has a heel placing part 2092A at the end opposite to the tip end TOP in the x-axis direction.

The base part 2092 is made of for example an ethylene-vinylacetate copolymer (EVA) and may have a thickness of 3 mm to 8 mm. The base part 2092 is bent in an x-z plane around an axis in the y-axis direction passing through an arbitrary point in the x-axis direction.

Figure 5:
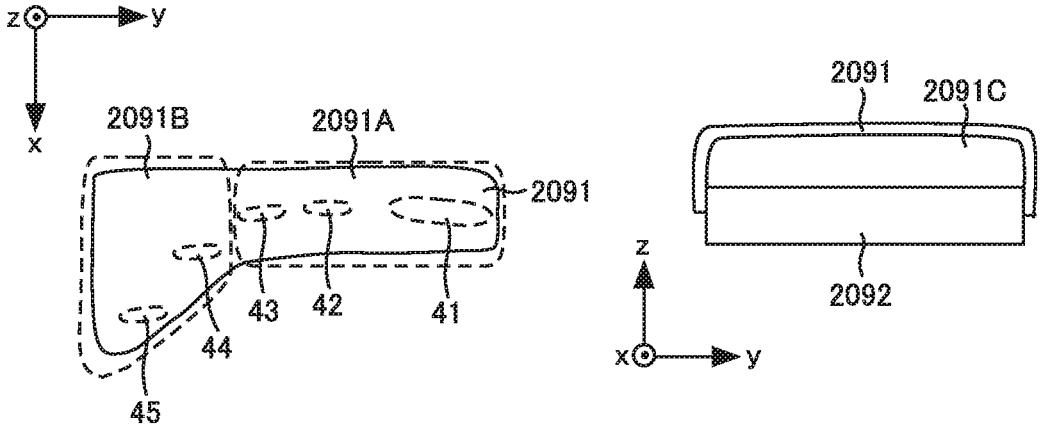
FIG. 5 includes a plan view and a sectional view of a presser part shown in FIG. 4.

FIG. 5 show a plan view and a sectional view of the presser part 2091 shown in FIG. 4. FIG. 5(*a*) is a plan view of the presser part 2091 as seen in the z-axis direction, and FIG. 5(*b*) is a sectional view of the presser part 2091 as seen in the x-axis direction.

Referring to FIG. 5(*a*), the presser part 2091 has a presser part 2091A and a presser part 2091B. The presser part 2091A has a substantially constant width (the length in the x-axis direction) in the y-axis direction. The width of the presser part 2091A may be from 3 cm to 5 cm. The presser part 2091B gradually increases in width (the length in the x-axis direction) in the negative direction along the y-axis.

The presser part 2091B may have a width from 3 cm to 5 cm on the side of the presser part 2091A and a width from 5 cm to 7 cm at an end in the y-axis direction on the side opposite to the side of the presser part 2091A.

Referring to FIG. 5(*b*), the presser part 2091 and the base part 2092 forms a space 2091C. The space 2091C is used for inserting the tip end of the big toe of the trainee. The height (the length in the z-axis direction) of the space 2091C may be from 2.5 cm to 3 cm.

Figure 6:
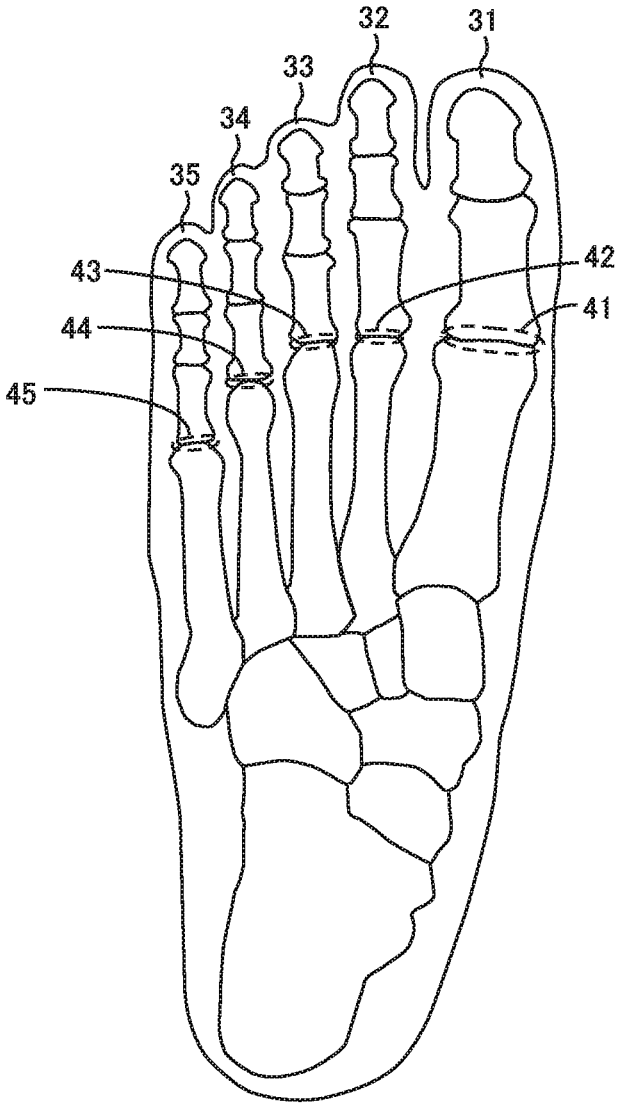
FIG. 6 is a schematic view of the bones of toes of a left foot.

FIG. 6 is a schematic view of the bones of the toes of a left foot. Referring to FIG. 6, the big toe 31 has a first joint and a second joint 41, and the second toe 32, the third toe 33, the fourth toe 34, and the fifth toe 35 have the first joints, the second joints, and the third joints 42 to 45.

As shown in FIG. 6, the second joint 41 of the big toe 31, the third joint 42 of the second toe 32, and the third joint 43 of the third toe 33 are positioned substantially aligned in the width-wise direction of the foot, and the third joint 44 of the fourth toe 34 and the third joint 45 of the fifth toe 45 are in positions displaced from the second joint 41 of the big toe 31, the third joint 42 of the second toe 32, and the third joint 43 of the third toe 33.

Therefore, the presser part 2091A is provided corresponding to the second joint 41 of the big toe 31, the third joint 42 of the second toe 32, and the third joint 43 of the third toe 33 to press the second joint 41 of the big toe 31, the third joint 42 of the second toe 32, and the third joint 43 of the third toe 33.

The presser part 2091B is provided corresponding to the third joint 44 of the fourth toe 34 and the third joint 45 of the fifth toe 45 to press the third joint 44 of the fourth toe 34 and the third joint 45 of the fifth toe 45 (see FIG. 5(*a*)).

Note that in FIG. 5(*a*), the positions of the second joint 41 of the big toe 31, the third joint 42 of the second toe 32, the third joint 43 of the third toe 33, the third joint 44 of the fourth toe 34, and the third joint 45 of the fifth toe 45 are indicated by dotted lines.

As described above, the width (the length in the x-axis direction) of the presser part 2091B gradually increases in the negative direction along the y-axis. This is because the positions of the third joint 44 of the fourth toe 34 and the third joint 45 of the fifth toe 35 are displaced from the positions of the second joint 41 of the big toe 31, the third joint 42 of the second toe 32, and the third joint 43 of the third toe 33 in the x-axis direction.

The presser part 2091 is made of the elastic material, and therefore when the tip end of the foot is inserted in the space 2091C so that the second joint 41 of the big toe 31, the third joint 42 of the second toe 32, the third joint 43 of the third toe 33, the third joint 44 of the fourth toe 34, and the third joint 45 of the fifth toe 45 are in contact with the lower side of the presser part 2091, the tensile force of the elastic material in the z-axis direction acts to press the second joint 41 of the big toe 31, the third joint 42 of the second toe 32, the third joint 43 of the third toe 33, the third joint 44 of the fourth toe 34, and the third joint 45 of the fifth toe 45 toward the base part 2092.

Note that the material of the presser part 2091 is not limited to the elastic material and may be any material which can press the second joint 41 of the big toe 31, the third joint 42 of the second toe 32, the third joint 43 of the third toe 33, the third joint 44 of the fourth toe 34, and the third joint 45 of the fifth toe 45 toward the base part 2092 when the tip end of the foot is inserted in the space 2091C so that the second joint 41 of the big toe 31, the third joint 42 of the second toe 32, the third joint 43 of the third toe 33, the third joint 44 of the fourth toe 34, and the third joint 45 of the fifth toe 45 are in contact with the lower side of the presser part 2091.

The footrest member 213 shown in FIG. 1 is identical to the footrest member 209 shown in FIGS. 4 and 5 in structure, size, and material. Therefore, the heel placing part 2132A of the footrest member 213 is identical to the heel placing part 2092A of the footrest member 209.

FIG. 7 is a diagram for illustrating the operation of the training guidance instrument 200 shown in FIG. 1. Referring to FIG. 7, the support member 212 has a substantially L shape in an x-z plane. The other end of the support member 2197 of the telescopic member 219 is connected to the support member 212 by the end of the straight line part (the part arranged along the x-axis) of the support member 212. In this case, the support member 2197 is connected to the support member 212 rotatably around an axis parallel to the y-axis direction (an axis in a direction perpendicular to the sheet surface of FIG. 7) through a connection part between the other end of the support member 2197 and the support member 212. The support member 2197 is connected to the support member 216 similarly to the connection between the support member 2197 and the support member 212.

When the training guidance instrument 200 is used, the position $Z_A$ of the gate valve 2195 is adjusted to be in the position $Z_{A_n}$ by the pressure adjusting unit 2192 while one end of the support member 212 is in contact with to the ground.

In this case, when one end of the support member 212 is in contact with the ground, the rotary member 210, the support member 211, the rotary part 202A, and the support member 212 rotate clockwise in an x-z plane, and while the part from the presser part 2091 to the tip end of the footrest member 209 is in contact with the ground, the heel placing part 2092A of the footrest member 209 moves upward from the ground as the rotary member 210 and the other members rotate the clockwise and stops at the highest position (maximum position) above and away from the ground when one end of the support member 212 reaches the ground. Then, the position $Z_A$ of the gate valve 2195 is adjusted to be in the position $Z_{A_n}$, by the pressure adjusting unit 2192. As a result, since the pressure $P_{0A_n}$ in the space 2191A is higher than the pressure $P_{0B}$ in the space 2191B, the gate valve 2196 is pressed toward the ground (in the negative direction along the z-axis) by the pressure $P_{0A_n}$ in the space 2191A at a timing when the position $Z_A$ of the gate valve 2195 is in the position $Z_{A_n}$. The force which pushes the gate valve 2196 toward the ground acts as force for rotating the rotary member 210, the support member 211, the rotary part 202A, and the support member 212 in the clockwise direction in an x-z plane, a force Pw1 in the upward direction from the ground is applied on the heel placing part 2092A of the footrest member 209. More specifically, when the heel placing part 2092A reaches its highest position, the upward force Pw1 is applied from the ground to the heel placing part 2092A.

For example, while the force Pw1 is applied to the heel placing part 2092A, the toes of the left foot are inserted in the space 2091C so that the second joint 41 of the big toe 31, the third joint 42 of the second toe 32, the third joint 43 of the third toe 33, the third joint 44 of the fourth toe 34, and the third joint 45 of the fifth toe 45 of the left foot are pressed by the presser part 2091, and the heel of the left foot is placed on the heel placing part 2092A (see FIG. 7(*a*)).

The left foot is bent at the second joint 41 of the big toe 31, the third joint 42 of the second toe 32, the third joint 43 of the third toe 33, the third joint 44 of the fourth toe 34, and the third joint 45 of the fifth toe 45, and the heel is raised upward (in the z-axis direction) while the part from the tip end of the toes to the second joint 41 of the big toe 31, the third joint 42 of the second toe 32, the third joint 43 of the third toe 33, the third joint 44 of the fourth toe 34, and the third joint 45 of the fifth toe 45 is in contact with the ground through the base part 2092.

In the state shown in FIG. 7(*a*), a force Pw2 greater than the force Pw1 is applied to the heel placing part 2092A by the heel of the left foot, and the heel placing part 2092A reaches the ground. In this case, the force Pw2 applied to the heel placing part 2092A moves the gate valve 2196 in the positive direction along the z axis (upward on the sheet surface of FIG. 7) against the pressure $P_{0A_n}$ in the space 2191A of the telescopic member 219. More specifically, the force Pw2 applied on the heel placing part 2092A is force applied on the gate valve 2196 in a direction in which force stronger than the pressure $P_{0A_n}$ is directed from the space 2191B toward the space 2191A.

Then, the rotary member 210, the support member 211, the rotary part 202A, and the support member 212 of the support member 202 of the training guidance instrument 200 rotate counterclockwise in an x-z plane in response to application of the force Pw2 toward the ground on the heel placing part 2092A, and stops the counterclockwise rotary movement as the heel placing part 2092A reaches the ground (see FIG. 7(*b*)).

In this case, since the gate valve 2196 is moved to a position above the initial position, the volume in the space 2191A is smaller than the volume in the state shown in FIG. 7(*a*), and the volume in the space 2191B is larger than the volume in the state shown in FIG. 7(*a*). Therefore, the pressure $P_A$ in the space 2191A of the telescopic member 219 increases from the pressure $P_{0A_n}$ to the pressure $P_{A_n}$ and the pressure $P_B$ in the space 2191B decreases from the pressure $P_{0B}$ to the pressure $P_{B_n}$. Since the pressure $P_{0B}$ is lower than the pressure $P_{0A_n}$, the pressure $P_{A_n}$ is higher than the pressure $P_{B_n}$.

Therefore, when application of the force Pw2 on the heel placing part 2092A is stopped while the heel placing part 2092A in contact with the ground, since the pressure $P_{A_n}$ in the space 2191A is higher than the pressure $P_{B_n}$ in the space 2191B, the gate valve 2196 is pushed toward the ground (in the negative direction along the z-axis) by the pressure $P_{A_n}$ and gradually moves toward the initial position.

Then, the rotary member 210, the support member 211, the rotary part 202A, and the support member 212 of the support member 202 of the training guidance instrument 200 rotate clockwise in an x-z plane in response to the movement of the gate valve 2196 toward the initial position, and the heel placing part 2092A moves above and away from the ground in response to the rotation of the rotary member 210 in the clockwise direction and pushes the heel of the trainee in the upward direction.

When the gate valve 2196 reaches the initial position, one end of the support member 212 reaches the ground, and therefore the rotary member 210, the support member 211, the rotary part 202A and the support member 212 of the support member 202 stop to rotate clockwise, the heel placing part 2092A attains its highest position and stops moving upward while the force Pw1 upward from the ground is applied on the heel placing part 2092A. More specifically, the state shown in FIG. 7(*a*) is attained.

Therefore, the operation of applying the force Pw2 on the heel placing part 2092A until the heel placing part 2092A reaches the ground when the heel placing part 2092A is in its highest position in the state shown in FIG. 7(*a*), and the operation of stopping the application of the force Pw2 on the heel placing part 2092A when the heel placing part 2092A is in contact with the ground in the state shown in FIG. 7(*b*) are repeatedly carried out, so that the heel of the left foot can be moved up and down in the vertical direction while the second joint 41 of big toe 31, the third joint 42 of the second toe 32, the third joint 43 of the third toe 33, the third joint 44 of the fourth toe 34, and the third joint 45 of the fifth toe 45 of the left foot are pressed by the presser part 2091.

Using the footrest member 213, the rotary member 214, the support members 215 and 216, the rotary part 202B, and the telescopic member 220 of the training guidance instrument 200, the heel of the right foot can be moved up and down in the vertical direction according to the same method described in conjunction with FIG. 7 while the second joint 41 of the big toe 31, the third joint 42 of the second toe 32, the third joint 43 of the third toe 33, the third joint 44 of the fourth toe 34, and the third joint 45 of the fifth toe 45 are pressed by the presser part 2131 (=the presser part 2091).

In this manner, using the training guidance instrument 200, the heels of the both feet of the trainee can be made to move up and down in the vertical direction while the second joint 41 of the big toe 31, the third joint 42 of the second toe 32, the third joint 43 of the third toe 33, the third joint 44 of the fourth toe 34, and the third joint 45 of the fifth toe 45 of each of the feet are pressed downward.

The pressure $P_A$ in the space 2191A can be adjusted to an arbitrary pressure within the range from the pressure $P_{AMIN}$ to the pressure $P_{AMAX}$ by the pressure adjusting unit 2192 in the state shown in FIG. 7(*a*), so that the force Pw1 applied on the heel placing part 2092A can be adjusted according to the physical ability of the trainee in the state shown in FIG. 7(*a*).

The strength of the force Pw1 applied on the heel placing part 2092A varies among trainees and strong force can be applied by some trainees on the heel placing part 2092A, while only weaker force can be applied by other trainees to the heel placing part 2092A. Therefore, the pressure $P_A$ in the space 2191A can be adjusted to an arbitrary pressure within the range from the pressure $P_{AMIN}$ to the pressure $P_{AMAX}$ by the pressure adjusting unit 2192, so that the physical ability of the trainee can be evaluated by the strength of the force Pw1 applied to the heel placing part 2092A. More specifically, a trainee who can apply strong force on the heel placing part 2092A has high physical ability, and a trainee who can apply only weak force on the heel placing part 2092A has low physical ability.

In this manner, using the training guidance instrument 200, the pressure $P_A$ in the space 2191A can be adjusted to an arbitrary pressure within the range from the pressure $P_{AMIN}$ to the pressure $P_{AMAX}$ by the pressure adjusting unit 2192, so that the force to be applied on the heel placing part 2092A can be adjusted depending on the physical abilities of the trainees in the state shown in FIG. 7(*a*).

According to the method described in conjunction with FIG. 7, the operation of moving up and down the heel in the vertical direction is performed by the trainee for both feet while the second joint 41 of the big toe 31, the third joint 42 of the second toe 32, the third joint 43 of the third toe 33, the third joint 44 of the fourth toe 34, and the third joint 45 of the fifth toe 45 are pressed, and then the pressure adjusting unit 2192 adjusts the pressure $P_A$ in the space 2191A to a pressure higher than the pressure $P_A$ in the space 2191A before the operation of moving up and down the heel, then force is applied on the heel placing part 2092A in the state shown in FIG. 7(*a*), and it is determined whether the heel placing part 2092A reaches the ground, so that it can be determined whether the physical ability of the trainee has improved. If it is determined that the heel placing part 2092A can reach the ground with the increased pressure $P_A$ in the space 2191A, it can be determined that the physical ability of the trainee has improved, and if the heel placing part 2092A cannot reach the ground with the increased pressure $P_A$ in the space 2191A, it can be determined that the physical ability of the trainee has not improved.

Therefore, using the training guidance instrument 200, it can quickly be determined whether the physical ability of the trainee has improved.

Figure 8:
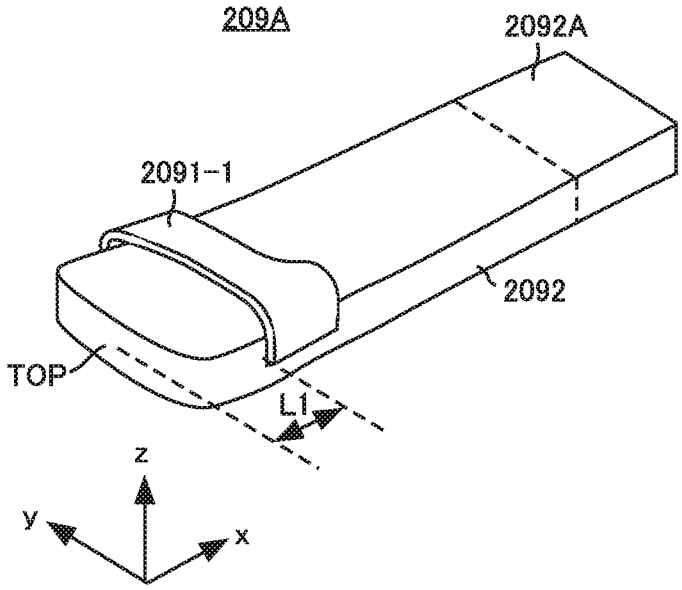
FIG. 8 is a schematic view of another footrest member according to the embodiment of the present invention.

FIG. 8 is a schematic view of another footrest member according to the embodiment of the present invention. Referring to FIG. 8, a footrest member 209A is identical to the footrest member 209 except that the presser part 2091 of the footrest member 209 shown in FIG. 4 is replaced by a presser part 2091-1.

The presser part 2091-1 is attached to the base part 2092 in the same position as that of the presser part 2091. The presser part 2091-1 has the same planar shape as the presser part 2091 (see FIG. 5(*a*)).

Figure 9:
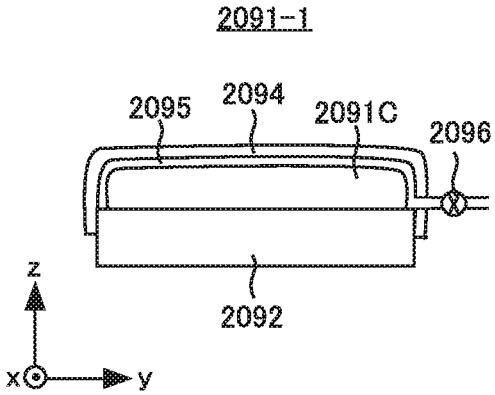
FIG. 9 is a sectional view of the presser part 2091-1 of the footrest member 209A shown in FIG. 8.

FIG. 9 is a sectional view of a part of the presser part 2091-1 of the footrest member 209A shown in FIG. 8.

Referring to FIG. 9, the presser part 2091-1 includes a fixing member 2094, a bag member 2095, and a valve 2096.

The fixing member 2094 is fixed to the side surfaces at both ends of the base part 2092 in the y-axis direction. The bag member 2095 is attached along the inner surface of the fixing member 2094 and partly connected to the valve 2096 through the fixing member 2094.

The valve 2096 is connected to a part of the bag member 2095. Then, the valve 2096 causes the inside of the bag member 2094 to communicate with the outside by an opening/closing mechanism or shuts off the inside of the bag member 2094 from the outside.

The fixing member 2094 and the bag member 2095 form the space 2091C between the base part 2092 and themselves.

The fixing member 2094 is made of a material such as a metal, plastic, wood, styrene foam and etc. The fixing member 2094 has for example a thickness from 2 mm to 3 mm.

The bag member 2095 is made for example of vinyl. When air is enclosed through the valve 2096 so that the internal pressure is higher than the atmospheric pressure, the bag member 2095 is inflated toward the base part 2092.

Therefore, when the trainee inserts the tip end of the foot into the space 2091C, and the second joint of the big toe, the third joint of the second toe, the third joint of the third toe, the third joint of the fourth toe, and the third joint of the fifth toe are placed under the fixing members 2094 and the bag member 2095, air is sealed in the bag member 2095.

As a result, since the bag member 2095 is inflated toward the base part 2092, the second joint of the big toe, the third joint of the second toe, the third joint of the third toe, the third joint of the fourth toe, and the third joint of the fifth toe of the trainee can be accurately pressed.

The foot size varies among trainees, and even for different foot sizes, the second joint of the big toe, the third joint of the second toe, the third joint of the third toe, the third joint of fourth toe, and the third joint of the fifth toe can accurately be pressed using the presser part 2091-1. As a result, when the operation described in conjunction with FIG. 7 is carried out by each of the trainees for both feet, the operation of moving up and down the heel of the feet can be carried out by the trainee while the second joint of the big toe, the third joint of the second toe, the third joint of the third toe, the third joint of the fourth toe, and the third joint of the fifth toe are accurately pressed, so that the physical ability of the trainee can be improved more accurately.

According to the embodiment of the present invention, the training guidance instrument 200 may include the footrest member 209A instead of the footrest members 209 and 213.

Figure 10:
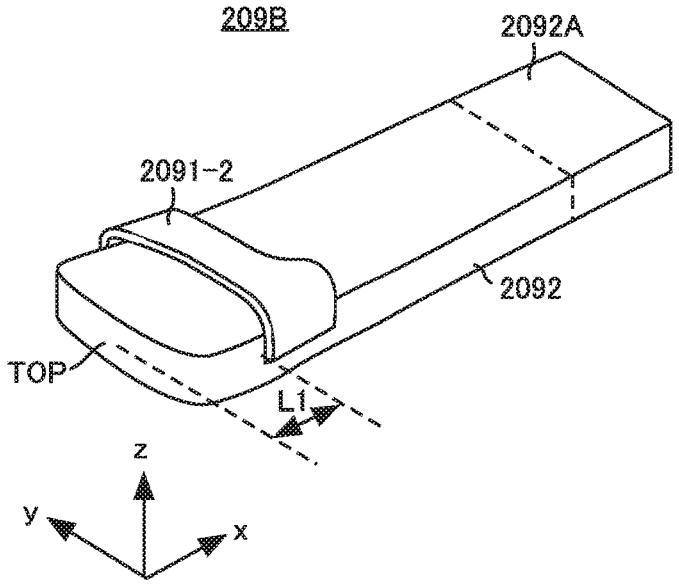
FIG. 10 is a schematic view of another footrest member according to the embodiment of the present invention.

FIG. 10 is a schematic view of another footrest member according to the embodiment of the present invention. Referring to FIG. 10, a footrest member 209B is identical to the footrest member 209 except that the presser part 2091 of the footrest member 209 shown in FIG. 4 is replaced by the presser part 2091-2.

The presser part 2091-2 is attached to the base part 2092 in the same position as the presser part 2091. The presser part 2091-2 has the same planar shape as the planar shape (see FIG. 5(*a*)) of the presser part 2091 and is made of the same material as that of the presser part 2091. The presser part 2091-2 has the same size as that of the presser part 2091.

Figure 11:
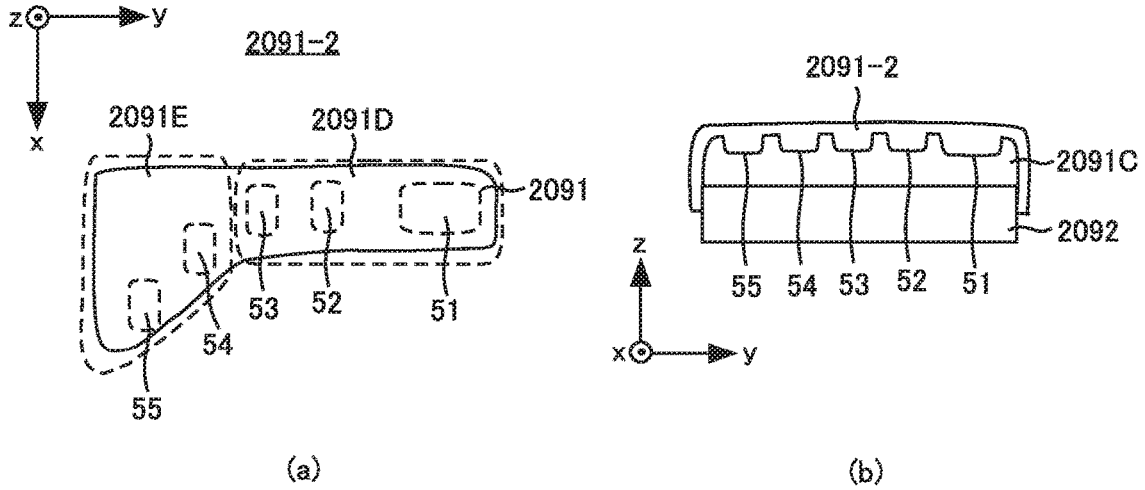
FIG. 11 includes a plan view and a sectional view of the presser part shown in FIG. 10.

FIG. 11 shows a plan view and a sectional view of the presser part shown in FIG. 10. FIG. 11(*a*) is a plan view of the presser part 2091-2 as seen in the z-axis direction, and FIG. 11(*b*) is a sectional view of the presser part 2091-2 as seen in the x-axis direction.

Referring to FIG. 11(*a*), the presser part 2091-2 has a presser part 2091D and a presser part 2091E. The presser part 2091D is equivalent to the presser part 2091A shown in FIG. 5(*a*) additionally provided with protrusions 51 to 53. The presser part 2091E is equivalent to the presser part 2091B shown in FIG. 5(*a*) additionally provided with protrusions 54 and 55. Therefore, the presser part 2091-2 is equivalent to the presser part 2091 additionally provided with the protrusions 51 to 55.

The protrusions 51 to 55 are provided in positions corresponding to the second joint of the big toe, the third joint of the second toe, the third joint of the third toe, the third joint of the fourth toe, and the third joint of the fifth toe. The protrusions 51 to 55 are made of the same material as that of the presser parts 2091A and 2091B.

For example, the protrusions 51 to 55 have a length from 1 cm to 2 cm in the x-axis direction. For example, the protrusion 51 has a length of about 2 cm in the y-axis direction, and the protrusions 52 to 55 have a length from 5 mm to 1 cm in the y-axis direction.

Referring to FIG. 11(*b*), the protrusions 51 to 55 protrude toward the base part 2092 and have a substantially rectangular cross-sectional shape.

Since the presser part 2091-2 is made of the same material as that of the presser part 2091, and when the second joint of the big toe, the third joint of the second toe, the third joint of the third toe, the third joint of the fourth toe, and the third joint of the fifth toe are inserted in the space 2091C, tensile force in the z-axis direction causes the protrusions 51 to 55 to be pressed against the second joint of the big toe, the third joint of the second toe, the third joint of the third toe, the third joint of the fourth toe, and the third joint of the fifth toe.

Therefore, the second joint of the big toe, the third joint of the second toe, the third joint of the third toe, the third joint of the fourth toe, and the third joint of the fifth toe can accurately be pressed by the presser part 2091-2. As a result, by letting the trainee carry out the operation described in conjunction with FIG. 7 for both feet, while the second joint of the big toe, the third joint of the second toe, the third joint of the third toe, the third joint of the fourth toe, and the third joint of the fifth toe are accurately pressed, the trainee can perform the operation of moving the heels of the feet up and down in the vertical direction, so that the physical ability of the trainee can be improved more accurately.

According to the embodiment of the present invention, the training guidance instrument 200 may include the footrest member 209B instead of the footrest members 209 and 213.

Figure 12:
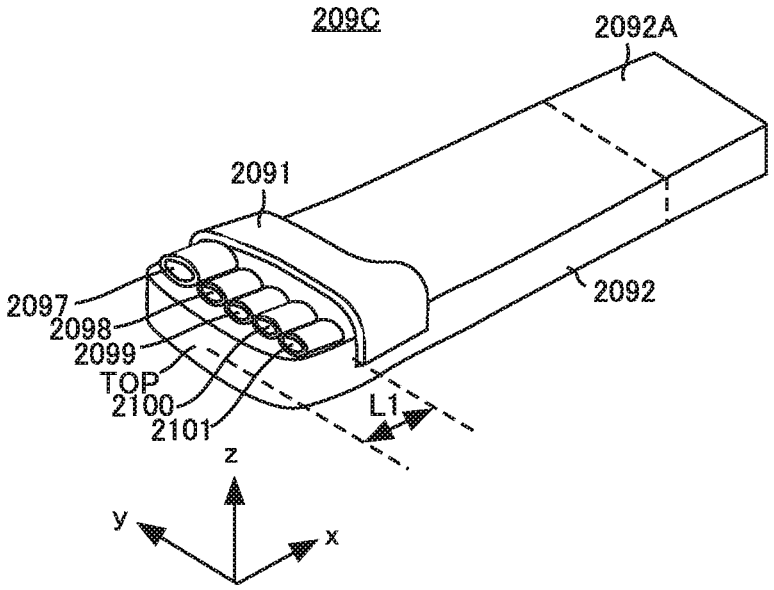
FIG. 12 is a schematic view of yet another footrest member according to the embodiment of the present invention.

FIG. 12 is a schematic view of yet another footrest member according to the embodiment of the present invention. Referring to FIG. 12, a footrest member 209C is the same as the footrest member 209 except that toe insertion parts 2097 to 2101 are added to footrest member 209 shown in FIG. 4.

The toe insertion parts 2097 to 2101 are provided closer to the tip end TOP than the presser part 2091. The toe insertion parts 2097 to 2101 are for inserting the big toe, the second toe, the third toe, the fourth toe, and the fifth toe, respectively.

The toe insertion parts 2097 to 2101 are made of an elastic material such as rubber. The toe insertion parts 2097 to 2101 have a cylindrical shape, the toe insertion part 2097 has an elliptical section having its major axis arranged in the y-axis direction, and the toe insertion parts 2098 to 2101 each have a substantially circular cross section. The length along the major axis of the toe insertion part 2097 is for example about 2.5 cm, and the length along the minor axis is for example about 2 cm. The toe insertion parts 2098 to 2101 each have for example a diameter of about 1 cm.

The thicknesses of the big toe, the second toe, the third toe, the fourth toe, fifth toe vary among trainees, but since the toe insertion parts 2097 to 2101 are made of an elastic material, each of the trainees can insert the big toe, the second toe, the third toe, the fourth toe, and the fifth toe into the toe insertion parts 2097 to 2101, respectively.

Using the footrest member 209C, the trainee is allowed to move the heels of the feet up and down in the vertical direction while the toes of the trainee are inserted into the toe insertion parts 2097 to 2101, and the second joint of the big toe, the third joint of the second toe, the third joint of the third toe, the third joint of the fourth toe, and the third joint of the fifth toe are pressed by the presser part 2091.

As a result, since the heel can be moved up and down in the vertical direction while the tip end of the foot in contact with the ground via the footrest member 209C, the physical ability of the trainee can further be improved.

Note that the footrest member 209C may be provided with one of the presser parts 2091-1 and 2091-2 instead of the presser part 2091.

The training guidance instrument 200 according to the embodiment of the present invention may include a footrest member 209C instead of the footrest members 209 and 213.

Figure 13:
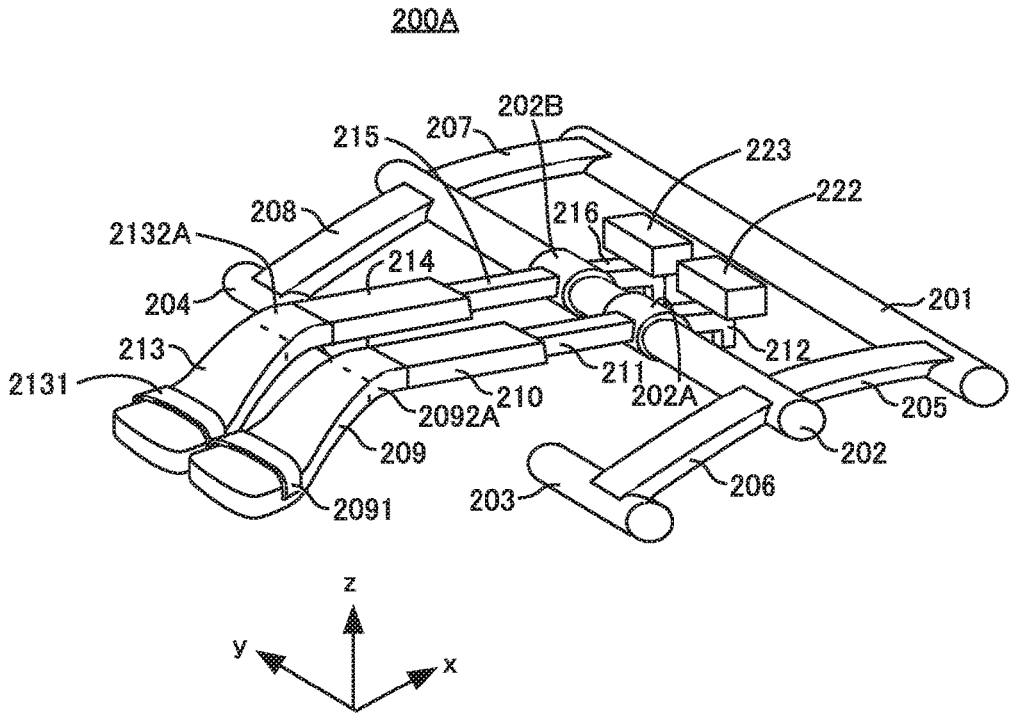
FIG. 13 is a schematic view of another training guidance instrument according to the embodiment of the present invention.

FIG. 13 is a schematic diagram of yet another training guidance instrument according to an embodiment of the present invention.

The training guidance instrument according to the embodiment of the present invention may be a training guidance instrument 200A shown in FIG. 13.

Referring to FIG. 13, the training guidance instrument 200A is the same as the training guidance instrument 200 except that the leg parts 217 and 218, the telescopic members 219 and 220, and the plate member 221 of the training guidance instrument 200 shown in FIG. 1 are replaced by with weight members 222 and 223.

The weight member 222 is provided on the support member 212, and the weight member 223 is provided on the support member 216.

In an initial state of the training guidance instrument 200A, one end of the support member 212 is in contact with the ground by the weight member 222, and one end of the support member 216 is in contact with the ground by the weight member 223.

Figure 14:
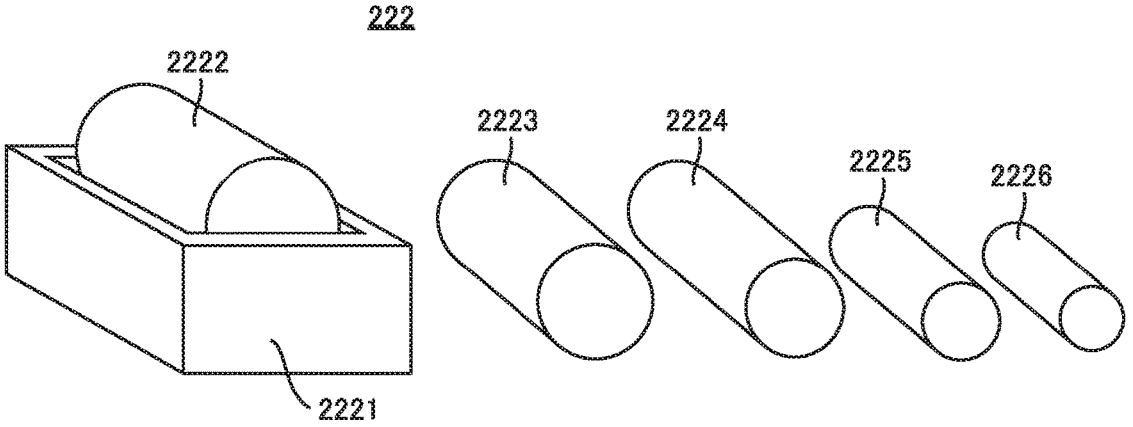
FIG. 14 is a schematic view of a weight member shown in FIG. 13.

FIG. 14 is a schematic view of the weight member 222 shown in FIG. 13. Referring to FIG. 14, the weight member 222 includes a box member 2221 and weights 2222 to 2226.

The box member 2221 has a substantially rectangular parallelepiped shape and has an externally open recess. Then, the box member 2221 is fixed to the end of the straight part (the part parallel to the x-axis) of the support member 212.

The weights 2222 to 2226 have a substantially cylindrical shape and different weights from one another. In FIG. 14, the difference in weight is represented in magnitude. When the weights of the weights 2222 to 2226 are m1 to m5, respectively, the relation is represented by m1>m2>m3>m4>m5.

Any one of the weights 2222 to 2226 is placed in the recess of the box member 2221. When the lightest weight 2226 is placed in the recess of the box member 2221, one end of the support member 212 reaches the ground.

Note that the weight member 223 shown in FIG. 13 also has the same structure as the weight member 222 shown in FIG. 14. Therefore, when the lightest weight 2226 is placed in the recess of the box member 2221, one end of the support member 216 reaches the ground.

FIG. 15 is a diagram for illustrating the operation of the training guidance instrument 200A shown in FIG. 13. Referring to FIG. 15, when the training guidance instrument 200A is used, one of the weights 2222 to 2226 is placed in the recess of box member 2221. Then, the rotary member 210, the support member 211, the rotary part 202A, and the support member 212 rotate clockwise within an x-z plane, and the heel placing part 2092A moves upward from the ground in response to the clockwise rotation of the rotary member 210 and the other members and stops in the highest position which is moved upward from the ground when one end of the support member 212 reaches the ground.

The force of the weight member 222 which pushes the support member 212 toward the ground acts as force which rotates the rotary member 210, the support member 211, the rotary part 202A, and the support member 212 in the clockwise direction in an x-z plane, and while the heel placing part 2092A reaches the highest position, a force Pw3 in the upward direction from the ground is applied on the heel placing part 2092A by the weight member 222.

For example, while the force Pw3 is applied on the heel placing part 2092A, the toes of the left foot are inserted in the space 2091C so that the second joint 41 of the big toe 31, the third joint 42 of the second toe 32, the third joint 43 of the third toe 33, the third joint 44 of the fourth toe 34, and the third joint 45 of the fifth toe 45 of the left foot are pressed by the presser part 2091, and the heel of the left foot is mounted on the heel placing part 2092A (see FIG. 15(*a*)).

In this case, the left foot is bent at the second joint 41 of the big toe 31, the third joint 42 of the second toe 32, the third joint 43 of the third toe 33, the third joint 44 of the fourth toe 34, and the third joint 45 of the fifth toe 45, and the heel is raised in the upward direction (in the z-axis direction) while the part from tip end of the toes of the foot to the second joint 41 of the big toe 31, the third joint 42 of the second toe 32, the third joint 43 of the third toe 33, the third joint 44 of the fourth toe 34, and the third joint 45 of the fifth toe 45 is in contact with the ground through the footrest member 209.

In the state shown in FIG. 15(*a*), a force Pw4 toward the ground stronger than the force Pw3 is applied on the heel placing part 2092A by the heel of the left foot.

In this way, the rotary member 210, the support member 211, the rotary part 202A, and the support member 212 of the support member 202 of the training guidance instrument 200A rotate counterclockwise in an x-z plane in response to application of the force Pw4 toward the ground on the heel placing part 2092A and stops the counterclockwise rotation as the heel placing part 2092A reaches the ground (see FIG. 15(*b*)).

When the application of the force Pw4 on the heel placing part 2092A is stopped while the heel placing part 2092A is in contact with the ground, the force of the weight member 222 which pushes the support member 212 toward the ground rotates the rotary member 210, the support member 211, the rotary part 202A, and the support member 212 of the support member 202 of the training guidance instrument 200A in the clockwise direction, and the heel placing part 2092A moves upward from the ground as the clockwise rotation of the rotary member 210 and the other members to raise the heels upward.

When one end of the support member 212 reaches the ground, the rotary member 210, the support member 211, the rotary part 202A, and the support member 212 of the support member 202 stop rotating in the clockwise direction, and the heel placing part 2092A reaches the highest position above the ground and stops the upward movement, so that the state shown in FIG. 15(*a*) is attained.

Therefore, the operation of applying the force Pw4 on the heel placing part 2092A until the heel placing part 2092A reaches the ground in the state shown in FIG. 15(*a*) and the operation of stopping applying the force Pw4 on the heel placing part 2092A in the state shown in FIG. 15(*b*) are repeatedly carried out, so that the heel of the left foot can be moved up and down in the vertical direction while the second joint 41 of the big toe 31, the third joint 42 of the second toe 32, the third joint 43 of the third toe 33, the third joint 44 of the fourth toe 34, and the third joint 45 of the fifth toe 45 of the left foot are pressed by the presser part 2091.

Using the footrest member 213, the rotary member 214, the support member 215, the rotary part 202B, and the support member 216 of the training guidance instrument 200A, the heel of the right foot can be moved up and down in the vertical direction by the same method described in conjunction with FIG. 15 while the second joint 41 of the big toe 31, the third joint 42 of the second toe 32, the third joint 43 of the third toe 33, the third joint 44 of the fourth toe 34, and the third joint 45 of the fifth toe 45 of the right foot are pressed by the presser part 2131.

In this way, using the training guidance instrument 200A, the trainee can be instructed to carry out the operation of moving heel up and down in the vertical direction for both feet while the second joint 41 of the big toe 31, the third joint 42 of the second toe 32, the third joint 43 of the third toe 33, the third joint 44 of the fourth toe 34, and the third joint 45 of the fifth toe 45 of the foot are pressed by the presser part 2091.

In the state shown in FIG. 15(*a*), the weight of the weight placed in the recess of the box member 2221 can be changed, so that the force Pw4 applied on the heel placing part 2092A in the state shown in FIG. 15(*a*) can be adjusted depending the physical abilities of the trainees.

The strength of the force Pw4 to be applied on the heel placing part 2092A may vary depending on the trainee, and some trainees can apply strong force on the heel placing part 2092A, while others can apply only weak force on the heel placing part 2092A. Therefore, the physical abilities of the trainee can be evaluated by the strength of the force Pw4 applied on the heel placing part 2092A. More specifically, a trainee who can apply strong force on the heel placing part 2092A has high physical ability, and a trainee who can apply only weak force on the heel placing part 2092A has low physical ability.

As described above, using the training guidance instrument 200A, the weight of the weight to be placed in the recess of the box member 2221 can be changed, so that the force Pw4 to be applied on the heel placing part 2092A in the state shown in FIG. 15(*a*) can be adjusted depending on the physical ability of the trainee.

Furthermore, according to the method described in conjunction with FIG. 15, the trainee is allowed to carry out the operation of moving the heels up and down in the vertical direction while the second joint 41 of the big toe 31, the third joint 42 of the second toe 32, the third joint 43 of the third toe 33, the third joint 44 of the fourth toe 34, and the third joint 45 of the fifth toe 45 are pressed by the presser part 2091, then the weight of the weight placed in the recess of the box member 2221 may be changed to a heavier weight than the weight before the up-down movement of the heel, and it is determined whether the heel placing part 2092A reaches the ground upon applying force toward the ground on the heel placing part 2092A in the state shown in FIG. 15(*a*), so that it can be determined whether the physical ability of the trainee has improved. When the weight of the weight is increased and still the heel placing part 2092A can reach the ground, it can be determined that the physical ability of the trainee has improved, while when the heel placing part 2092A with the heavier weight cannot reach the ground, it can be determined that the physical ability of the trainee has not improved.

Therefore, using the training guidance instrument 200A, it can quickly be determined whether the physical ability of the trainee has improved.

Note that the training guidance instrument 200A may be provided with any one of the footrest members 209A, 209B, and 209C instead of the footrest members 209 and 213.

FIG. 16 is a schematic diagram of yet another training guidance instrument according to the embodiment of the present invention. The training guidance instrument according to the embodiment of the present invention may be a training guidance instrument 200B shown in FIG. 16.

Referring to FIG. 16, the training guidance instrument 200B includes a footrest member 209 and an expandable/shrinkable member 230.

The expandable/shrinkable member 230 has for example an elliptical spherical shape similar to a rugby ball. In this case, the major axis of the ellipse is arranged in the y-axis direction.

The expandable/shrinkable member 230 can enclose air inside. The air pressure in the expandable/shrinkable member 230 can be adjusted to an arbitrary air pressure in a range higher than the atmospheric pressure.

The heel placing part 2092A of the footrest member 209 is fixed to the surface of the expandable/shrinkable member 230. More specifically, one of a pair of hook-and-loop fasteners is fixed to the back surface of the heel placing part 2092A, the other is fixed to the surface of the expandable/shrinkable member 230, and the heel placing part 2092A is fixed to the surface of the expandable/shrinkable member 230 as one of the fasteners is contacted to the other.

When one of the both feet is placed on the footrest member 209 and force is applied on the heel placing part 2092A by the heel so that the expandable/shrinkable member 230 is shrunk, the force to be applied on the heel placing part 2092A is greater than the pressure of the air enclosed in the expandable/shrinkable member 230. Therefore, when force toward the ground which is greater than the pressure of the air enclosed in the expandable/shrinkable member 230 is applied on the heel placing part 2092A, the heel placing part 2092A moves toward the ground, so that the expandable/shrinkable member 230 can be shrunk toward the ground and the footrest member 209 is substantially parallel to an x-y plane.

Then, when application of the force on the heel placing part 2092A is stopped while the footrest member 209 is substantially parallel to an x-y plane, the heel placing part 2092A is moved upward (in the z-axis direction) by the pressure of the air enclosed in the expandable/shrinkable member 230.

FIG. 17 is a diagram for illustrating the operation of the training guidance instrument 200B shown in FIG. 16.

Referring to FIG. 17, when the training guidance instrument 200B is used, air is enclosed in the expandable/shrinkable member 230 to adjust the air pressure inside the expandable/shrinkable member 230 to a predetermined pressure. Then, while the part from the presser part 2091 of the footrest member 209 to the tip end is in contact with the ground, the heel placing part 2092A moves upward from the ground in response to upward force from the ground caused by the air pressure of the expandable/shrinkable member 230. Then, the heel placing part 2092A stops in the highest position above the ground. As the heel placing part 2092A is in the highest position, an upward force Pw5 from the ground is applied on the heel placing part 2092A.

For example, while the force Pw5 is applied on the heel placing part 2092A, the toes of the left foot is inserted in the space 2091C so that the second joint 41 of the big toe 31, the third joint 42 of the second toe 32, the third joint 43 of the third toe 33, the third joint 44 of the fourth toe 34, and the third joint 45 of the fifth toe 45 are pressed by the presser part 2091, and the heel of the left foot is placed on the heel placing part 2092A (see FIG. 17(*a*)).

In this case, the left foot is bent at the second joint 41 of the big toe 31, the third joint 42 of the second toe 32, the third joint 43 of the third toe 33, the third joint 44 of the fourth toe 34 and the third joint 45 of the fifth toe 45, the part from the tip end of the toes to the second joint 41 of the big toe 31, the third joint 42 of the second toe 32, the third joint 43 of the third toe 33, the third joint 44 of the fourth toe 34, and the third joint 45 of the fifth toe 45 is in contact with the ground through the footrest member 209, and the heel is raised upward (in the z-axis direction).

In the state shown in FIG. 17(*a*), a force Pw6 toward the ground which is greater than the force Pw5 is applied on the heel placing part 2092A by the heel of the left foot.

Then, the expandable/shrinkable member 230 of the training guidance instrument 200B is shrunk toward the ground, and the heel placing part 2092A is substantially parallel to an x-y plane (see FIG. 17(*b*)).

Then, when the heel placing part 2092A stops applying the force Pw6 while the heel placing part 2092A is substantially parallel to an x-y plane, the expandable/shrinkable member 230 is inflated by the pressure of the air inside, and the heel placing part 2092A moves upward from the ground by the inflation of the expandable/shrinkable member 230 and pushes the heel upward.

When the heel placing part 2092A reaches the upward highest position (in the z-axis direction), the heel placing part 2092A stops moving in the upward direction. More specifically, the state shown in FIG. 17(*a*) is attained.

Therefore, the operation of applying the force Pw6 on the heel placing part 2092A until the heel placing part 2092A is substantially parallel to an x-y plane in the state shown in FIG. 17(*a*) and the operation of stopping applying the force Pw6 on the heel placing part 2092A in the state shown in FIG. 17(*b*) are repeatedly carried out, so that the heel of the left foot can be moved up and down in the vertical direction while the second joint 41 of the big toe 31, the third joint 42 of the second toe 32, the third joint 43 of the third toe 33, the third joint 44 of the fourth toe 34, and the third joint 45 of the fifth toe 45 of the left foot are pressed by the presser part 2091.

Furthermore, the heel of the right foot can be moved up and down according to the method shown in FIG. 17 using the training guidance instrument 200B having the heel placing part 2132A (=the heel placing part 2092A) of the footrest member 213 (in place of the footrest member 209) fixed to the surface of the expandable/shrinkable member 230.

In this way, using the training guidance instrument 200B, the trainee is allowed to carry out, for both feet, the operation of moving the heel up and down in the vertical direction while the second joint 41 of the big toe 31, the third joint 42 of the second toe 32, the third joint 43 of the third toe 33, the third joint 44 of the fourth toe 34, and the third joint 45 of the fifth toe 45 are pressed by the presser part 2091.

Furthermore, in the state shown in FIG. 17(*a*), since the pressure of the air inside the expandable/shrinkable member 230 can be changed, the force Pw6 applied on the heel placing part 2092A in the state shown in FIG. 17(*a*) can be adjusted depending on the physical ability of the trainee.

The strength of the force Pw6 applied on the heel placing part 2092A varies among trainees, and some trainees can apply strong force on the heel placing part 2092A, while other trainees can apply only weak force on the heel placing part 2092A. Therefore, the physical ability of a trainee can be evaluated by the strength of the force Pw6 applied on the heel placing part 2092A. More specifically, a trainee who can apply strong force on the heel placing part 2092A has high physical ability, and a trainee who can apply only weak force on the heel placing part 2092A has low physical ability.

Since the pressure of the air inside the expandable/shrinkable member 230 can be changed using the training guidance instrument 200B, the force Pw6 applied to the heel placing part 2092A in the state shown in FIG. 17(*a*) can be adjusted according to the physical ability of the trainee.

Furthermore, according to the method described in conjunction with FIG. 17, the trainee carries out, for both feet, the operation of moving the heel up and down in the vertical direction while the second joint 41 of the big toe 31, the third joint 42 of the second toe 32, the third joint 43 of the third toe 33, the third joint 44 of the fourth toe 34, and the third joint 45 of the fifth toe 45 are pressed by the presser part 2091, then the pressure of the air inside the expandable/shrinkable member 230 may be changed to higher pressure than the pressure in the expandable/shrinkable member 230 before the operation of moving the heels up and down, and then it can be determined whether the heel placing part 2092A approaches the ground by applying force on the heel placing part 2092A in the state shown in FIG. 17(*a*), so that it can be determined whether the physical ability of the trainee has improved. If the heel placing part 2092A can be brought closer to the ground with the increased air pressure inside the expandable/shrinkable member 230, it can be determined that the physical ability of the trainee has improved, and if the heel placing part 2092A cannot be brought closer to the ground with the increased air pressure inside the expandable/shrinkable member 230, it can be determined that the physical ability of the trainee has not improved.

Therefore, using the training guidance instrument 200B, it can quickly be determined whether the physical ability of the trainee has improved.

Note that the training guidance instrument 200B may include any one of the footrest members 209A, 209B, and 209C instead of the footrest member 209.

In the above description, at the start of using the training guidance instruments 200, 200A, and 200B, the forces Pw2, Pw4, and Pw6 are applied to the heel placing part 2092A in a position where the heel placing part 2092A of each of the training guidance instrument 200, 200A, and 200B is raised from the ground, and then the heel placing part 2092A is moved closer to the ground. However, according to the embodiment of the present invention, the present invention is not limited to this, and use of the training guidance instruments 200, 200A, and 200B may be started while the heel mounting part 2092A is in contact with the ground.

When the training guidance instrument 200 is used, the pressure adjusting unit 2192 adjusts the pressure $P_A$ in the space 2191A so that the pressure $P_A$ in the space 2191A is higher than the pressure $P_B$ in the space 2191B when air is enclosed in the space 2191B until the heel placing part 2092A reaches the ground, and then the training guidance instrument 200 may start to be used, so that in the state shown in FIG. 7(*b*), the rotary member 210, the support member 211, the rotary part 202A, and the support member 212 rotate in the clockwise direction in response to the interruption of application of the force Pw2 on the heel placing part 2092A by the trainee, and the heel placing part 2092A moves upward (the z-axis direction) to raise the heel of the trainee upward. More specifically, the state shown in FIG. 7(*a*) is attained.

Then, when the state shown in FIG. 7(*a*) is attained, force toward the ground which is stronger than the upward force from the ground applied on the heel placing part 2092A may be applied according to the above-described method, so that the heel placing part 2092A can reach the ground.

Therefore, the heel of the trainee can be moved up and down in the vertical direction even when the training guidance instrument 200 starts to be used from the state where the heel placing part 2092A is in contact with the ground.

Furthermore, when the training guidance instrument 200A starts to be used and a weight is not placed in the recess of the box member 2221, the heel placing part 2092A is in contact with the ground. Therefore, when the training guidance instrument 200A starts to be used with no weight placed in the recess of the box member 2221 by placing the foot of the trainee on the footrest member 209 and then placing a weight (any of weights 2222 to 2226) in the recess of the box member 2221, the heel of the trainee may be moved up and down in the vertical direction according to the above-described method even by starting using the training guidance instrument 200A from the state in which the heel placing part 2092A is in contact with the ground.

Furthermore, when the training guidance instrument 200B is used, the heel placing part 2092A is in contact with the ground while air is evacuated from the expandable/shrinkable member 230. Therefore, when the foot of the trainee is placed on the footrest member 209 with no air inside the expandable/shrinkable member 230, and then air is gradually input to be enclosed in the expandable/shrinkable member 230 so that the state shown in FIG. 17(*a*) is attained without applying force toward the ground on the footrest member 209, the heel placing part 2092A can move upward from the ground to raise the heel of the trainee upward. After the state shown in FIG. 17(*a*) is attained, the force Pw6 toward the ground can be applied to the heel placing part 2092A, and the heel placing part 2092A can be moved toward the ground according to the above-described method.

Therefore, even when the training guidance instrument 200B starts to be used while the heel placing part 2092A is in contact with the ground, the heel of the trainee can be moved up and down in the vertical direction.

Accordingly, the training guidance instruments 200, 200A, and 200B may start to be used from the state in which the heel placing part 2092A is in a position above and away the ground or the training guidance instruments 200, 200A, and 200B may start to be used from the state in which the heel placing part 2092A is in contact with the ground.

In the above description, when the heel placing part 2092A is in the highest position above the ground, one of the forces Pw2, Pw4, and Pw6 toward the ground is applied on the heel placing part 2092A to have the heel placing part 2092A reach the ground, while according to the embodiment of the present invention, the present invention is not limited to this, and when the heel placing part 2092A is positioned above and apart from the ground, force toward the ground which is stronger than the upward force from the ground applied on the heel placing part 2092A may be applied on the heel placing part 2092A to move the heel placing part 2092A to a lower position, and the application of the force on the heel placing part 2092A may be stopped in the lower position. This also allows the trainee to move the heel up and down in the vertical direction while the second joint of the big toe, and the third joints of the second toe, the third toe, the fourth toe, and the fifth toe are pressed by the presser part. More specifically, the trainee can move the heel up and down in the range below the highest position of the heel placing part 2092A above the ground while the second joint of the big toe and the third joints of the second toe, the third toe, the fourth toe, and the fifth toe are pressed by the presser part.

Therefore, the training guidance instrument according to the embodiment of the present invention may include a presser part which presses the second joint of the big toe and the third joints of the second toe, the third toe, the fourth toe, and the fifth toe of the trainee, a heel placing part for placing the heel of the trainee thereon, and a control unit configured to move the heel placing part toward the ground in response to application of second force by the trainee on the heel placing part, the second force being stronger than first force applied upward from the ground on the heel placing part when the heel placing part is positioned above and away from the ground and move the heel placing part upward from the ground in response to application of weaker force toward the ground than the second force by the trainee on the heel placing part when the heel placing part is positioned below its upward highest position above the ground, while the second and third joints of the trainee are pressed by the presser part. The control unit preferably moves the heel placing part upward from the ground in response to interruption of application of force toward the ground by the trainee to the heel placing part when the heel placing part is positioned below the upward highest position above the ground.

The force applied on the heel placing part 2092A should be weaker than the second force when the heel placing part 2092A is below the highest position for the following reason.

In the training guidance instruments 200, 200A, and 200B, when the forces Pw2, Pw4, and Pw6 (the second force) are each applied on the heel placing part 2092A, the heel placing part 2092A stops by the forces Pw2, Pw4, and Pw6 (=the second force) in a position which prohibits the heel placing part 2092A from moving toward the ground. More specifically, the heel placing part 2092A stops in a position where the forces Pw2, Pw4, and Pw6 are equal to the forces Pw1, Pw3, and Pw5, respectively. Therefore, when the force applied on the heel placing part 2092A is weaker than the forces Pw2, Pw4, and Pw6 (=the second force) while the heel placing part 2092A is below its highest position, the heel placing part 2092A starts to move upward from the ground.

Therefore, when the presser part, the heel placing part, and the control unit are provided, the trainee is allowed to move the heel up and down in the vertical direction while the second joint of the big toe and the third joints of the second toe, the third toe, the fourth toe, and the fifth toe are pressed.

In the training guidance instruments 200, 200A, and 200B, when the upward forces Pw1, Pw3, and Pw5 are each applied from the ground on the heel placing parts 2092A and 2132A of the footrest members 209 and 213, the downward forces Pw2, Pw4, and Pw6 stronger than the forces Pw1, Pw3, and Pw5 are each applied on the heel placing parts 2092A and 2132A against the forces Pw1, Pw3, and Pw5, so that the heel placing parts 2092A and 2132A move toward the ground, and application of the downward forces Pw2, Pw4, and Pw6 on the heel placing parts 2092A and 2132A moved toward the ground is interrupted, so that the heel placing parts 2092A and 2132A move upward from the ground.

Note that in the training guidance instrument 200, the rotary members 210 and 214, the support members 211 and 215, the rotary parts 202A and 202B, the support members 212 and 216, and the telescopic members 219 and 220 constitute the "control unit."

Also in the training guidance instrument 200A, the rotary members 210 and 214, the support members 211 and 215, the rotary parts 202A and 202B, the support members 212 and 216, and the weight members 222 and 223 constitute the "control unit."

In the training guidance instrument 200B, the expandable/shrinkable member 230 constitutes the "control unit".

A training guidance method using the training guidance instruments 200, 200A, and 200B will be described.

Figure 18:
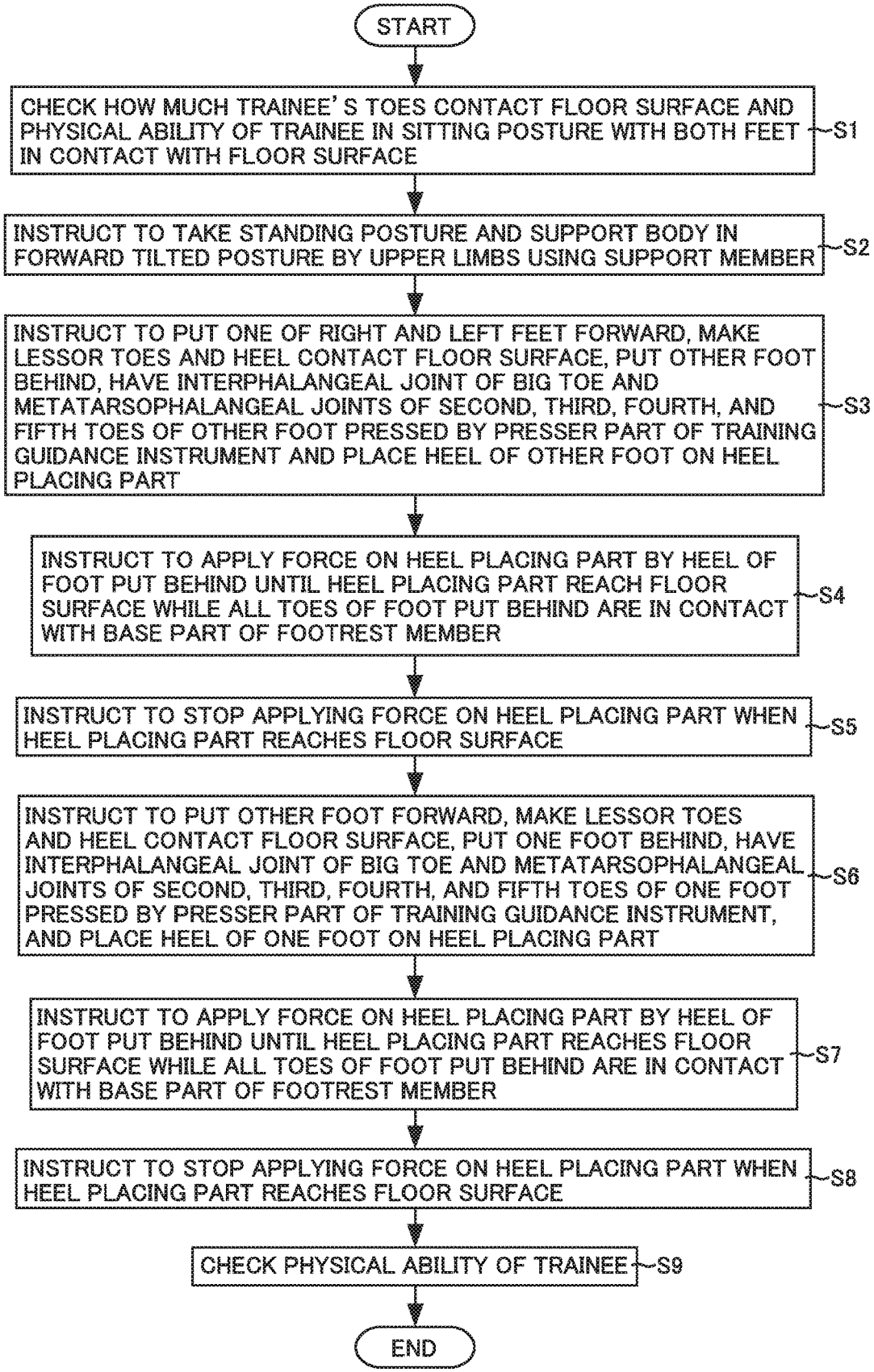
FIG. 18 is a flowchart for illustrating a training guidance method using the training guidance instrument according to the embodiment of the present invention.

FIG. 18 is a flowchart for illustrating the training guidance method using the training guidance instrument 200 according to the embodiment of the present invention. The training guidance method according to the embodiment of the present invention is carried out for example in a training facility.

Referring to FIG. 18, when the training guidance method according to the embodiment of the present invention is started, an instructor checks how much the toes of a trainee contact the floor surface while the trainee in a sitting posture has both feet contact the floor surface and checks the physical ability of the trainee (step S1).

For example, the instructor checks, as the degree of how much the toes contact the floor surface, whether any of the toes of the trainee has hallux valgus, whether any of the toes of the trainee is floating, whether the toes of trainee has a bunionette.

In addition, the instructor evaluates the physical ability by the following method.

(1) The instructor pushes the shoulders of the trainee in a standing posture to the right and left and checks whether the trainee can maintain the standing posture in order to check a balance between the left and right sides of the trainee.

(2) When the trainee is in a sitting posture, the instructor pushes the trainee in the sitting posture to the back and checks whether the trainee can maintain the sitting posture in order to check a balance between the front and back sides of the trainee.

(3) The instructor asks the trainee to make a loop with the index finger and the thumb of one of the hands and a loop with the index finger and the thumb of the other hand and to connect the loops like a chain. Then, the instructor asks the trainee to pull the loops to the right and left to make the loops apart while holding the index fingers and the thumbs with all the strength to prevent the loops from opening. At this time, the instructor checks the ability of the thumbs and the fingers of trainee's hands by checking how much strength the index fingers and the thumbs of the trainee exert.

The instructor checks the physical ability of the trainee by using at least one of (1) to (3).

After step S1, the instructor instructs the trainee to take a standing posture and support the body in a forward tilted posture by the upper limbs using the support member (step S2).

Then, the instructor instructs the trainee to put one of the right and left feet forward, place the toes and the heel in contact with the floor surface, put the other foot behind, have the second joint of the big toe and the third joints of the second toe, the third toe, the fourth toe, and the fifth toe of the other foot pressed by the presser part 2091 of the training guidance instrument 200, and place the heel of the other foot on the heel placing part 2092A (step S3).

Subsequently, the instructor instructs the trainee to apply force on the heel placing part 2092A by the heel of the foot put behind until the heel placing part 2092A reaches the floor while all the toes of the foot put behind are in contact with the base part 2092 of the footrest member 209 (step S4). In this way, the trainee moves the heel of the other foot toward the floor surface until the heel placing part 2092A reaches the floor surface while the second joint of the big toe and the third joints of the second toe, the third toe, the fourth toe, and the fifth toe of the other foot are pressed by the presser part 2091 of the training guidance instrument 200.

Thereafter, when the heel placing part 2092A reaches the floor surface, the instructor instructs the trainee to stop applying the force on the heel placing part 2092A (step S5). In this way, while the second joint of the big toe and the third joints of the second toe, the third toe, the fourth toe, and the fifth toe of the other foot are pressed by the presser part 2091 of the training guidance instrument 200, the trainee moves the heel of the other foot upward until one end of the support member 212 of the training guidance instrument 200 reaches the floor surface.

In this case, the instructor preferably instructs the trainee to move up and down the heel of the foot put behind, for example, five to ten times in the vertical direction. More specifically, the instructor repeats steps S4 and S5 five to ten times.

Then, the instructor instructs the trainee to put the other foot forward and place the toes and heel on the floor surface, put one foot backward, so that the second joint of the big toe and the third joints of the second toe, the third toe, the fourth toe, and the fifth toe of one foot are pressed by the presser part 2091 of the training guidance instrument 200 and the heel of one foot is placed on the heel placing part 2092A (step S6).

Subsequently, the instructor instructs the trainee to apply force on the heel placing part 2092A by the heel of the foot put behind until the heel placing part 2092A reaches the floor surface while all the toes of the foot put behind are in contact with the base part 2092 of the footrest member 213 (step S7). In this way, the trainee moves the heel of one foot toward the floor surface until the heel placing part 2092A reaches the floor surface while the second joint of the big toe and the third joints of the second toe, the third toe, the fourth toe, and the fifth toe of the foot are pressed by the presser part 2091 of the training guidance instrument 200.

Thereafter, when the heel placing part 2092A reaches the floor surface, the instructor instructs the trainee to stop applying the force on the heel placing part 2092A (step S8). In this way, the trainee moves the heel of one foot upward until one end of the support member 216 of the training guidance instrument 200 reaches the floor surface while the second joint of the big toe and the third joints of the second toe, the third toe, the fourth toe, and the fifth toe of the foot are pressed by the presser part 2091 of the training guidance instrument 200.

In this case, the instructor preferably instructs the trainee to move up and down the heel of the foot put behind, for example, five to ten times. More specifically, the instructor repeats steps S7 and S8 five to ten times.

Then, the instructor checks the physical ability of the trainee (step S9). For example, the instructor checks the physical ability of the trainee according to the same method as described in connection with step S1.

This ends the training guidance method using the training guidance instrument 200.

Note that the training guidance method using the training guidance instrument 200A or 200B is also executed according to the flowchart shown in FIG. 18.

Figure 19:
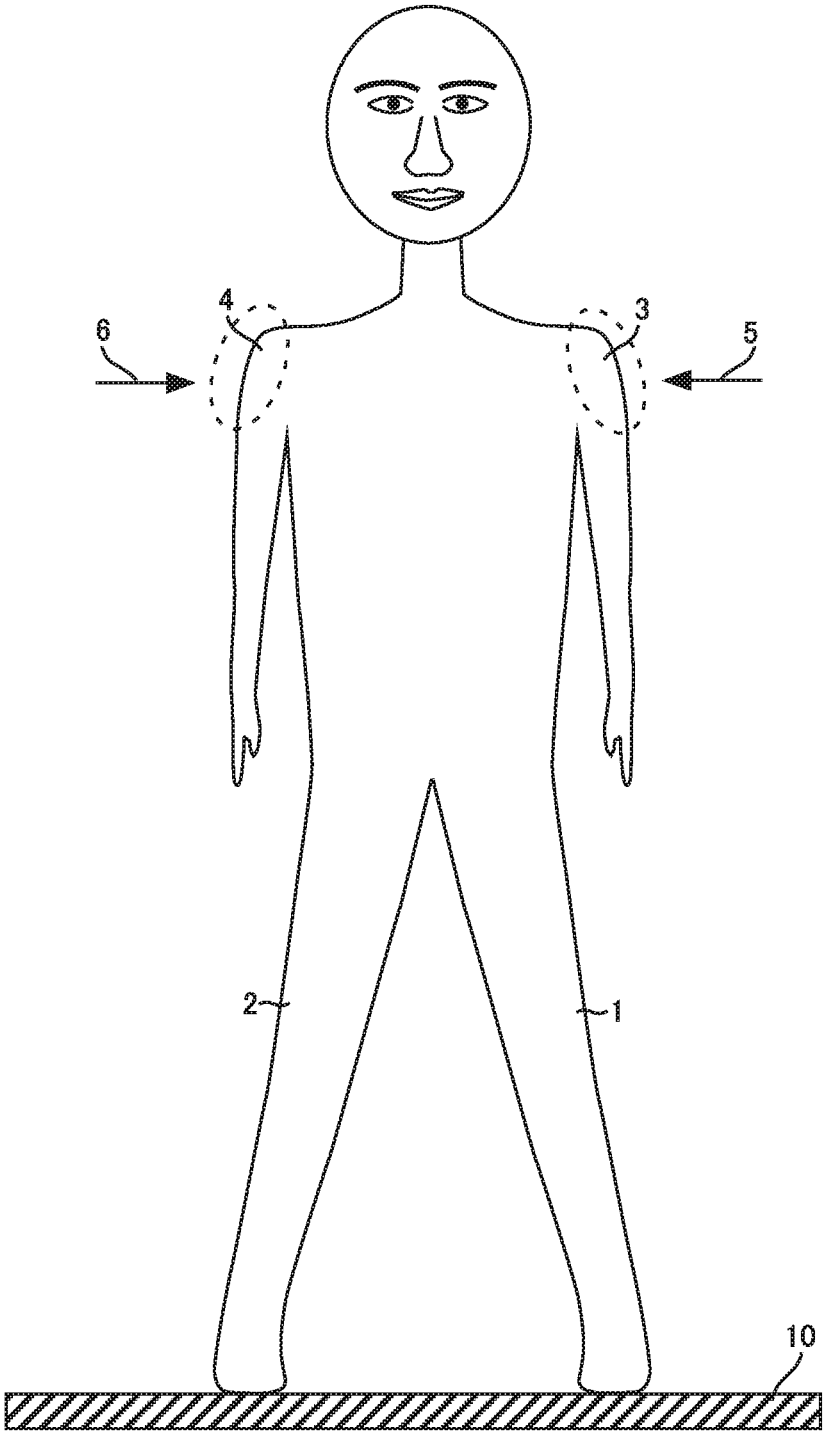
FIG. 19 is a schematic view for illustrating a method for checking a balance between the left and right sides of a trainee.

FIG. 19 is a schematic diagram for illustrating a method for checking a balance between the left and right sides of a trainee. In step S1 of the training guidance method, the instructor checks a balance between the left and right sides of a trainee by the following method in order to check the physical ability of the trainee.

Referring to FIG. 19, in step S1 of the training guidance method, the instructor instructs the trainee to stand on the floor surface 10 and arrange the distance between the feet 1 and 2 to be substantially equal to the shoulder width. Then, the instructor pushes the deltoid muscle 3 of the left shoulder of the trainee in the direction of the arrow 5 to check whether the trainee can maintain the standing posture. In this case, the instructor preferably instructs the trainee not to bend the knees of both feet 1 and 2. The instructor then pushes the deltoid muscle 4 of the right shoulder of the trainee in the direction of the arrow 6 and checks whether the trainee can maintain the standing posture. Again, the instructor preferably instructs the trainees not to bend the knees of both feet 1 and 2. The operation by the instructor of pushing the deltoid muscle 3 of the trainee in the direction of the arrow 5 and checking whether the trainee can maintain the standing posture, and the operation of pushing the deltoid muscle 4 of the trainee in the direction of the arrow 6 and checking whether the trainee can maintain the standing posture are carried out at least once in order to check a balance between the left and right sides of the trainee.

In step S9 of the training guidance method, the instructor also checks a balance between the left and right sides of the trainee using the method shown in FIG. 19 as a way of checking the physical ability of the trainee.

Figure 20:
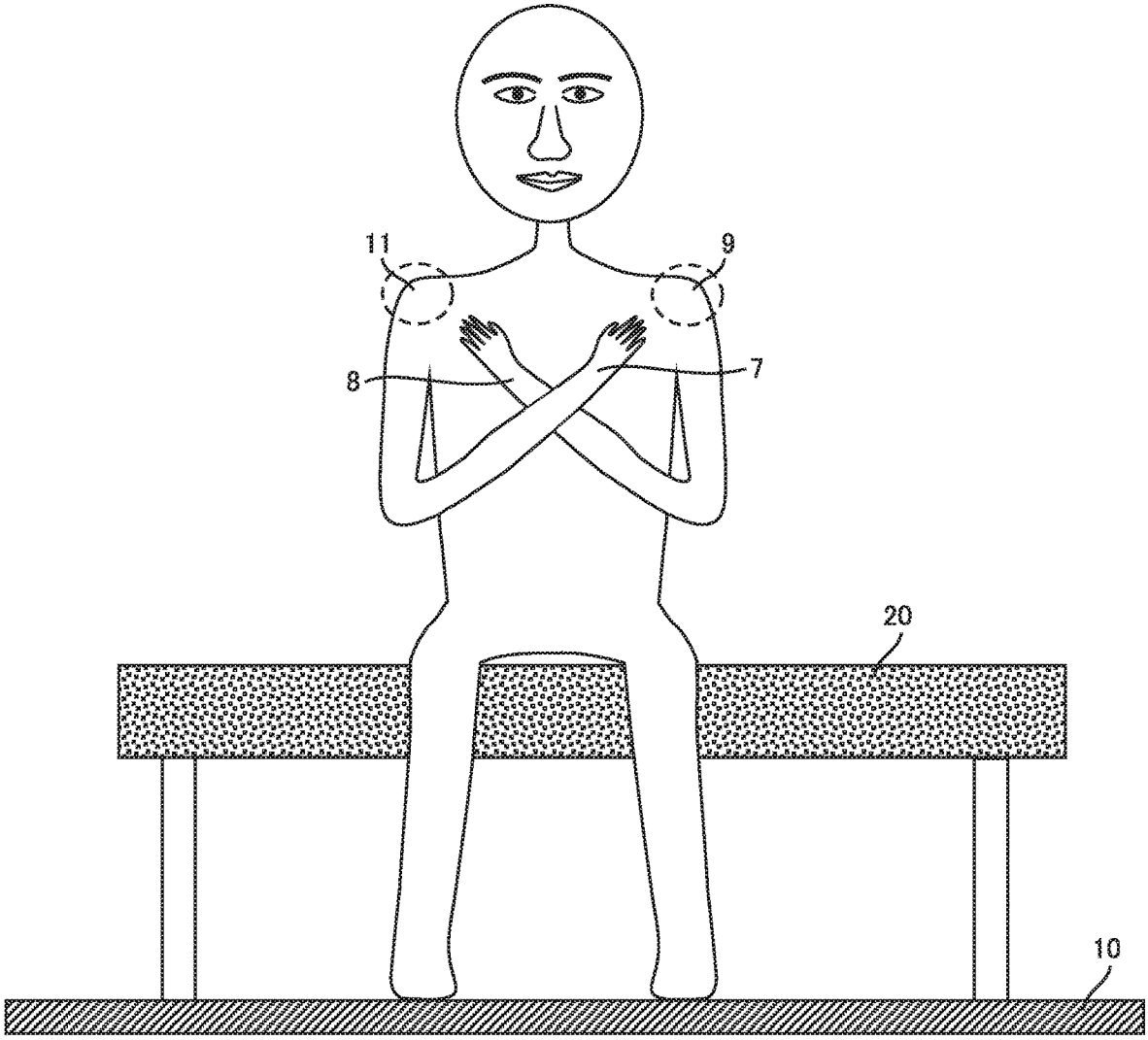
FIG. 20 is a schematic view for illustrating a method for checking a balance between the front and back sides of a trainee.

FIG. 20 is a schematic diagram for illustrating a method for checking a balance between the front and back sides of a trainee. In step S1 of the training guidance method, the instructor checks a balance between the front and back sides of the trainee by the following method as away of checking the physical ability of the trainee.

Referring to FIG. 20, in step S1 of the training guidance method, the instructor instructs the trainee to take a sitting posture on a seat 20 while the toes and heels of both feet are in contact with the floor surface 10 and cross the right arm 7 and the left arm 8 in front of the chest. Then, the instructor pushes the left shoulder 9 and the right shoulder 11 of the trainee to the back with both hands (on the sheet surface of FIG. 20, from the front side to the back side) and checks whether the trainee can maintain the sitting posture. The instructor carries out, at least once, the operation of pushing the left shoulder 9 and the right shoulder 11 of the trainee to the back (on the sheet surface of FIG. 20, from the front side to the back side) and checking whether the trainee can maintain the sitting posture to check a balance between the front and back sides of the trainee.

The trainee can be prevented from being subjected to an excessive load on the lumbar vertebra by checking a balance between the front and back sides of the trainee while the feet of the trainee are in contact with the floor surface 10.

In checking a balance between the front and back sides of the trainee, both feet of the trainee do not have to be in contact with the floor surface 10.

Also in step S9 of the training guidance method, the instructor checks a balance between the front and back sides of the trainee by using the method shown in FIG. 20 as a way of checking the physical ability of the trainee.

FIG. 21 is a diagram for illustrating a method for measuring the force exerted by the trainee to make the heel placing part 2092A contact the floor surface.

Referring to FIG. 21(*a*), while one end of each of the support members 209 and 216 is in contact with the floor surface, the gate valve 2195 is moved in the z-axis direction by the pressure adjusting unit 2192, and the volume of the space 2191A is set to V1. At the time, the pressure $P_A$ in the space 2191A is set to $P_{0A_k}$ (k is an integer which satisfies $1 \leq k \leq n$).

Referring to FIG. 21(*b*), while one end of each of the support members 209 and 216 is in contact with the floor surface, the gate valve 2195 is moved in the z-axis direction by the pressure adjusting unit 2192, and the volume of the space 2191A is set to a volume V2 (<V1) which is smaller than the volume V1. At the time, the pressure $P_A$ in the space 2191A is set to a pressure $P_{0A_k+1}$ ($>P_{0A_k}$) higher than the pressure $P_{0A_k}$.

Then, it is determined whether the trainee can apply force on the heel placing part 2092A by the heel and make the heel placing part 2092A reach the floor surface while the pressure $P_A$ in the space 2191A is kept at the pressure $P_{0A_k}$, and the second joint of the big toe and the third joints of the second toe, the third toe, the fourth toe, and the fifth toe of the trainee are pressed by the presser part 2091.

If the heel placing part 2092A can be made to reach the floor surface, it is determined whether the trainee can apply force on the heel placing part 2092A by the heel and make the heel placing part 2092A reach the floor surface while the pressure $P_A$ in the space 2191A is set to the pressure $P_{0A_k+1}$ and the second joint of the big toe and the third joints of the second toe, the third toe, the fourth toe, and the fifth toe of the trainee are pressed by the presser part 2091.

In this way, while changing the pressure $P_A$ in the space 2191A, the force exerted by the trainee to make the heel placing part 2092A reach the floor surface is measured. In this case, the pressure $P_A$ in the space 2191A when the heel placing part 2092A can be made to reach the floor surface is recorded as force allowing the heel placing part 2092A to reach the floor surface. The force exerted by the trainee to make the heel placing part 2092A reach the floor surface is measured for both feet.

In steps S1 and S9 of the training guidance method, force exerted by the trainee to make the heel placing part 2092A reach the floor surface is measured for both feet according to the above-described method, and the measured force represents the physical ability of the trainee.

Note that the force exerted by the trainee to make the heel placing part 2092A reach the floor surface can be measured in the same manner by using one of the training guidance instruments 200A and 200B.

When the training guidance instrument 200A is used, while the weight of a weight placed in the box member 2221 may be changed, the weight of the weight when the trainee can make the heel placing part 2092A reach the floor surface is detected, so that the force exerted by the trainee to make the heel placing part 2092A reach the floor surface can be measured.

Furthermore, when the training guidance instrument 200B is used, the air pressure in the expandable/shrinkable member 230 is detected when the trainee can make the heel placing part 2092A reach the floor surface while the air pressure in the expandable/shrinkable member 230 is changed, so that the force exerted by the trainee to make the heel placing part 2092A reach the floor surface can be measured.

The instructor carries out at least one of checking of a balance between the left and right sides as described in conjunction with FIG. 19 and a balance between the front and back sides described in conjunction with FIG. 20 and measuring the force when the heel placing part 2092A can be made to contact the floor described in conjunction with FIG. 21, as a way of checking the physical ability in steps S1 and S9 of the training guidance method.

The instructor may check the physical ability of the trainee using at least one of the above (1) to (3) in steps S1 and S9 of the training guidance method.

Figure 22:
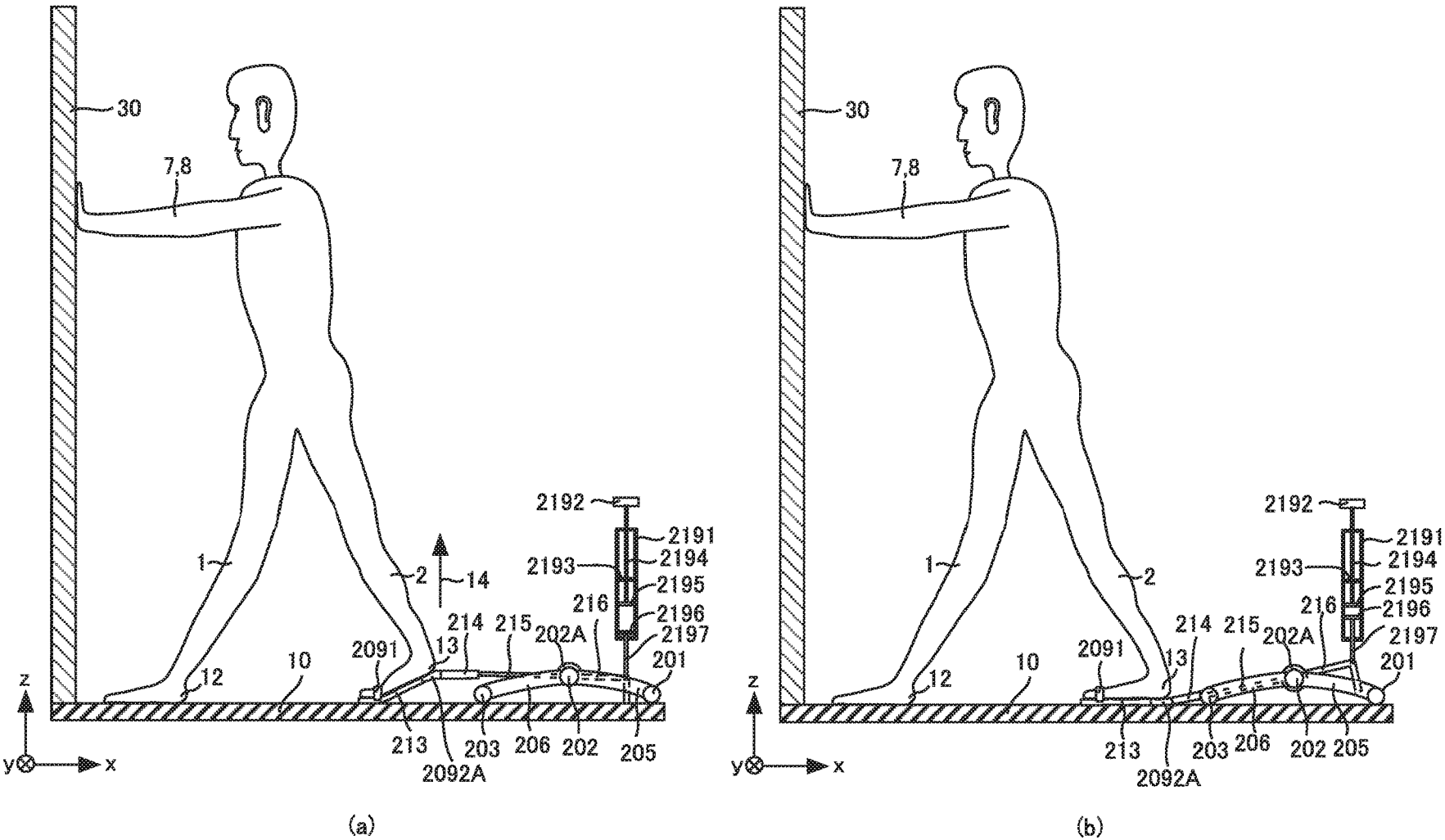
FIG. 22 is a schematic view for illustrating operation in steps S2 to S8 in the training guidance method illustrated in FIG. 18.

FIG. 22 is a schematic diagram for illustrating the operation in steps S2 to S8 of the training guidance method shown in FIG. 18.

Referring to FIG. 22, in step S2 of the training guidance method, the instructor instructs the trainee to take a standing posture and use the wall 30 (a support member) to support the body with the arms (the right arm 7 and the left arm 8) in a forward tilted posture, then in step S3 of the training guidance method, the instructor instructs the trainee for example to put the left foot 1 forward to have the toes and heel 12 contact the floor surface 10, put the right foot 2 behind to have the second joint of the big toe and the third joints of the second toe, the third toe, the fourth toe, and the fifth toe of the right foot 2 pressed by the presser part 2091, and place the heel 13 of the right foot 2 on the heel placing part 2132A (=heel placing part 2092A) of the footrest member 213 (see FIG. 22(*a*)).

In this case, one end of the support member 216 of the training guidance instrument 200 is in contact with the floor surface 10, and the heel placing part 2092A moves upward above the floor surface 10 (in the direction of the arrow 14 along the z-axis) by the force Pw1 applied upward from the ground. In addition, the instructor instructs the trainee to put the right arm 7 and the left arm 8 horizontally forward and bring the palms of the right arm 7 and the left arm 8 into contact with the wall 30 to maintain the forward tilted posture. In addition, the instructor instructs the trainee not to bend the knees of the left foot 1 and the right foot 2 when the trainee puts the left foot 1 forward and the right foot 2 behind.

After the trainee takes the posture shown in FIG. 22(*a*), in step S4 of the training guidance method, the instructor instructs the trainee to apply force Pw2 on the heel placing part 2092A by the heel 13 of the foot put behind (the right foot 2) until the heel placing part 2092A reaches the floor surface 10 while all the toes of the foot put behind (the right foot 2) are in contact with the base part 2092 of the footrest member 213 (see FIG. 22(*b*)).

In this way, the trainee applies the force Pw2 on the heel placing part 2092A by the heel 13 of the right foot 2 until the heel placing part 2092A reaches the floor surface 10, and moves the heel 13 toward the floor surface 10 (downward) while the second joint of the big toe, the third joint of the second toe, the third joint of the third toe, the third joint of the fourth toe, and the third joint of the fifth toe of the right foot 2 are pressed by the presser part 2091. Then, the rotary member 214, the support member 215, the rotary part 202B, and the support member 216 rotate counterclockwise within an x-z plane, and the gate valve 2196 is pushed upward (in the z-axis direction). As a result, the pressure $P_A$ in the space 2191A between the gate valves 2195 and 2196 becomes higher than the pressure in FIG. 22(*a*), the pressure $P_B$ in the space 2191B between the gate valve 2196 and the main body 2191 becomes lower than the pressure in FIG. 22(*a*), and the pressure $P_A$ becomes higher than the pressure $P_B$.

In the movement for shifting from the state shown in FIG. 22(*a*) to the state shown in FIG. 22(*b*), the instructor preferably instructs the trainee not to bend the knee of the right foot 2.

As shown in FIG. 22(*b*), when the heel placing part 2092A reaches the floor surface 10, the instructor instructs the trainee to stop applying the force Pw2 on the heel placing part 2092A in step S5 of the training guidance method.

Then, since the pressure $P_A$ in the space 2191A between the gate valves 2195 and 2196 is higher than the pressure $P_B$ in the space 2191B between the gate valve 2196 and the main body 2191, the gate valve 2196 is pushed toward the floor surface 10 (downward) by the pressure $P_A$ until one end of the support member 216 reaches the floor surface 10.

As a result, the rotary member 214, the support member 215, the rotary part 202B, and the support member 216 rotate clockwise in an x-z plane, the heel placing part 2092A of the footrest member 213 moves upward from the floor surface 10, and then moves the heel 13 of the right foot 2 of the trainee in the upward direction. Then, the state shown in FIG. 22(*a*) is attained.

In this case, the instructor preferably instructs the trainee to stand on a tiptoe only on the right foot 2 without bending the knee of the right foot 2. More preferably, the instructor instructs the trainee to raise the heel 13 of the right foot 2 immediately above. With this instruction, the center of gravity is brought on all of the five toes (the big toe, the second toe, the third toe, the fourth toe, and the fifth toe) of the right foot 2 when the heel 13 is raised upward, and all the five toes of the right foot 2 (the big toe, the second toe, the third toe, the fourth toe, and the fifth toe) can be made to reach to the base part 2092 of the footrest member 213.

In addition, the instructor confirms that all the toes of the right foot 2 are in contact with the base part 2092 of the footrest member 213. Then, if at least one toe of the right foot 2 is not in contact with the base part 2092 of the footrest member 213, the instructor instructs the trainee to raise the heel 13 upward while being conscious of that all the toes of the right foot 2 are in contact with the base part 2092 of the footrest member 213. With this instruction, the center of gravity is more easily brought on all the five toes (the big toe, the second toe, the third toe, the fourth toe and the fifth toe) of the right foot 2 when the heel 13 is raised upward.

The instructor preferably repeats steps S4 and S5 of the training guidance method five to ten times (a predetermined number of times). More specifically, the instructor instructs the trainee to repeat, five to ten times (a prescribed number of times), the exercise for shifting from the state shown in FIG. 22(*a*) to the state shown in FIG. 22(*b*) and the exercise for shifting from the state shown in FIG. 22(*b*) to the state shown in FIG. 22(*a*).

Subsequently, in step S6 of the training guidance method, the instructor instructs the trainee to put the right foot 2 forward to have the toes and the heel 13 contact the floor surface 10, put the left foot 1 behind, and place the second joint of the big toe and the third joints of the second toe, the third toe, the fourth toe, and the fifth toe of the left foot 1 pressed by the presser part 2091, and place the heel 12 of the left foot 1 on the heel placing part 2092A of the footrest member 209 (see FIG. 22(*a*)).

In this case, one end of the support member 212 of the training guidance instrument 200 is in contact with the floor surface 10, and the heel placing part 2092A is moved upward and apart (in the z-axis direction) from the floor surface 10 by the force Pw1 applied upward from the ground. The instructor also instructs the trainee to put the right arm 7 and the left arm 8 horizontally forward and bring the palms of the right arm 7 and the left arm 8 into contact with the wall 30 to maintain the forward tilted posture. The instructor also instructs the trainee not to bend the knees of the left foot 1 and the right foot 2 when the trainee puts the right foot 2 forward and the left foot 1 behind.

After the trainee takes the posture shown in FIG. 22(*a*), in step S7 of the training guidance method, the instructor instructs the trainee to apply the force Pw2 by the heel 12 of the foot put behind (the left foot 1) on the heel placing part 2092A until the heel placing part 2092A reaches the floor surface 10 while all the toes of the foot put behind (the left foot 1) are in contact with the base part 2092 of the footrest member 209 (see FIG. 22(*b*)).

In this way, the trainee applies the force Pw2 on the heel placing part 2092A until the heel placing part 2092A reaches the floor surface 10 by the heel 12 of the left foot 1 and moves the heel 12 toward the floor surface 10 (downward) while the second joint of the big toe and the third joint of the second toe, the third joint of the third toe, the third joint of the fourth toe, and the third joint of the fifth toe of the left foot 1 are pressed by the presser part 2091. Then, the rotary member 210, the support member 211, the rotary part 202A, and the support member 212 rotate counterclockwise in an x-z plane, and the gate valve 2196 is pushed upward (along the z-axis). As a result, the pressure $P_A$ in the space 2191A between the gate valves 2195 and 2196 becomes higher than the pressure in FIG. 22(*a*), the pressure $P_B$ in the space 2191B between the gate valve 2196 and the main body 2191 becomes lower than the pressure in FIG. 22(*a*), and the pressure $P_A$ becomes higher than the pressure $P_B$.

In the operation of shifting from the state shown in FIG. 22(*a*) to the state shown in FIG. 22(*b*), the instructor preferably instructs the trainee not to bend the knee of the left foot 1.

As shown in FIG. 22(*b*), when the heel placing part 2092A reaches the floor surface 10, the instructor instructs the trainee to stop applying the force Pw2 on the heel placing part 2092A in step S8 of the training guidance method.

Then, since the pressure $P_A$ in the space 2191A between the gate valves 2195 and 2196 is higher than the pressure $P_B$ in the space 2191B between the gate valve 2196 and the main body 2191, the gate valve 2196 is pushed toward the floor surface 10 (downward) by the pressure $P_A$ until one end of the support member 212 reaches the floor surface 10.

As a result, the rotary t member 210, the support member 211, the rotary part 202A, and the support member 212 rotate clockwise in an x-z plane, and the heel placing part 2092A of the footrest member 209 moves upward from the floor surface 10 and moves the heel 12 of the left foot 1 of the trainee upward. Then, the state shown in FIG. 22(*a*) is attained.

In this case, the instructor preferably instructs the trainee to stand on a tiptoe only by the left foot 1 without bending the knee of the left foot 1. The instructor more preferably instructs the trainee to raise the heel 12 of the left foot 1 immediately above. With this instruction, the center of gravity is brought on all of the five toes (the big toe, the second toe, the third toe, the fourth toe, and the fifth toe) of the left foot 1 when the heel 12 is moved upward, and the five toes of the left foot 1 (the big toe, the second toe, the third toe, the fourth toe, and the fifth toe) can be in contact with the base part 2092 of the footrest member 209.

In addition, the instructor confirms that all the toes of the left foot 1 are in contact with the base part 2092 of the footrest member 209. Then, if at least one toe of the left foot 1 is not in contact with the base part 2092 of the footrest member 209, the instructor instructs the trainee to raise the heel 12 upward while being conscious of that all the toes of the left foot 1 are in contact with the base part 2092 of the footrest member 209. With this instruction, the center of gravity can more easily be brought on all of the five toes (the big toe, the second toe, the third toe, the fourth toe, and the fifth toe) of the left foot 1 when the heel 12 is raised upward.

The instructor preferably repeats, five to ten times (a predetermined number of times), steps S7 and S8 in the training guidance method. More specifically, the instructor instructs the trainee to repeat, five to ten times (a predetermined number of times), the operation for shifting from the state shown in FIG. 22(*a*) to the state shown in FIG. 22(*b*) and the operation for shifting from the state shown in FIG. 22(*b*) to the state shown in FIG. 22(*a*).

Using training guidance instrument 200, the instructor instructs the trainee to repeat the operation of moving the heel 12 or 13 up and down in the vertical direction while keeping all the toes of the left foot 1 or the right foot 2 in contact with the base parts 2092 of the footrest member 209 or 213, so that the trainee learns how to walk, run, and play various sports while keeping the toes of the left foot 1 and the right foot 2 in contact with the ground by repeating the up-down movement of the heel 12 or 13 while keeping the toes of the left foot 1 or the right foot 2 in contact with the base parts 2092 of the footrest member 209 or 213. As a result, the trunk balance of the trainee can be improved, so that the physical ability of the trainee can be improved.

When the training instructing instrument 200A or the training instructing instrument 200B is used, the operation in steps S2 to S8 in the training guidance method is the same as that described in conjunction with FIG. 22.

Figure 23:
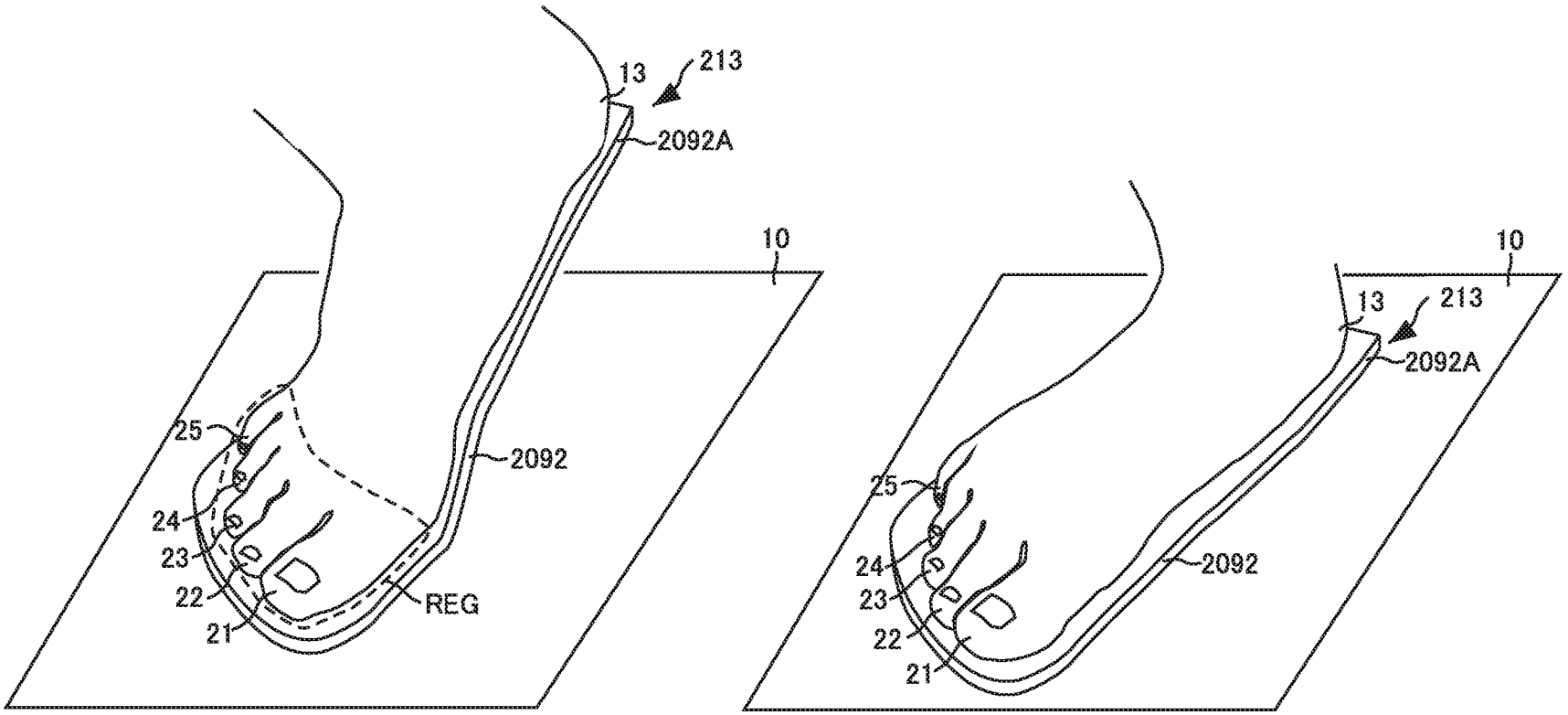
FIG. 23 is a partly enlarged view of a right foot 2 shown in FIGS. 22(*a*) and (*b*).

FIG. 23 is a partly enlarged view of the right foot 2 shown in FIGS. 22(*a*) and 22(*b*). In FIG. 23, the presser part 2091 of the footrest member 213 is not shown.

Referring to FIG. 23, in the state shown in FIG. 22(*a*), the five toes (the big toe 21, the second toe 22, the third toe 23, the fourth toe 24, and the fifth toe 25) of the right foot 2 are in contact with the floor surface 10 through the base part 2092 of the footrest member 213, and the heel 13 of the right foot 2 and the heel placing part 2092A of the footrest member 213 are above and away from the floor surface 10 (see FIG. 23(*a*)).

Then, when the heel 13 of the right foot 2 is raised by the training guidance instrument 200, the instructor instructs the trainee to have all the five toes (the big toe 21, the second toe 22, the third toe 23, the fourth toe 24, and the fifth toe 25) reach the floor surface 10 through the base part 2092 of the footrest member 213. The instructor preferably instructs the trainee to have a region REG including the five toes (the big toe 21, the second toe 22, the third toe 23, the fourth toe 24, and the fifth toe 25) of the right foot 2 reach the floor surface 10 through the base part 2092 of the footrest member 213 (see FIG. 23(*a*)). In this case, since the fifth toe 25 easily moves up, the instructor particularly makes sure that the fifth toe 25 is in contact with the floor surface 10 through the base part 2092 of the footrest member 213.

When the heel 12 of the left foot 1 is raised upward using the training guidance instrument 200, as shown in FIG. 23(*a*), the instructor also instructs the trainee to keep the five toes of the left foot 1 (the big toe, the second toe, the third toe, the fourth toe, and the fifth toe) in contact with the floor surface 10 through the base part 2092 of the footrest member 209.

This better ensures that the region REG shown in FIG. 23(*a*) contacts the floor surface 10 through the base part 2092. As a result, the trainee can effectively learn the feelings of walking, running, and playing various sports by keeping all the toes of the feet in contact with the ground.

In FIG. 22(*b*), the five toes (the big toe 21, the second toe 22, the third toe 23, the fourth toe 24, and the fifth toe 25) and the heel 13 of the right foot 2 are in contact with the floor surface 10 through the base part 2092 of the footrest member 213 (see FIG. 23(*b*)).

When the instructor instructed a trainee according to the training guidance method using the training guidance instruments 200, 200A, and 200B, and the trainee carried out the up-down movement of the heel 12 of the left foot 1 and the heel 13 of the right foot 2 in the vertical direction a prescribed number of times as shown in FIGS. 22 and 23, the trainee, who could not keep a balance between the left and right sides and the front and back sides of the body and could only make the heel placing part 2092A contact with the floor surface 10 with a weaker force in the check of physical ability in step S1 in the training guidance method, but was able to maintain a standing posture even when pushed to the left and right and a sitting posture even when pushed to the front and back in the check of physical ability in step S9 in the training guidance method, in other words, the trainee was able to exert stronger force to make the heel placing part 2092A contact the floor surface 10.

More specifically, the trainee was able to improve the physical ability by performing steps S2 to S8 in the training guidance method.

The inventor of the above-mentioned training guidance method has acquired knowledge that a lot of people do not have some of the five toes of the left foot 1 (the big toe, the second toe, the third toe, the fourth toe, and the fifth toe) and/or the five toes of the right foot 2 (the big toe 21, the second toe 22, the third toe 23, the fourth toe 24, and the fifth toe 25) in contact with the ground and has created the above training guidance instruments 200, 200A, and 200B and the training guidance method using the training guidance instruments 200, 200A, and 200B thereby.

The feet are crucial when a person walks, runs, and plays various sports, and the feet are unstable unless the five toes of both feet (the big toe, the second toe, the third toe, the fourth toe, and the fifth toe) are firmly in contact with the ground.

When guided by the training guidance method using the above-mentioned training guidance instruments 200, 200A, and 200B, however, the trainee can carry out the exercise of moving the heels up and down while the second joint of the big toe and the third joints of the second toe, the third toe, the fourth toe, and the fifth toe are pressed by the presser part 2091 and the five toes of each of the feet (the big toe, the second toe, the third toe, the fourth toe, and the fifth toe) are securely in contact with the ground, so that the trunk balance may be improved and the physical ability of the trainee may be improved.

As described above, the training guidance instruments 200, 200A, and 200B and the training guidance method using the training guidance instruments 200, 200A, and 200B described above were created on the basis of the above-described new findings and are entirely different from known foot health orthoses and training methods. More specifically, the known foot health orthoses and training methods are adapted to train specific muscles among many muscles of the body and not adapted to train the trunk (torso) balance.

Furthermore, the known foot health orthoses and training methods do not involve an idea concerning training performed for the purpose of having all the five toes of both feet (the big toe, the second toe, the third toe, the fourth toe, and the fifth toe) trained to reach the ground while the second joint of the big toe of the foot, the third joint of the second toe, the third joint of the third toe, the third joint of the fourth toe, and the third joint of the fifth toe are pressed. Therefore, the training guidance instruments 200, 200A, and 200B and the training guidance method using the training guidance instruments 200, 200A, 200B involve a totally different idea from conventional foot health orthoses and training methods, and highly unique training guidance instruments and training guidance method are provided.

The training guidance instruments 200, 200A, and 200B and the training guidance method described above are not for use in medical practice such as medical treatment, but are used by the trainee to execute training so that the trainee can improve the trunk balance.

This is also evident for example from a result of instructing a golf player according to the training guidance method using the above-mentioned training guidance instruments 200, 200A, and 200B that the flight distance of balls struck with a driver increased by 20 to 30 yards.

In addition, the training guidance method using the above-described training guidance instruments 200, 200A, and 200B is not limited to training for golf players and may be used by players of various sports such as baseball, tennis, athletics, and martial arts (judo, karate, kendo, etc.) for training to improve the trunk balance and the physical ability.

In the training guidance method shown in FIG. 18, sequential execution of steps S3 to S5 and steps S6 to S8 may be alternately repeated. In this case, single or multiple sequential execution of steps S3 to S5 and single or multiple sequential execution of steps S6 to S8 may be alternately repeated.

The time required for training is shortened by the training guidance method using the above-described training guidance instruments 200, 200A, and 200B. More specifically, it takes only several minutes (which could be one minute depending on the trainee) for the trainee to work out by the guidance of steps S2 to S8 described above. In this way, even for the short training time, the trunk balance of the trainee (for example a balance between the left and right sides and a balance between the front and the back) is effectively improved, or force applied on the heel placing part 2092A by the trainee to make the heel placing part 2092A contact the ground becomes stronger, and the physical ability of the trainee can be improved.

In addition, according to the training guidance method using the training guidance instruments 200, 200A, and 200B, the trainee can be trained by simple workout. More specifically, by the guidance of the above-described steps S2 to S8, the trainee simply presses the second joint of the big toe, the third joint of the second toe, the third joint of the third toe, the third joint of the fourth toe, and the third joint of the fifth toe of the foot by the presser part 2091 and moves the heel up and down by keeping all the toes of the feet in contact with the ground. In this way, even the training by the simple workout allows the trunk balance of the trainee (for example a balance between the left and the right sides and a balance between the front and back sides) to be effectively improved, and force exerted by the trainee to make the heel placing part 2092A contact the ground increases, so that the physical ability of the trainee can be improved.

Figure 24:
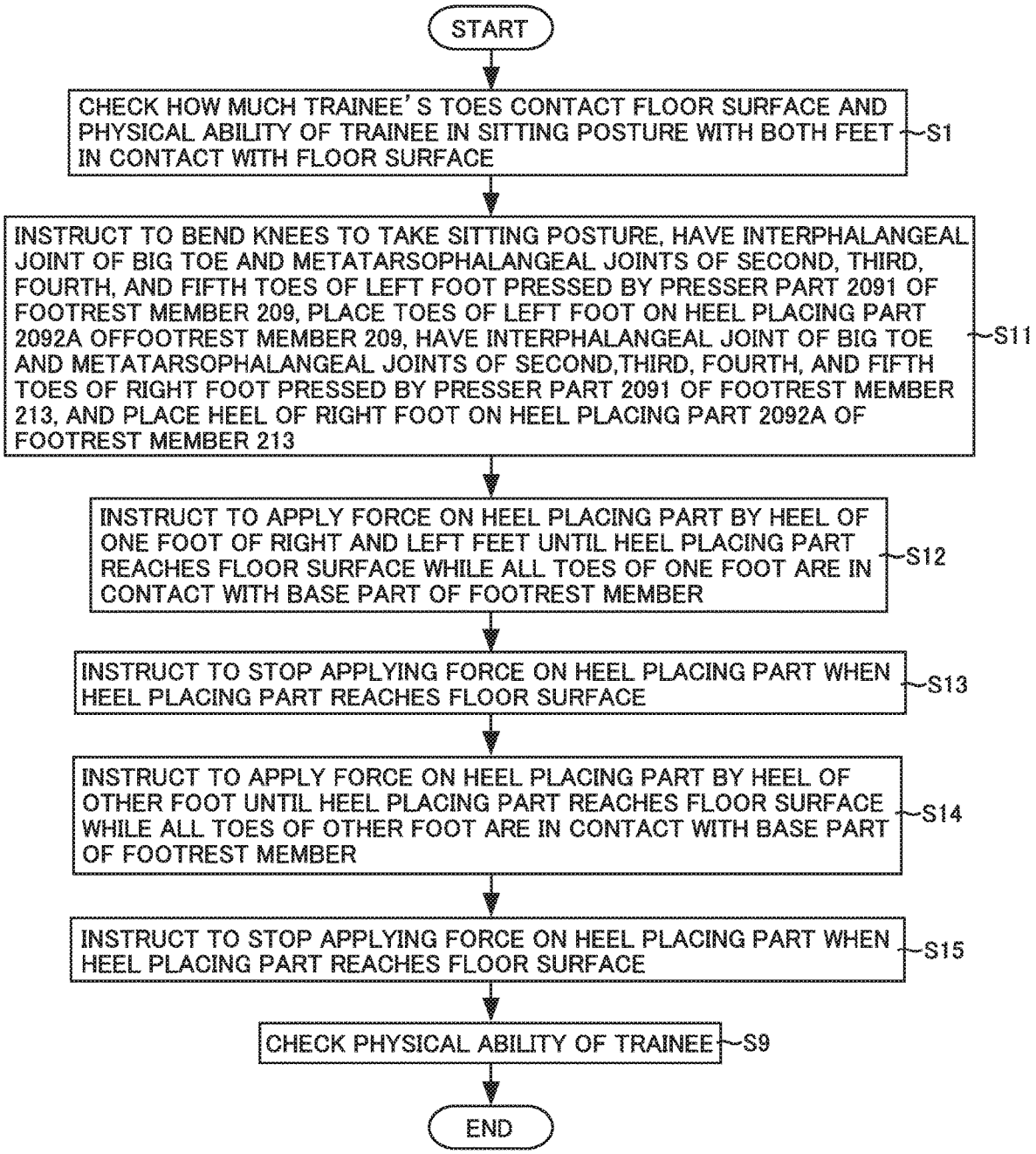
FIG. 24 is a flowchart for illustrating another training guidance method using the training guidance instrument according to the embodiment of the present invention.

FIG. 24 is a flowchart for illustrating another training guidance method using the training guidance instrument according to the embodiment of the present invention.

In the flowchart shown in FIG. 24, steps S2 to S8 in the flowchart shown in FIG. 18 are replaced by steps S11 to S15, and the other steps are the same as those in the flowchart shown in FIG. 18.

Referring to FIG. 24, when the training guidance method starts, an instructor executes step S1 described above.

Then, the instructor instructs the trainee to bend the knees to take a sitting posture, press the second joint of the big toe and the third joints of the second toe, the third toe, the fourth toe and the fifth toe of the left foot by the presser part 2091 of the footrest member 209, place the left heel on the heel placing part 2092A of the footrest member 209, press the second joint of the big toe and the third joints of the second toe, the third toe, the fourth toe, and the fifth toe of the right foot by the presser part 2131 (=the presser part 2091) of the footrest member 213, and place the right heel on the heel placing part 2132A (the heel placing part 2092A) of the footrest member 213 (step S11).

Thereafter, the instructor instructs the trainee to make all the toes of one of the right foot and the left foot contact the base part 2092 of the footrest member and apply the force Pw2 on the heel placing part 2092A by one heel until the heel placing part 2092A reaches the floor surface 10 (step S12).

When the heel placing part 2092A reaches the floor surface 10, the instructor instructs the trainee to stop applying the force Pw2 on the heel placing part 2092A (step S13).

Subsequently, the instructor instructs the trainee to make all the toes of the other foot contact the base part 2092 of the footrest member and apply the force Pw2 by the other heel on the heel placing part 2092A until the heel placing part 2092A reaches the floor surface 10 (step S14).

Then, when the heel placing part 2092A reaches the floor surface 10, the instructor instructs the trainee to stop applying the force Pw2 on the heel placing part 2092A (step S15).

Thereafter, the instructor performs step S9 described above. As a result, the training guidance method shown in FIG. 24 ends.

When the training guidance instrument 200A or the training guidance instrument 200B is used, the training guidance method is executed according to the flowchart shown in FIG. 24.

In the training guidance method shown in FIG. 24, the instructor preferably repeatedly executes steps S12 and S13 five to ten times (a prescribed number of times) and repeatedly executes steps S14 and S15 five to ten times (a prescribed number of times).

In the training guidance method shown in FIG. 24, the instructor may repeatedly sequentially execute steps S12 and S13 once or more and may repeatedly sequentially execute steps S14 and S15 once or more.

In the training guidance method shown in FIG. 24, the instructor may simultaneously carry out steps S12 and S14 and may simultaneously carry out steps S13 and S15. More specifically, using the training instructing instrument 200, the instructor may instruct the trainee to apply the force Pw2 on the heel placing parts 2092A of the footrest members 209 and 213 by the heels of the feet until the heel placing parts 2092A of the footrest members 209 and 213 reaches the floor surface 10 while the second joint of the big toe and the third joints of the second toe, the third toe, the fourth toe, and the fifth toe of each of the feet are by the presser part 2091 and all the toes of the feet are in contact with the floor surface 10 through the base parts 2092 of the footrest members 209 and 213, and once the heel placing parts 2092A of the footrest members 209 and 213 reach the floor surface 10, the trainee may be instructed to simultaneously stop applying the force Pw2 on the heel placing parts 2092A of the footrest members 209 and 213. Then, the instructor may simultaneously execute steps S12 and S14 five to ten times (a prescribed number of times) and simultaneously execute step S13 and step S15 five to ten times (a prescribed number of times).

Figure 25:
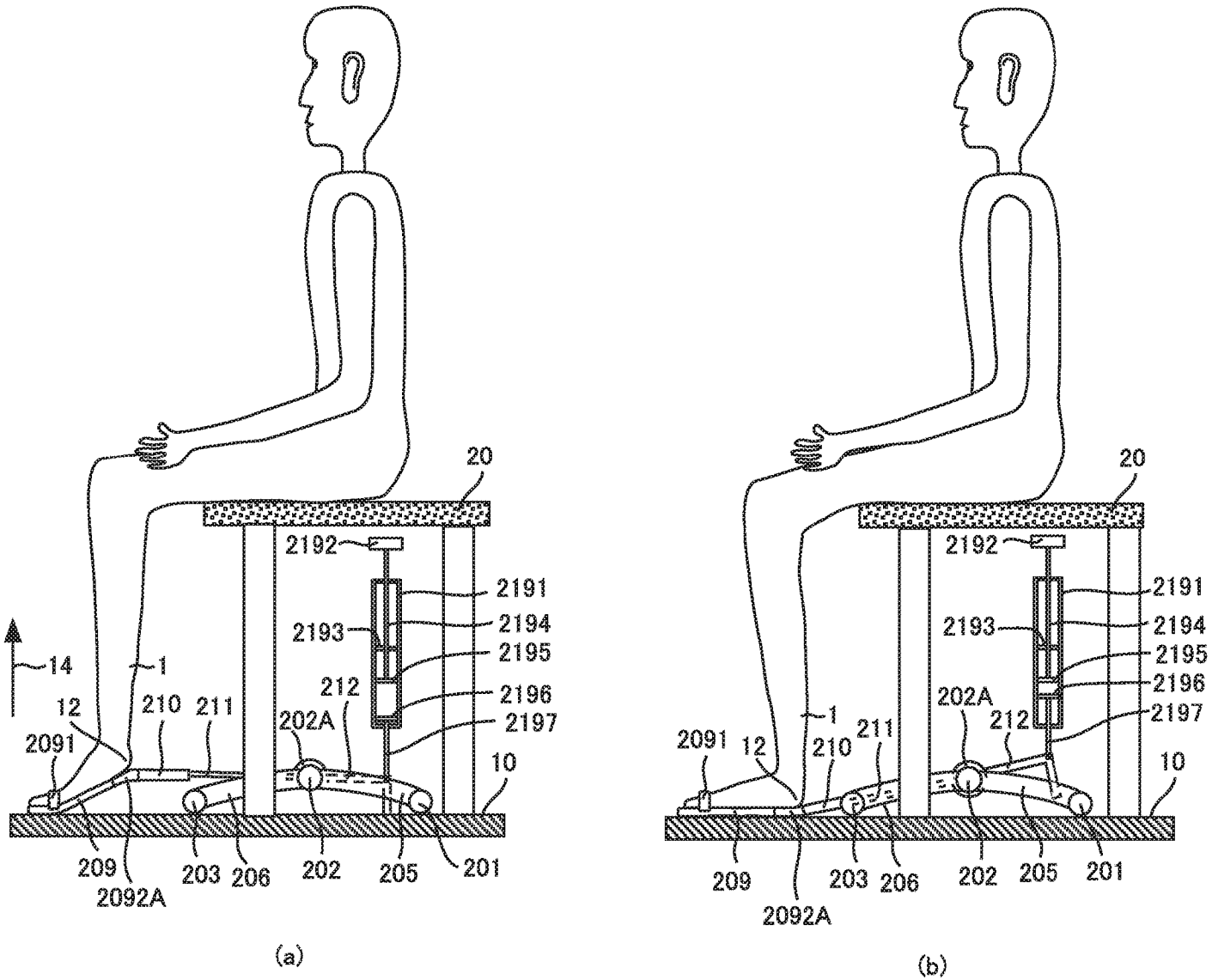
FIG. 25 is a schematic view for illustrating operation in steps S11 to S15 in the training guidance method shown in FIG. 24.

FIG. 25 is a schematic diagram for illustrating the operation in steps S11 to S15 of the training guidance method shown in FIG. 24. In FIG. 24, the right foot 2 of the trainee and the footrest member 213, the rotary member 214, the support members 215 and 216, the rotary part 202B, and the telescopic member 220 of the training guidance instrument 200 are not shown.

Referring to FIG. 25, in step S11 of the training guidance method shown in FIG. 24, the trainee is instructed to bend the knees to take a sitting posture on the seat 20, have the second joint of the big toe and the third joints of the second toe, the third toe, the fourth toe, and the fifth toe of the left foot pressed by the presser part 2091 of the footrest member 209, place the heel 12 of the left foot on the heel placing part 2092A of the footrest member 209, have the second joint of the big toe and the third joints of the second toe, the third toe, the fourth toe, and the fifth toe of the right foot pressed by the presser part 2091 of the footrest member 213, and place the heel of the right foot on the heel placing part 2092A of the footrest member 213 (see FIG. 25(*a*)). In this case, the heel placing part 2092A is above and apart from the floor surface 10 (in the direction of the arrow 14 along the z-axis).

Thereafter, in step S12 of the training guidance method shown in FIG. 24, the instructor instructs the trainee to apply the force Pw2 by the heel 12 of one foot (the left foot 1) on the heel placing part 2092A until the heel placing part 2092A reaches the floor surface 10 while all the toes of the left foot 1 are in contact with the base part 2092 of the footrest member 209 (see FIG. 25(*b*)).

In this way, the trainee applies the force Pw2 on the heel placing part 2092A by the heel 12 of the left foot 1 until the heel placing part 2092A reaches the floor surface 10 and moves the heel 12 toward the floor surface 10 (downward) while the second joint of the big toe, the third joint of the second toe, the third joint of the third toe, the third joint of the fourth toe, and the third joint of the fifth toe of the left foot 1 are pressed by the presser part 2091. Then, the rotary member 210, the support member 211, the rotary part 202A, and the support member 212 rotate counterclockwise in an x-z plane, and the gate valve 2196 is pushed upward (in the z-axis direction). As a result, the pressure $P_A$ in the space 2191A between the gate valves 2195 and 2196 becomes higher than the pressure in FIG. 25(*a*), and the pressure $P_B$ in the space 2191B between the gate valve 2196 and the main body 2191 becomes lower than the pressure in FIG. 25(*a*), so that the pressure $P_A$ becomes higher than the pressure $P_B$.

When the heel placing part 2092A reaches the floor surface 10 as shown in FIG. 25(*b*), in step S13 of the training guidance method shown in FIG. 24, the instructor instructs the trainee to stop applying the force Pw2 on the heel placing part 2092A.

Then, since the pressure $P_A$ in the space 2191A between the gate valves 2195 and 2196 is higher than the pressure $P_B$ in the space 2191B between the gate valve 2196 and the main body 2191, the gate valve 2196 is pushed toward the floor surface 10 (downward) by the pressure $P_A$ until one end of the support member 212 reaches the floor surface 10.

As a result, the rotary member 210, the support member 211, the rotary part 202A, and the support member 212 rotate clockwise in an x-z plane, and the heel placing part 2092A of the footrest member 209 moves upward from the floor surface 10 to move the heel 12 of the left foot 1 of the trainee upward. Then, the state shown in FIG. 25(*a*) is attained.

Subsequently, in step S14 of the training guidance method shown in FIG. 24, the instructor instructs the trainee to apply the force Pw2 on the heel placing part 2092A by the heel 13 of the other foot (right foot 2) until the heel placing part 2092A reaches the floor surface 10 while all the toes of the right foot 2 are in contact with the base part 2092 of the footrest member 213 (see FIG. 25(*b*)).

In this way, the trainee applies force Pw2 on the heel placing part 2092A by the heel 13 of the right foot 2 until the heel placing part 2092A reaches the floor surface 10 and moves the heel 13 toward the floor surface 10 (downward) while the second joint of the big toe and the third joint of the second toe, the third joint of the third toe, the third joint of the fourth toe, and the third joint of the fifth toe of the right foot 2 are pressed by the presser part 2091. Then, the rotary member 214, the support member 215, the rotary part 202B, and the support member 216 rotate counterclockwise in an x-z plane, and the gate valve 2196 is pushed upward (in the z-axis direction). As a result, the pressure $P_A$ in the space 2191A between the gate valves 2195 and 2196 becomes higher than the pressure in FIG. 25(*a*), and the pressure $P_B$ in the space 2191B between the gate valve 2196 and the main body 2191 becomes lower than the pressure in FIG. 25(*a*), so that the pressure $P_A$ becomes higher than the pressure $P_B$.

When the heel placing part 2092A reaches the floor surface 10 as shown in FIG. 25(*b*), in step S15 of the training guidance method shown in FIG. 24, the instructor instructs the trainee to stop applying the force Pw2 on the heel placing part 2092A.

Then, since the pressure $P_A$ in the space 2191A between the gate valves 2195 and 2196 is higher than the pressure $P_B$ in the space 2191B between the gate valve 2196 and the main body 2191, the gate valve 2196 is pushed by the pressure $P_A$ toward the floor surface 10 (downward) until one end of the support member 216 reaches the floor surface 10.

As a result, the rotary member 214, the support member 215, the rotary part 202B, and the support member 216 pivot clockwise in an x-z plane, and the heel placing part 2092A of the footrest member 213 moves upward from the floor surface 10 and moves the heel 13 of the right foot 2 of the trainee in the upward direction. Then, the state shown in FIG. 25(*a*) is attained.

As a result of guidance according to the training guidance method described in conjunction with FIGS. 24 and 25, in step S1 for checking physical ability, a trainee could not maintain a balance between the left and right sides and a balance between the front and back sides, force applied on the heel placing parts 2092A and 2132A to make the heel placing parts 2092A and 2132A of the footrest members 209 and 213 reach the floor surface 10 was weak, and the physical ability of the trainee was low, while in step S9 for checking the physical ability, it was confirmed that the trainee was able to maintain a balance between the left and right sides and a balance between the front and back sides, the force applied on the heel placing part 2092A and 2132A to make the heel placing parts 2092A and 2132A of the footrest members 209 and 213 reach the floor surface 10 was stronger, and the physical ability of the trainee was improved.

The description of the training guidance method shown in FIG. 18 applies to the training guidance method shown in FIG. 24 for the rest.

Figure 26:
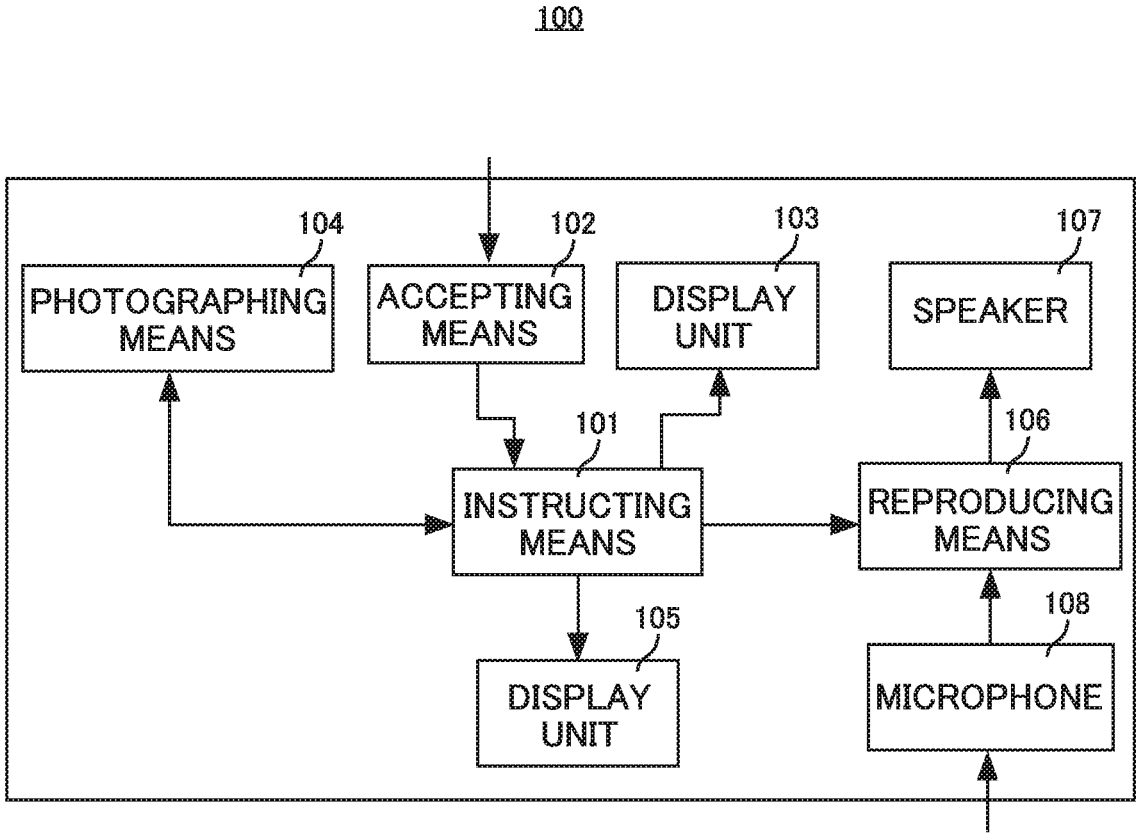
FIG. 26 is a schematic view of the structure of the training guidance apparatus according to the embodiment of the present invention.

FIG. 26 is a schematic diagram showing the structure of a training guidance apparatus according to the embodiment of the present invention.

Referring to FIG. 26, a training guidance apparatus 100 according to the embodiment of the present invention includes instructing means 101, accepting means 102, display units 103 and 105, photographing means 104, reproducing means 106, a speaker 107, and a microphone 108.

The instructing means 101 stores image information indicating postures of the trainee. The instructing means 101 also stores audio information for explaining the contents of steps S1 to S9 shown in FIG. 18. The instructing means 101 also stores character information for explaining the contents of steps S1 to S9 shown in FIG. 18.

The instructing means 101 receives a guidance start signal from the accepting means 102 and sequentially displays the image information and the character information at the display unit 103 and sequentially outputs the audio information to the reproducing means 106 in response to the received guidance start signal.

The instructing means 101 outputs a photographing instruction signal to the photographing means 104. The instructing means 101 receives image information indicating an image taken by the photographing means 104 from the photographing means 104 and displays the received image information at the display unit 105.

The accepting means 102 accepts a start of training from the instructor, generates a guidance start signal in response to the accepted start of training, and outputs the generated signal to the instructing means 101.

The display unit 103 sequentially displays the image information and the character information received from the instructing means 101.

The photographing means 104 receives a photographing instruction signal from the instructing means 101, photographs a trainee in response to the received photographing instruction signal, and outputs the image information of the photographed image to the instructing means 101.

The display unit 105 receives the image information from the instructing means 101 and displays the received image information.

The reproducing means 106 receives audio information from the instructing means 101, reproduces the received audio information, and outputs the reproduced audio information to the speaker 107.

In addition, the reproducing means 106 receives audio information from the microphone 108, reproduces the received audio information, and outputs the reproduced audio information to the speaker 107.

The speaker 107 receives the audio information from the reproducing means 106, amplifies the received audio information, and outputs the amplified audio information to the outside.

The microphone 108 is provided with audio information from an instructor as an input and outputs the input audio information to the reproducing means 106.

FIG. 27 is a diagram showing the concept of character information. Referring to FIG. 27, the character information CHR1 includes "please take a sitting posture on the seat with both feet in contact with the floor surface." Character information CHR2 includes "please take a standing posture with your feet set apart at a distance substantially equal to your shoulder width." Character information CHR3 includes "please take a sitting posture on the seat and cross the arms in front of the chest." Character information CHR4 includes "please take a standing posture and use the support member to support the body in a forward tilted posture with the upper limbs." Character information CHR5 includes "please put one of the right foot and the left foot forward, make the toes and heel in contact with the floor surface, put the other foot behind, have the second joint of the big toe and the third joints of the second toe, the third toe, the fourth toe, and the fifth toe of the other foot pressed by the presser part 2091 of the training guidance instrument 200, and put the heel of the other foot on the heel placing part 2092A." Character information CHR6 includes "please apply force on the heel placing part 2092A by the heel of the foot put behind until the heel placing part 2092A reaches the floor surface 10 while all the toes of the foot put behind are in contact with the base part 2092 of the footrest member." Character information CHR7 includes "please stop applying force on the heel placing part 2092A when the heel placing part 2092A reaches the floor surface 10." Character information CHR8 includes "please put the other foot forward, make the toes and the heel in contact with the floor surface, put one foot behind, have the second joint of the big toe and the third joints of the second toe, the third toe, the fourth toe, and the fifth toe of the one foot pressed by the presser part 2091 of the training guiding instrument 200, and place the heel of the one foot on the heel placing part 2092A." Character information CHR9 includes "please apply force Pw2 on the heel placing part 2092A by the heel of the foot put behind until the heel placing part 2092A reaches the floor surface while all the toes of the foot put behind are in contact with the base part 2092 of the footrest member." Character information CHR10 includes "please stop applying the force Pw2 on the heel placing part 2092A when the heel placing part 2092A reaches the floor surface 10."

The instructing means 101 of the training guidance apparatus 100 stores the character information CHR1 to CHR10. In addition, the instructing means 101 of the training guidance apparatus 100 stores audio information AUD1 to AUD10 having the same contents as the character information CHR1 to CHR10.

Figure 28:
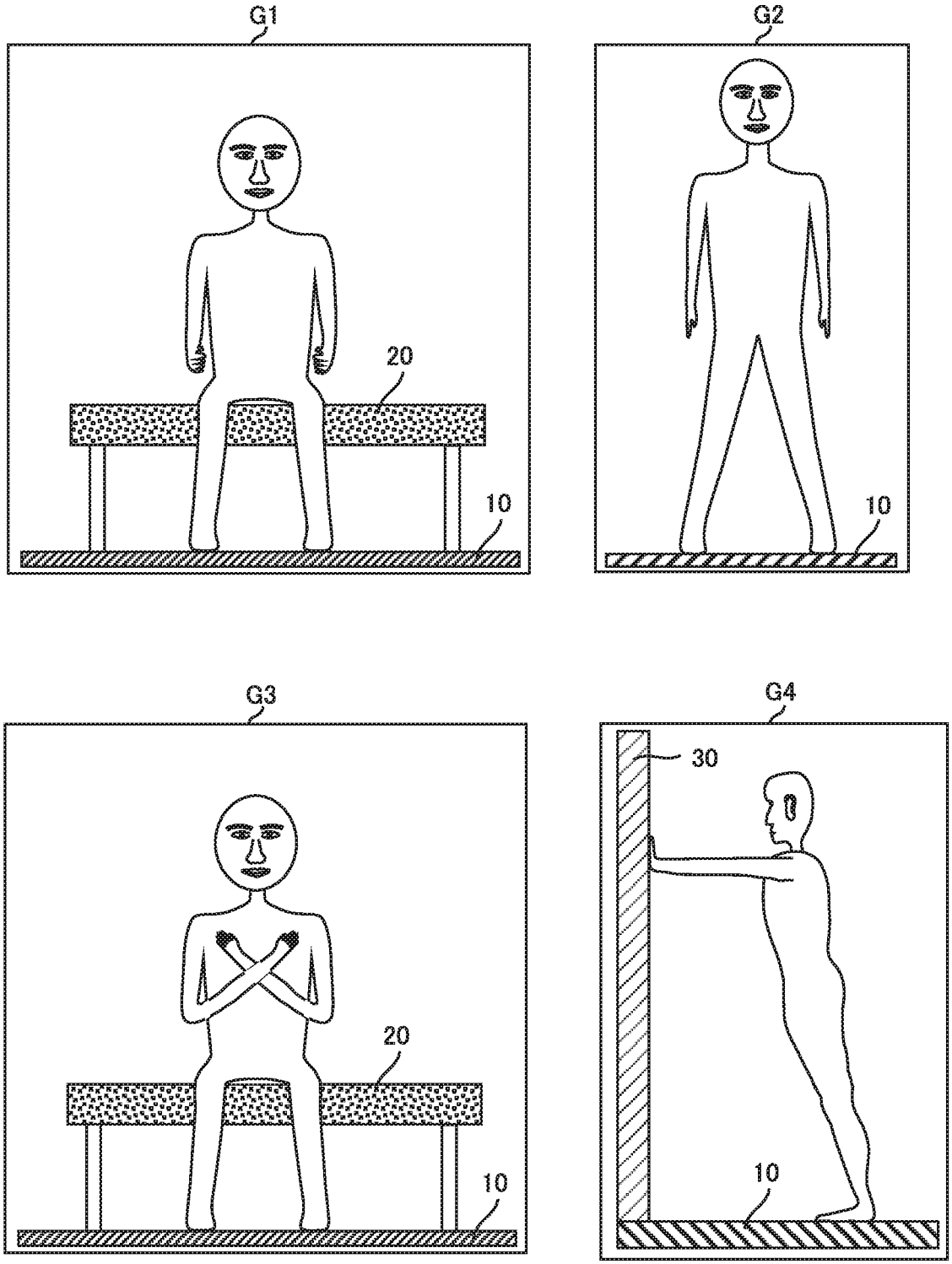
FIG. 28 is a view showing the concept of image information.
Figure 29:
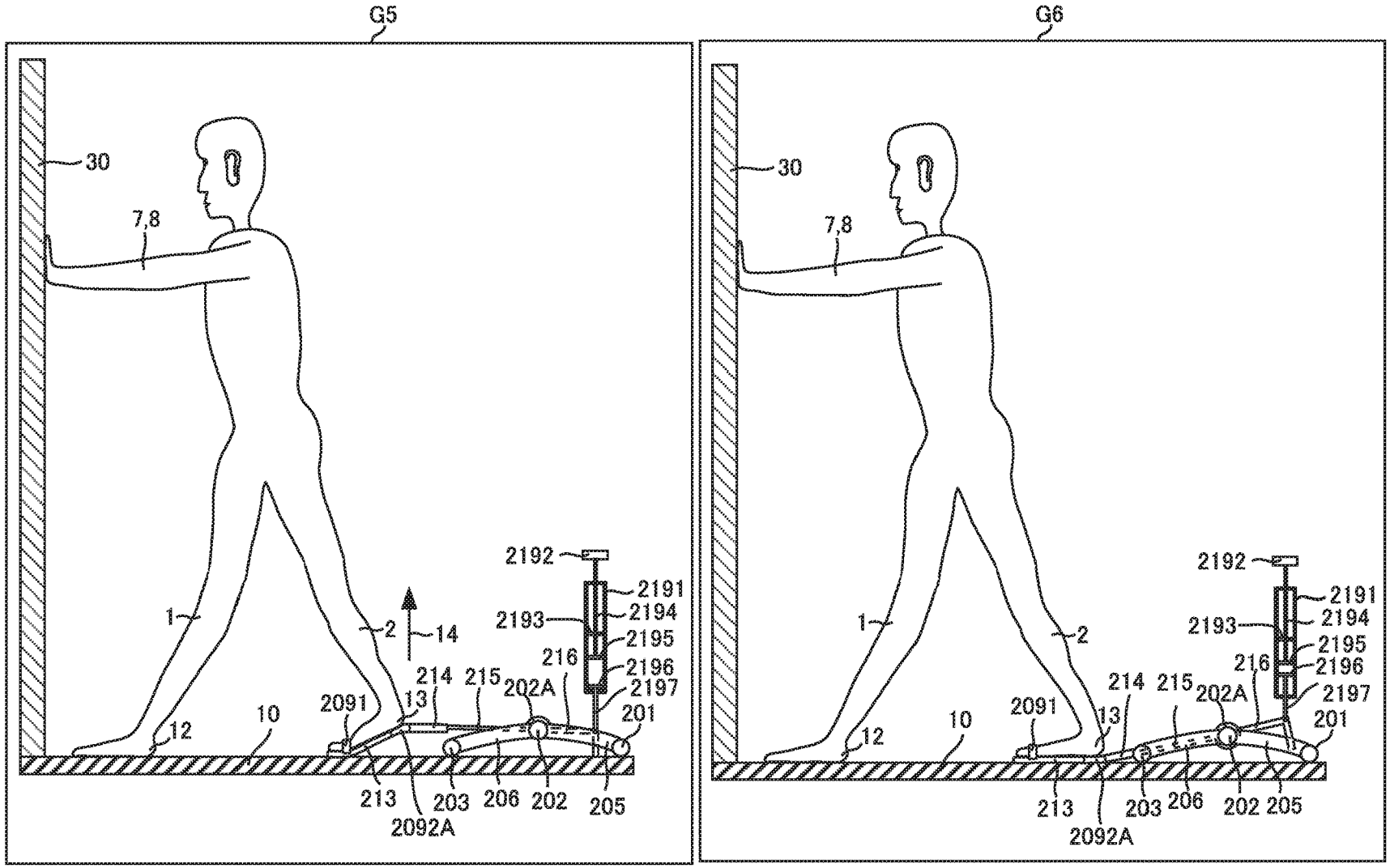
FIG. 29 is a view showing the concept of image information.

FIGS. 28 and 29 are diagrams each showing the concept of image information. Referring to FIG. 28, image information G1 indicates an image showing a sitting posture on the seat 20, image information G2 indicates an image showing the standing posture shown in FIG. 19, image information G3 indicates an image showing the sitting posture shown in FIG. 20, and image information G4 indicates an image showing a standing posture and a state in which the body is supported in a forward tilted posture with the upper limbs using the support member (the wall 30). Referring to FIG. 29, image information G5 indicates an image showing the standing posture shown in FIG. 22(*a*), and image information G6 indicates an image showing the standing posture shown in FIG. 22(*b*).

The instructing means 101 of the training guidance apparatus 100 stores the image information G1 to G6.

Figure 30:
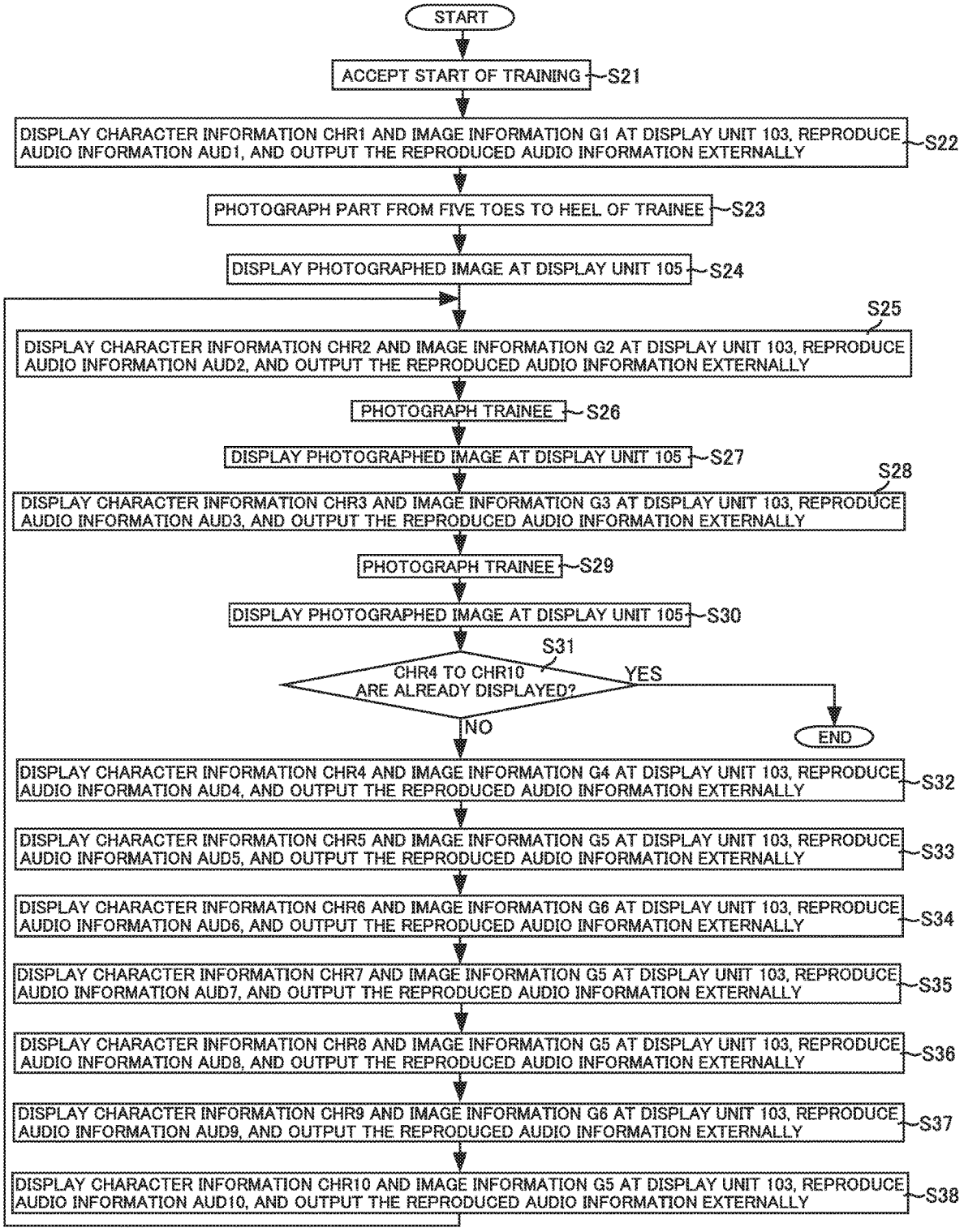
FIG. 30 is a flowchart for illustrating the operation of the training guidance apparatus shown in FIG. 26.

FIG. 30 is a flowchart for illustrating the operation of the training guidance apparatus 100 shown in FIG. 26.

Referring to FIG. 30, when the operation of the training guidance apparatus 100 starts, the accepting means 102 accepts a start of training from the instructor (step S21), and generates a guidance start signal on the basis of the accepted start of training and outputs the generated signal to the instructing means 101.

The instructing means 101 displays the character information CHR1 and the image information G1 at the display unit 103 and outputs the audio information AUD1 to the reproducing means 106 in response to the guidance start signal from the accepting means 102. The reproducing means 106 reproduces the audio information AUD1 and outputs the reproduced audio information AUD1 to the speaker 107, and the speaker 107 amplifies the audio information AUD1 and outputs the amplified audio information to the outside. In this way, the character information CHR1 and the image information G1 are displayed at the display unit 103, and the audio information AUD1 is output to the outside (step S22). As a result, the trainee looks at the character information CHR1 and the image information G1 displayed at the display unit 103, listens to the audio information AUD1, and then takes a sitting posture on the seat 20 while making the both feet contact the floor surface.

Then, the instructing means 101 generates a photographing instruction signal and outputs the generated signal to the photographing means 104, and the photographing means 104 photographs the part from the five toes to the heel of the foot of the trainee in response to the photographing instruction signal (step S23).

The photographing means 104 outputs the photographed image to the instructing means 101, and the instructing means 101 displays the image at the display unit 105 (step S24). In this way, the instructor can look at the image displayed at the display unit 105 and check the degree of how much the toes of the foot of the trainee contact the floor surface.

Thereafter, the instructing means 101 displays the character information CHR2 and the image information G2 at the display unit 103, and the instructing means 101, the reproducing means 106, and the speaker 107 reproduce the audio information AUD2 and outputs the reproduced audio information to the outside (step S25).

As a result, the trainee looks at the character information CHR2 and the image information G2 displayed at the display unit 103 and listens to the audio information AUD2 to take the standing posture shown in FIG. 19. The instructor pushes the deltoid muscles of the trainee to the left and the right.

Then, the instructing means 101 generates a photographing instruction signal and outputs the generated signal to the photographing means 104, and the photographing means 104 photographs the trainee when the deltoid muscles are pushed to the left and the right in response to the photographing instruction signal (step S26).

The photographing means 104 outputs the photographed image to the instructing means 101, and the instructing means 101 displays the image at the display unit 105 (step S27).

In this way, the instructor can look at the display unit 105 and check whether the trainee can maintain the standing posture shown in FIG. 19.

After step S27, the instructing means 101 displays the character information CHR3 and the image information G3 at the display unit 103, and the instructing means 101, the reproducing means 106 and the speaker 107 reproduce audio information AUD3 and output the reproduced audio information to the outside (step S28).

In this way, the trainee looks at the character information CHR3 and the image information G3 displayed at the display unit 103, listens to the audio information AUD3, and takes the sitting posture shown in FIG. 20. The instructor then pushes the left and right shoulders of the trainee to the back.

The instructing means 101 generates a photographing instruction signal and outputs the photographing instruction signal to the photographing means 104. In response to the photographing instruction signal, the photographing means 104 photographs the trainee when the left and right shoulders are pushed to the back (step S29).

The photographing means 104 outputs the photographed image to the instructing means 101, and the instructing means 101 displays the image at the display unit 105 (step S30).

In this way, the instructor can look at the display unit 105 and check whether the trainee can maintain the sitting posture shown in FIG. 20.

Thereafter, the instructing means 101 determines whether the character information CHR4 to CHR10 has already been displayed at the display unit 103 (step S31).

In step S31, if it is determined that the character information CHR4 to CHR10 has not been displayed at the display unit 103, the instructing means 101 displays the character information CHR4 and the image information G4 at the display unit 103, and the instructing means 101, the reproducing means 106, and the speaker 107 reproduce the audio information AUD4 and output the reproduced audio information to the outside (step S32).

In this way, the trainee looks at the character information CHR4 and the image information G4, listens to the audio information AUD4, and takes a standing posture having the body supported by the upper limbs in a forward tilted manner using the support member (the wall 30).

Thereafter, the instructing means 101 displays the character information CHR5 and the image information G5 at the display unit 103, and the instructing means 101, the reproducing means 106, and the speaker 107 reproduce the audio information AUD5 and output the reproduced audio information to the outside (step S33). In this way, the trainee looks at the character information CHR5 and the image information G5, listens to the audio information AUD5, and takes the standing posture shown in FIG. 22(*a*). In this case, the instructor preferably checks whether the heel of the foot put behind reaches the heel placing part 2092A. Then, the instructor preferably instructs the trainee to make the heel of the foot put behind contact the heel placing part 2092A if the heel of the foot put behind does not reach the heel placing part 2092A.

Subsequently, the instructing means 101 displays the character information CHR6 and the image information G6 at the display unit 103, and the instructing means 101, the reproducing means 106, and the speaker 107 reproduce the audio information AUD6 and output the reproduced audio information to the outside (step S34). In this way, the trainee looks at the character information CHR6 and the image information G6 and listens to the audio information AUD6, and as shown in FIG. 22(*b*), the trainee applies the force Pw2 on the heel placing part 2092A by the heel of the foot put behind until the heel placing part 2092A reaches the floor surface 10 and lower the heel of the foot put behind while the second joint of the big toe, the third joint of the second toe, the third joint of the second toe, the third joint of the third toe, the third joint of the fourth toe, and the third joint of the fifth toe are pressed by the presser part 2091 and all of the toes of the foot put behind are in contact with the base part 2092. In this case, the instructor preferably instructs the trainee to lower the heel without bending the knee of the foot put behind.

Then, the instructing means 101 displays the character information CHR7 and the image information G5 at the display unit 103, and the instructing means 101, the reproducing means 106, and the speaker 107 reproduce the audio information AUD7 and output the reproduced audio information to the outside (step S35). In this way, the trainee looks at the character information CHR7 and the image information G5, listens to the audio information AUD7, stops applying the force Pw2 on the heel placing part 2092A, and takes the standing posture shown in FIG. 22(*a*).

Thereafter, the instructing means 101 displays the character information CHR8 and the image information G5 (image information G5 in which the left foot and the right foot are exchanged) at the display unit 103, and the instructing means 101, the reproducing means 106 and the speaker 107 reproduce the audio information AUD8 and outputs the reproduced audio information to the outside (step S36). In this way, the trainee looks at the character information CHR8 and the image information G5 (the image information G5 in which the left foot and the right foot are exchanged), listens to the audio information AUD8, and takes the standing posture shown in FIG. 22(*a*) (the standing posture in which the left foot 1 and the right foot 2 are replaced in FIG. 22(*a*)). In this case, the instructor preferably checks whether the heel of the foot put behind is in contact with the heel placing part 2092A. Then, the instructor preferably instructs the trainee to have the heel of the foot put behind contact the heel placing part 2092A if the heel of the foot put behind is not in contact with the heel placing part 2092A.

Subsequently, the instructing means 101 displays the character information CHR9 and the image information G6 (the image information G5 in which the left foot and the right foot are exchanged) at the display unit 103, and the instructing means 101, the reproducing means 106, and the speaker 107 reproduce the audio information AUD9 and output the reproduced audio information to the outside (step S37). In this way, the trainee looks at the character information CHR9 and the image information G6 (the image information G5 in which the left foot and the right foot are exchanged), listens to the audio information AUD9, and applies the force Pw2 on the heel placing part 2092A and lowers the heel of the foot put behind until the heel placing part 2092A reaches the floor surface 10 by the heel of the foot put behind while the second joint of the big toe, the third joint of the second toe, the third joint of the third toe, the third joint of the fourth toe, and the third joint of the fifth toe of the foot put behind are pressed by the presser part 2091 and all the toes of the foot put behind are in contact with the base part 2092 as shown in FIG. 22(*b*). In this case, the instructor preferably instructs the trainee to lower the heel without bending the knee of the foot put behind.

Then, the instructing means 101 displays the character information CHR10 and the image information G5 (image information G5 in which the left foot and the right foot are exchanged) at the display unit 103, and the instructing means 101, the reproducing means 106, and the speaker 107 reproduce the audio information AUD10 and outputs the reproduced audio information to the outside (step S38). In this way, the trainee looks at the character information CHR10 and the image information G5 (the image information G5 in which the left foot and the right foot are exchanged), listens to the audio information AUD10, stops applying the force Pw2 on the heel placing part 2092A, and takes the standing posture shown in FIG. 22(*a*) (the standing posture in which the left foot 1 and the right foot 2 are exchanged in FIG. 22(*a*)).

After step S38, the operation of the training guidance apparatus 100 returns to step S25, and the above-described steps S25 to S31 are repeatedly executed. Then, if it is determined in step S31 that the character information CHR4 to CHR10 has already been displayed at the display unit 103, the operation of the training guidance apparatus 100 ends.

The above-described steps S22 to S30 correspond to step S1 shown in FIG. 18. Steps S22 to S24 correspond to checking "how much the toes of the foot of the trainee contact the floor surface" in step S1 shown in FIG. 18, and steps S25 to S27 executed for the first time correspond to "checking a balance between the left and right sides in the trunk balance" as a method for checking the physical ability of the trainee in step S1 shown in FIG. 18. Steps S28 to S30 executed for the first time correspond to checking "a balance between the front and back sides in the trunk balance" as a method for checking the physical ability of the trainee in step S1 in FIG. 18.

Step S32 corresponds to step S2 shown in FIG. 18, step S33 corresponds to step S3 shown in FIG. 18, step S34 corresponds to step S4 shown in FIG. 18, step S35 corresponds to step S5 shown in FIG. 18, step S36 corresponds to step S6 shown in FIG. 18, step S37 corresponds to step S7 shown in FIG. 18, step S38 corresponds to step S8 shown in FIG. 18, and steps S25 to S30 executed after step S38 correspond to step S9 shown in FIG. 18.

In the flowchart shown in FIG. 30, steps S33 to S35 may be sequentially executed five to ten times (a prescribed number of times), and steps S36 to S38 may be sequentially executed five to ten times (a prescribed number of times).

Furthermore, in the flowchart shown in FIG. 30, single or multiple sequential execution of steps S33 to S35 and single or multiple sequential execution of step S36 to step S38 may be repeated.

In this way, the training guidance method shown in FIG. 18 can be executed using the training guidance apparatus 100.

In step S24, the instructor can check the presence of hallux valgus, floating toes, a bunionette, and the like of the foot of the trainee by looking at the image displayed at the display unit 105.

In step S27, the instructor can check a balance between the left and right sides of the trainee as a method for checking the physical ability of the trainee by looking at the image displayed at the display unit 105. In step S30, the instructor can check a balance between the front and back sides of the trainee as a method for checking the physical ability of the trainee by looking at the displayed image at the display unit 105.

When the training guidance method executed using the training guidance instrument 200 is carried out using the training guidance apparatus 100, one or more instructors may check whether the movement of the trainees is conducted as instructed. In this manner, the trainee can be instructed correctly. As a result, the physical ability of the trainee can be effectively improved.

Furthermore, in the flowchart shown in FIG. 30, the step of taking an image of the trainee by the photographing means 104 and displaying the image of the trainee at the display unit 105 may be added between steps S32 and S33, between steps S33 and S34, between steps S34 and S35, between steps S35 and S36, between steps S36 and S37, between the steps S37 and S38, and between steps S38 and S25. In this way, the instructor can check whether the trainee follows the instruction when each of steps S32 to S38 is executed. Then, if the movement is not as instructed, the instructor inputs audio information for instructing the trainee to perform the movement as instructed by using the microphone 108, and the reproducing means 106 of the training guidance apparatus 100 reproduces the audio information from the microphone 108 and outputs the audio information to the speaker 107, so that the speaker 107 amplifies the audio information and outputs the amplified audio information to the outside. In this way, the trainee can be instructed correctly. As a result, the physical ability of the trainee can be improved accurately.

In the description in conjunction with FIG. 30, the training guidance apparatus 100 executes the training guidance method using the training guidance instrument 200. However, the operation by the training guidance apparatus 100 to carry out the training method shown in FIG. 18 using the training guidance instrument 200A or the training guidance instrument 200B is also executed according to the flowchart shown in FIG. 30.

FIG. 31 is a diagram showing the concept of another kind of character information. Referring to FIG. 31, the character information CHR1 to the character information CHR3 are as described above. Character information CHR11 includes "please bend the knees to take a sitting posture, have the second joint of the big toe and the third joints of the second toe, the third toe, the fourth toe, and the fifth toe of the left foot pressed by the presser part 2091 of the footrest member 209, place the heel of the left foot on the heel placing part 2092A of the footrest member 209, have the second joint of the big toe and the third joints of the second toe, the third toe, the fourth toe, and the fifth toe of the right foot by the presser part 2091 of the footrest member 213, and place the heel of the right foot on the heel placing part 2092A of the footrest member 213." Character information CHR12 includes "please apply force Pw2 on heel placing part 2092A by the heel of one of the right foot and the left foot until the heel placing part 2092A reaches the floor surface while all the toes of the foot are in contact with the base part 2092 of the footrest member." Character information CHR13 includes "please stop applying the force Pw2 on the heel placing part 2092A when the heel placing part 2092A reaches the floor surface 10." Character information CHR14 includes "please apply the force Pw2 on the heel placing part 2092A by the heel of the other foot until the heel placing part 2092A reaches the floor surface 10 while all the toes of the other foot are in contact with the base part 2092 of the footrest member." Character information CHR15 includes "please stop applying the force Pw2 on the heel placing part 2092A when the heel placing part 2092A reaches the floor surface 10."

The instructing means 101 of the training guidance apparatus 100 stores the character information CHR1 to CHR 3 and CHR11 to CHR15. The instructing means 101 of the training guidance apparatus 100 also stores the audio information AUD1 to AUD3 and AUD11 to AUD15 having the same contents as the character information CHR1 to CHR 3 and CHR11 to CHR15, respectively.

Figure 32:
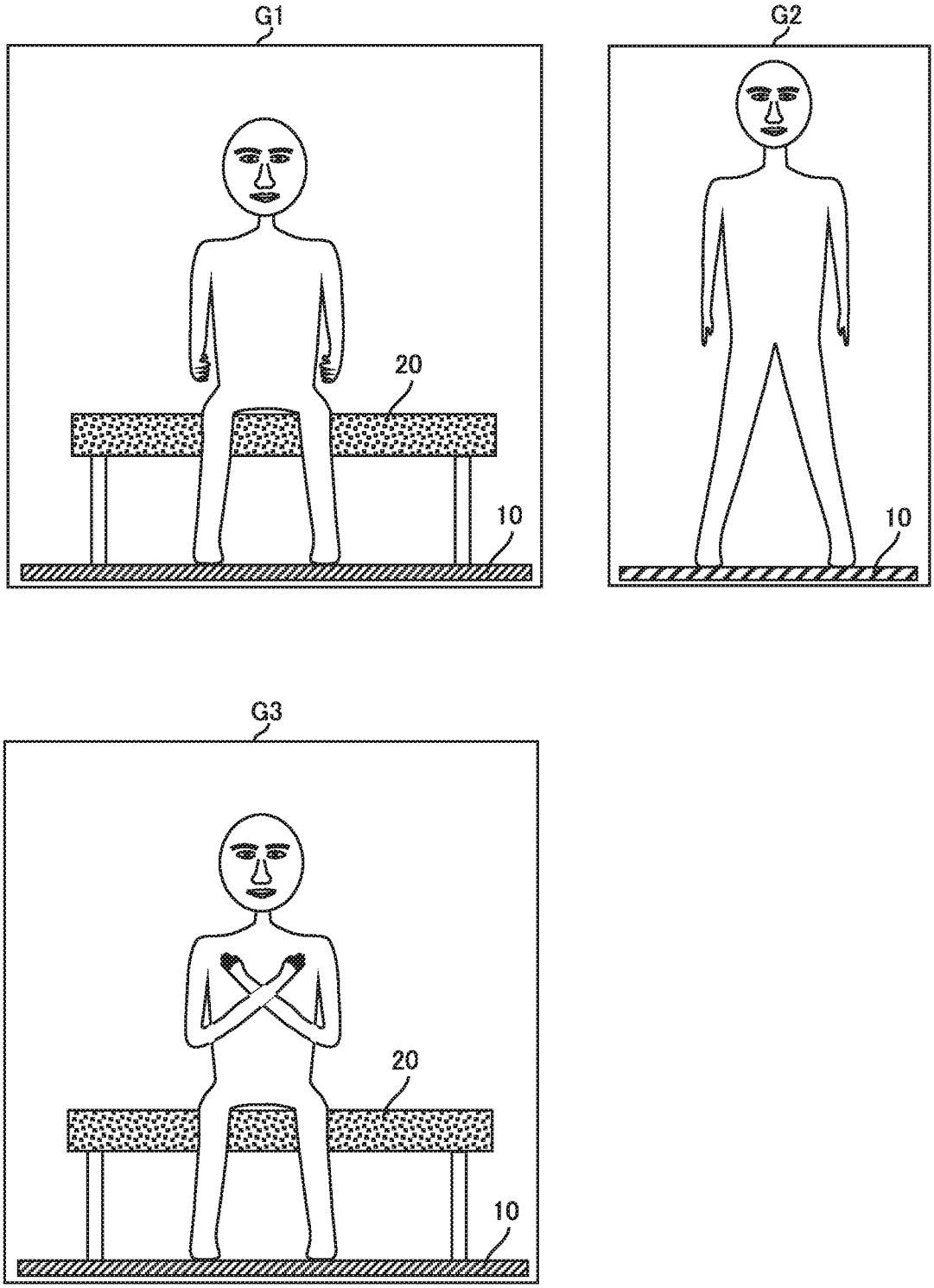
FIG. 32 is a view showing the concept of another kind of image information.

FIGS. 32 and 33 are diagrams showing the concept of other kinds of image information. Referring to FIG. 32, the image information G1 to G3 are as described above.

Referring to FIG. 33, image information G7 shows a sitting posture shown in FIG. 25(*a*), and image information G8 shows a sitting posture shown in FIG. 25(*b*).

The instructing means 101 of the training guidance apparatus 100 stores image information G1 to G3, G7, and G8.

Figure 34:
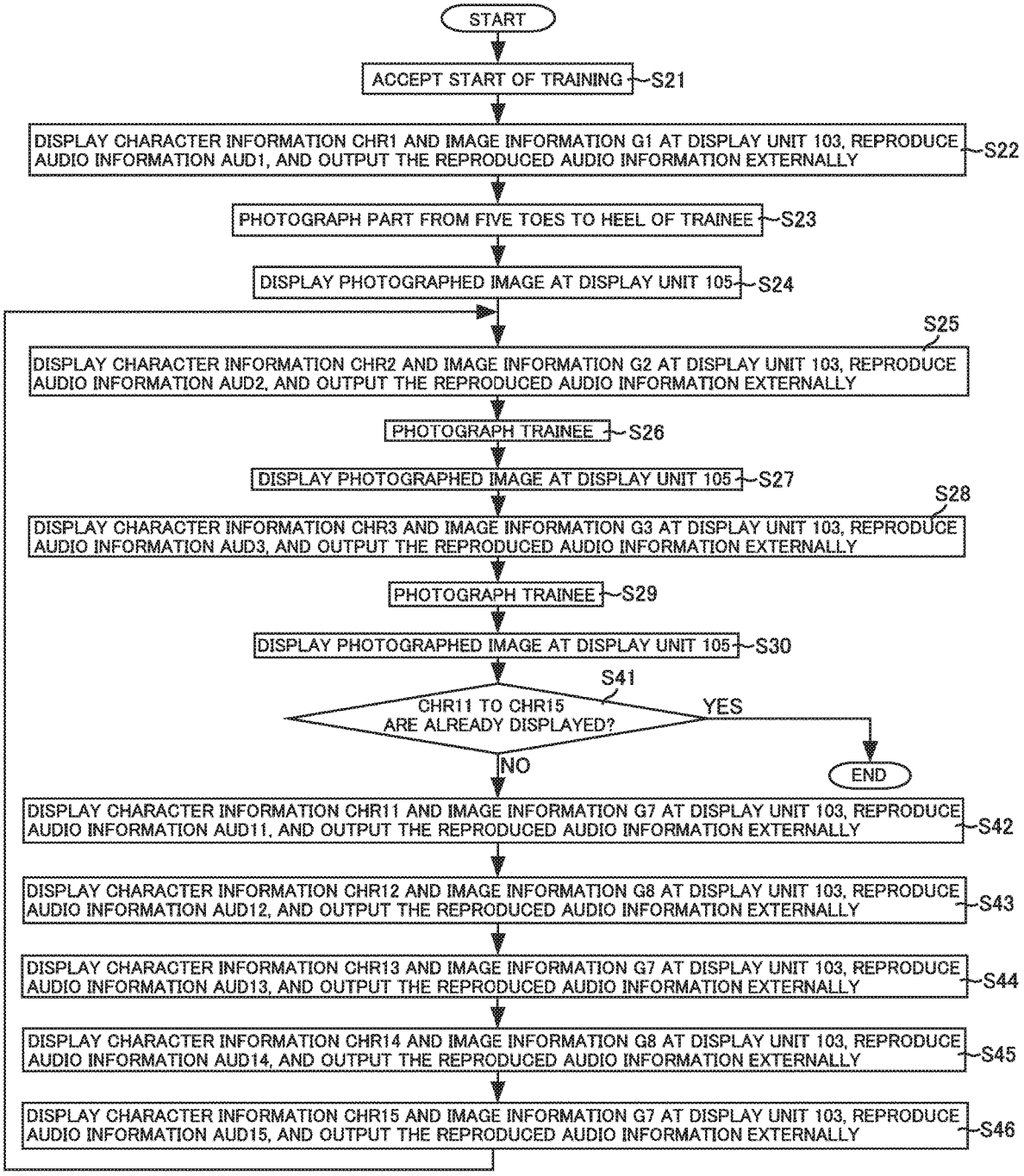
FIG. 34 is a flowchart for illustrating another kind of operation by the training guidance apparatus shown in FIG. 26.

FIG. 34 is a flowchart for illustrating another kind of operation of the training guidance apparatus 100 shown in FIG. 26.

In the flowchart shown in FIG. 34, steps S31 to S38 of the flowchart shown in FIG. 30 are replaced by steps S41 to S46, and the other steps are the same as those in the flowchart shown in FIG. 30.

Referring to FIG. 34, when the operation of training guidance apparatus 100 starts, steps S21 to S30 described above are sequentially executed.

Then, the instructing means 101 determines whether the character information CHR11 to CHR15 has already been displayed at the display unit 103 (step S41).

When it is determined in step S41 that the character information CHR11 to CHR15 has not been displayed at the display unit 103, the instructing means 101 displays the character information CHR11 and the image information G7 at the display unit 103, and the instructing means 101, the reproducing means 106, and the speaker 107 reproduce the audio information AUD11 and output the reproduced audio information to the outside (step S42). In this way, upon looking at the character information CHR11 and the image information G7 and listening to the audio information AUD11, the trainee bends the knees to take a sitting posture, has the second joint of the big toe and the third joints of the second toe, the third toe, the fourth toe, and the fifth toe of the left foot pressed by the presser part 2091 of the footrest member 209, place the heel of the left foot on the heel placing part 2092A of the footrest member 209, has the second joint of the big toe and the third joints of the second toe, the third toe, the fourth toe, and the fifth toe of the right foot pressed by the presser part 2091 of the footrest member 213, and place the heel of the right foot on the heel placing part 2092A of the footrest member 213 to take the sitting posture shown in FIG. 25(*a*).

Thereafter, the instructing means 101 displays the character information CHR12 and the image information G8 at the display unit 103, and the instructing means 101, the reproducing means 106, and the speaker 107 reproduce the audio information AUD12 and output the reproduced audio information to the outside (step S43). In this way, upon looking at the character information CHR12 and the image information G8 and listening to the audio information AUD12, the trainee applies the force Pw2 on the heel placing part 2092A until the heel placing part 2092A reaches the floor surface 10 and lowers the heel of one foot downward while having the second joint of the big toe, the third joint of the second toe, the third joint of the third toe, the third joint of the fourth toe, and the third joint of the fifth toe of one foot pressed by the presser part 2091 and all the toes of the foot contact the base part 2092 of the footrest member 213. More specifically, the trainee takes the sitting posture shown in FIG. 25(*b*).

Subsequently, the instructing means 101 displays the character information CHR13 and the image information G7 at the display unit 103, and the instructing means 101, the reproducing means 106, and the speaker 107 reproduce audio information AUD13 and output the reproduced audio information to the outside (step S44). In this way, upon looking at t the character information CHR13 and the image information G7 and listening to the audio information AUD13, the trainee stops applying the force Pw2 on the heel placing part 2092A. Then, the gate valve 2196 is pushed downward (toward the floor surface 10) by the pressure $P_A$ in the space 2191A between the gate valves 2195 and 2196, and the rotary member 210, the support member 211, the rotary part 202A and the support member 212 rotate clockwise in an x-z plane. As a result, the heel placing part 2092A is moved upward, and the trainee raises the heel upward. More specifically, the trainee takes the sitting posture shown in FIG. 25(*a*).

Then, the instructing means 101 displays the character information CHR14 and the image information G8 (the image in which the heel of the foot different from the foot in the step S43 is placed on the heel placing part 2092A) at the display unit 103, and the instructing means 101, the reproducing means 106, and the speaker 107 reproduce the audio information AUD14 and outputs the reproduced audio information to the outside (step S45). In this way, upon looking at the character information CHR14 and the image information G8 (the image in which the heel of the foot different from the foot in the step S43 is placed on the heel placing part 2092A) and listening to the audio information AUD14, the trainee applies the force Pw2 on the heel placing part 2092A by the heel of the other foot until the heel placing part 2092A reaches the floor surface 10 and lowers the heel of the other foot downward while the second joint of the big toe and the third joints of the second toe, the third toe, the fourth toe, and the fifth toe of the other foot are pressed by the presser part 2091 and all the toes of the other foot are in contact with the base part 2092 of footrest member. More specifically, the trainee takes the sitting posture shown in FIG. 25(*b*) (the sitting posture in which the foot that raises the heel upward is replaced).

Thereafter, the instructing means 101 displays the character information CHR15 and the image information G7 at the display unit 103, and the instructing means 101, the reproducing means 106, and the speaker 107 reproduce the audio information AUD15 and output the reproduced audio information to the outside (step S46). In this way, upon looking at the character information CHR15 and the image information G7 and listening to the audio information AUD15, the trainee stops applying the force Pw2 on the heel placing part 2092A. Then, the gate valve 2196 is pushed downward (toward the floor surface 10) by the pressure $P_A$ in the space 2191A between the gate valves 2195 and 2196, and the rotary member 210, the support member 211, the rotary part 202A, and the support member 212 rotate clockwise in an x-z plane. As a result, the heel placing part 2092A is moved upward, and the trainee raises the heel upward. More specifically, the trainee takes the sitting posture shown in FIG. 25(*a*).

After step S46, the operation of the training guidance apparatus 100 returns to step S25, and the above-described steps S25 to S30 and S41 are repeatedly executed. Then, if it is determined in step S41 that the character information CHR11 to CHR15 has already been displayed at the display unit 103, the operation of the training guidance apparatus 100 ends.

The above-described steps S22 to S30 correspond to step S1 shown in FIG. 24. Steps S22 to S24 correspond to checking "how much the toes of the feet of the trainee contact the floor surface" in step S1 shown in FIG. 24, and steps S25 to S27 executed for the first time correspond to checking "a balance between the left and right sides in the trunk balance" as a method for checking the physical ability of the trainee in step S1 shown in FIG. 24. Steps S28 to S30 executed for the first time correspond to checking "a balance between the front and back sides in the trunk balance" as a method for checking the physical ability of the trainee in step S1 shown in FIG. 24.

Step S42 corresponds to step S11 shown in FIG. 24, step S43 corresponds to step S12 shown in FIG. 24, step S44 corresponds to step S13 in FIG. 24, step S45 corresponds to step S14 shown in FIG. 24, step S46 corresponds to step S15 shown in FIG. 24, and steps S25 to S30 executed after step S46 correspond to step S9 shown in FIG. 24.

In the flowchart shown in FIG. 34, steps S43 and S44 may be sequentially executed five to ten times (a prescribed number of times), and steps S44 and S45 may be sequentially executed five to ten times (a prescribe number of times).

Furthermore, in the flowchart shown in FIG. 34, single or multiple execution of steps S43 and S44 and single or multiple execution of steps S44 and S45 may be repeated.

Furthermore, in the flowchart shown in FIG. 34, steps S43 and S45 may be executed simultaneously, and steps S44 and S46 may be executed simultaneously.

Furthermore, in the flowchart shown in FIG. 34, five to ten times (a prescribed number of times) of execution of steps S43 and S45 and five or ten times (a prescribed number of times) of execution of steps S44 and S46 may be performed simultaneously.

In this way, the training guidance method using the training guidance instrument 200 shown in FIG. 24 can be executed by the training guidance apparatus 100.

Note that when the training guidance method is executed by the training guidance apparatus 100, one or more instructors may check whether the movement of the trainee is as instructed. In this way, the trainee can be instructed correctly. As a result, the physical ability of the trainees can effectively be improved.

Furthermore, in the flowchart shown in FIG. 34, the step of photographing the trainee by the photographing means 104 and displaying the image of the trainee at the display unit 105 may be added between steps S42 and S43, between steps S43 and S44, between steps S44 and S45, between steps S45 and S46, and between step S46 and step S25. In this way, the instructor can check whether the trainee moves as instructed when each of steps S42 to S46 is executed. Then, if the operation is not carried out as instructed, the instructor inputs audio information for instructing the trainee to perform the movement as instructed by using the microphone 108, and the reproducing means 106 of the training guidance apparatus 100 reproduces audio information from the microphone 108 and outputs the reproduced audio information to the speaker 107, and the speaker 107 amplifies the audio information and outputs the amplified audio information to the outside. In this way, the trainee can be instructed correctly. As a result, the physical ability of the trainees can effectively be improved.

Note that in the description in conjunction with FIG. 34, the training guidance apparatus 100 executes the training guidance method shown in FIG. 24 using the training guidance instrument 200, but the operation for executing the training guidance method shown in FIG. 24 by the training guidance apparatus 100 using the training guidance instrument 200A or the training guidance instrument 200B is also executed according to the flowchart shown in FIG. 34.

As for the rest, the description in connection with FIG. 34 is the same as the description in connection with FIG. 30.

According to the embodiment of the present invention, the operation of the training guidance apparatus 100 may be executed by software. In this case, the training guidance apparatus 100 includes a CPU (Central Processing Unit), a ROM (Read Only Memory), a RAM (Random Access Memory), display unites 103 and 105, a speaker 107, and a microphone 108.

The ROM stores a program Prog_A including steps S21 to S38 in the flowchart shown in FIG. 30, a program Prog_B including steps S21 to S30 and S41 to S46 in the flowchart shown in FIG. 34, the character information CHR1 to CHR10, the character information CHR1 to CHR3 and CHR11 to CHR15, the image information G1 to G6, the image information G1 to G3, G7 and G8, the audio information AUD1 to AUD10, and the audio information AUD1 to AUD3 and AUD11 to AUD15. The RAM temporarily stores photographed images.

The CPU reads the program Prog_A (or the program Prog_B) from the ROM and executes the program. In this case, the CPU displays the images stored in the RAM at the display unit 105.

In this way, the above-described training guidance method shown in FIG. 18 or the training guidance method shown in FIG. 24 is executed.

Therefore, the program Prog_A (or program Prog_B) is a program for causing a computer (CPU) to execute the training guidance method.

Furthermore, the program Prog_A (or the program Prog_B) may be recorded on a recording medium such as a CD and a DVD and distributed. When a recording medium in which the program Prog_A (or the program Prog_B) is recorded is mounted to a personal computer, the CPU (computer) reads and the program Prog_A (or the program Prog_B) from the recording medium and executes the program. In this way, the above-described training guidance method shown in FIG. 18 or the training guidance method shown in FIG. 24 is executed.

Therefore, the recording medium having the program Prog_A (or program Prog_B) recorded therein is a computer (CPU) readable recording medium.

As described above, the training guidance method according to the embodiment of the present invention may be executed by an instructor or may be executed by the training guidance apparatus 100 (the instructor may also join in some cases).

In addition, the training guidance method according to the embodiment of the present invention may be executed in a facility such as a training center or may be executed outdoors.

In the above description, the trainee keeps the forward tilted posture having the palms of both hands in contact with the wall 30. However, according to the embodiment of the present invention, the trainee may use any member to keep the forward tilted posture if the posture can be maintained, and in general, the forward tilted posture may be maintained using the support member.

In the above description, the trainee is instructed to move the heel up and down in the vertical direction while the second joint of the big toe, the third joint of the second toe, the third joint of the third toe, the third joint of the fourth toe, and the third joint of the fifth toe are pressed by the presser part 2091 of the training guidance instrument 200, 200A, or 200B and all the toes of the foot are in contact with the base part 2092 of the footrest member 209 or 213.

Steps S1 and S9 in the flow chart shown in FIGS. 18 and 26 and steps S22 to S30 in the flowchart shown in FIGS. 30 and 34 are steps for checking the physical ability of the trainee, and it is not a step to instruct the trainee. Therefore, steps S1 and S9 in the flowchart shown in FIGS. 18 and 24 and steps S22 to S30 of the flowchart shown in FIGS. 30 and 34 do not need to be executed and as a training guidance method according to the embodiment of the present invention, steps S2 to S8 in the flowchart shown in FIG. 18, steps S11 to S15 in the flowchart shown in FIG. 24, steps S32 to S38 in the flowchart shown in FIG. 30, and steps S42 to S46 in the flowchart shown in FIG. 34 may be executed.

Therefore, the training guidance method according to the embodiment of the present invention may be a training guidance method for instructing a trainee by using any one of the training guidance instruments 200, 200A, and 200B, and the training guidance method includes instructing a trainee to carry out, at least once for both feet of the trainee, the operation of applying the second force (any of the forces Pw2, Pw4, and Pw6 described above) on the heel placing part so that the heel placing part positioned above and away from the ground approaches the ground and the operation of weakening the force toward the ground applied on the heel placing part to be less than the second force (any of the forces Pw2, Pw4, and Pw6 described above) as the heel placing part approaches the ground, while the second and third joints of the foot of the trainee are pressed by the presser part and the heel of the foot of the trainee is in contact with the heel placing part. Here, "weakening the force toward the ground applied on the heel placing part to be less than the second force (any one of the forces Pw2, Pw4, and Pw6 described above) as the heel placing part approaches the ground" includes stopping applying the force toward the ground on the heel placing part.

The training guidance method according to the embodiment of the present invention may further include the step of checking how much the toes of the trainee contact the ground in a sitting posture with the feet in contact with the ground and the physical ability of the trainee before the operation of applying the second force (any of the forces Pw2, Pw4, and Pw6 described above) on the heel placing part so that the heel placing part positioned above and away from the ground approaches the ground and the operation of weakening the force toward the ground applied on the heel placing part to be less than the second force (any of the forces Pw2, Pw4, and Pw6 described above) as the heel placing part approaches the ground and the step of checking the physical ability of the trainee after the operation of applying the second force (any of the forces Pw2, Pw4, and Pw6 described above) on the heel placing part so that the heel placing part positioned above and away from the ground approaches the ground and the operation of weakening the force toward the ground applied on the heel placing part to be less than the second force (any of the forces Pw2, Pw4, and Pw6 described above) as the heel placing part approaches the ground.

In this way, the step of checking the physical ability of the trainee allows evaluation of the advantageous effect provided as a result of carrying out the operation of applying the second force (any of the forces Pw2, Pw4, and Pw6 described above) on the heel placing part so that the heel placing part positioned above and away from the ground approaches the ground and the operation of weakening the force toward the ground applied on the heel placing part to be less than the second force (any of the forces Pw2, Pw4, and Pw6 described above) as the heel placing part approaches the ground. Since the advantageous effect provided as a result of carrying out the operation of applying the second force (any of the forces Pw2, Pw4, and Pw6 described above) on the heel placing part so that the heel placing part positioned above and away from the ground approaches the ground and the operation of weakening the force toward the ground applied on the heel placing part to be less than the second force (any of the forces Pw2, Pw4, and Pw6 described above) as the heel placing part approaches the ground may be immediately observed, the advantageous effects provided as a result of carrying out these kinds of operation can easily be checked by checking the physical ability of the trainee before and after these kinds of operation are executed.

In the training guidance method using the above-described training guidance instrument 200, 200A, or 200B, the trainee is instructed to carry out, while the second joint of the big toe and the third joints of the second toe, the third toe, the fourth toe, and the fifth toe are pressed by the presser part 2091, first operation for applying the force Pw2, Pw4, or Pw6 stronger than the force Pw1, Pw3, or Pw5 against the force Pw1, Pw3, or Pw5 on the heel placing part 2092A or 2132A by the heel of the trainee when the force Pw1, Pw3, or Pw5 is applied on the heel placing part 2092A or 2132A of the footrest member 209 or 213, so that the heel placing part 2092A or 2132A is moved toward the ground, and second operation for moving the heel of the trainee toward the ground as the heel placing part 2092A or 2132A approaches the ground and weakening the force applied on the heel placing part 2092A or 2132A to be less than the force Pw2, Pw4, or Pw6, so that the heel placing part 2092A or 2132A is moved upward from the ground.

In particular, the training guidance method is different from any of conventional training guidance methods in that the trainee is instructed to carry out the first operation.

The disclosed embodiment herein is to be considered in all respects as illustrative and not restrictive. The scope of the invention being indicated by the appended claims rather than by the foregoing description of the embodiment, and all changes which come within the meaning and range of equivalency of the claims are therefore intended to be embraced therein.

INDUSTRIAL APPLICABILITY

The present invention is applicable to a training guidance instrument and a training guidance method using the same.

The invention claimed is:

1. A training guidance instrument, comprising:

a presser part for pressing the second joint of a big toe and the third joints of a second toe, a third toe, a fourth toe, and a fifth toe of a trainee;

a heel placing part for placing a heel of the trainee thereon;

a control unit configured to apply a first force upward from the ground on the heel placing part; and a rotary member provided rotatably around an axis of a support member provided on the ground and having one end attached to the support member and the other end connected to the heel placing part; wherein the heel placing part is configured to move toward the ground in response to application of a second force by the trainee on the heel placing part when the heel placing part is positioned at a first position higher than the ground and the second force is stronger than the first force, and to move upward from the ground in response to application of a third force by the trainee on the heel placing part toward the ground that is weaker than the first force when the heel placing part is positioned below the first position and above the ground, while the second joint of the big toe and the third joints of the second to fifth toes of the trainee are pressed by the presser part;

the other end of the rotary member moves toward the ground in response to application of the second force by the trainee on the heel placing part when the heel placing part is positioned at the first position;

the other end of the rotary member moves upward in response to the third force applied by the trainee on the heel placing part when the heel placing part is positioned below the first position;

the rotary member includes:

a rotary part that rotates in a circumferential direction around the axis of the support member;

a first support member having one end connected to the heel placing part and other end connected to the rotary part; and a second support member having one end connected to the rotary part so as to form a straight line with the first support member;

the control unit applies the first force toward the ground on the other end of the second support member;

the one end of the first support member applies the first force upward from the ground on the heel placing part due to rotation of the rotary part in response to the application of the first force by the control unit on the other end of the second support member;

the one end of the first support member moves the heel placing part toward the ground due to rotation of the rotary part in response to the application of the second force by the trainee on the heel placing part when the heel placing part is positioned at the first position; and the one end of the first support member moves the heel placing part upward due to rotation of the rotary part in response to the third force applied by the trainee on the heel placing part when the heel placing part is positioned at the second position.

* * * * *